US011235212B2

(12) United States Patent
Clarke et al.

(10) Patent No.: US 11,235,212 B2
(45) Date of Patent: Feb. 1, 2022

(54) MULTI-MATERIAL IRON GOLF CLUB HEAD

(71) Applicant: KARSTEN MANUFACTURING CORPORATION, Phoenix, AZ (US)

(72) Inventors: Jacob T. Clarke, Phoenix, AZ (US); Cory S. Bacon, Cave Creek, AZ (US); Dave Wu, Pingtung (TW); Martin R. Jertson, Phoenix, AZ (US); Travis D. Milleman, Portland, OR (US); Ryan M. Stokke, Anthem, AZ (US); Clayson C. Spackman, Scottsdale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 16/894,706

(22) Filed: Jun. 5, 2020

(65) Prior Publication Data

US 2020/0298077 A1 Sep. 24, 2020

Related U.S. Application Data

(63) Continuation-in-part of application No. 16/286,462, filed on Feb. 26, 2019.

(Continued)

(51) Int. Cl.
*A63B 53/04* (2015.01)
*A63B 53/08* (2015.01)

(52) U.S. Cl.
CPC ..... *A63B 53/0475* (2013.01); *A63B 53/0412* (2020.08); *A63B 53/0416* (2020.08);
(Continued)

(58) Field of Classification Search
CPC ..... A63B 53/047; A63B 53/0475; A63B 53/0416; A63B 53/0479; A63B 53/0483;
(Continued)

(56) References Cited

U.S. PATENT DOCUMENTS 4,874,171 A 10/1989 Ezaki et al.
4,883,274 A * 11/1989 Hsien ..... A63B 53/04 473/335

(Continued)

FOREIGN PATENT DOCUMENTS

JP 3214539 1/2018

OTHER PUBLICATIONS

Xxio Forged Irons, www.xxiousa.com, Men's Golf Clubs / Xxio Forged Series / Xxio Forged Irons, accessed May 3, 2019.

(Continued)

*Primary Examiner* — Michael D Dennis

(57) ABSTRACT

Described herein is a tour iron having a golf club head with a faceplate, a body, and an insert. A sole, top rail, rear, and the faceplate enclose a cavity within the body. The cavity can house the insert. The insert can comprise a low-density material, allowing weight to be concentrated around the peripheral edge of the golf club head. The rear of the golf club head has an inflection seam running from the heel to the toe. The golf club head has an upper portion, above the inflection seam and a lower portion below the inflection seam. The lower portion can have a depth greater that the upper portion depth. The faceplate, body, and insert can be formed of different materials having different densities. The golf club head has a comparatively high moment of inertia and a low center of gravity. Other embodiments and methods are described herein.

19 Claims, 23 Drawing Sheets

Related U.S. Application Data

(60) Provisional application No. 62/635,020, filed on Feb. 26, 2018, provisional application No. 62/713,424, filed on Aug. 1, 2018, provisional application No. 62/768,543, filed on Nov. 16, 2018, provisional application No. 62/857,741, filed on Jun. 5, 2019, provisional application No. 62/865,831, filed on Jun. 24, 2019, provisional application No. 62/925,912, filed on Oct. 25, 2019.

(52) U.S. Cl.
CPC ..... *A63B 53/08* (2013.01); *A63B 2053/0479* (2013.01); *A63B 2053/0491* (2013.01); *A63B 2209/00* (2013.01)

(58) Field of Classification Search
CPC ..... A63B 2053/0479; A63B 2209/00; A63B 53/045; A63B 53/042; A63B 60/54
See application file for complete search history.

(56) References Cited

U.S. PATENT DOCUMENTS 5,078,397 A 1/1992 Aizawa
5,198,062 A 3/1993 Chen
5,312,106 A 5/1994 Cook
5,425,535 A 6/1995 Gee
5,588,923 A 12/1996 Schmidt et al.
5,766,092 A 6/1998 Mimeur et al.
6,030,293 A 2/2000 Takeda
6,042,486 A 3/2000 Gallagher
6,093,116 A 7/2000 Hettinger
6,200,228 B1 3/2001 Takeda
6,592,469 B2 7/2003 Gilbert
6,743,114 B2 * 6/2004 Best ..... A63B 53/04 473/291
6,743,117 B2 6/2004 Gilber
6,843,733 B1 1/2005 Llewellyn et al.
6,921,344 B2 7/2005 Gilbert
6,929,563 B2 8/2005 Nishitani
6,932,717 B2 8/2005 Hou et al.
6,964,620 B2 11/2005 Gilbert et al.
7,125,343 B2 10/2006 Imamoto
7,153,222 B2 12/2006 Gilbert et al.
7,166,042 B2 1/2007 Gilbert et al.
7,182,698 B2 2/2007 Tseng
7,207,899 B2 4/2007 Imamoto et al.
7,232,377 B2 6/2007 Gilbert et al.
7,371,190 B2 5/2008 Gilbert et al.
7,390,270 B2 6/2008 Roberts et al.
7,476,162 B2 1/2009 Stites et al.
7,662,050 B2 2/2010 Gilbert et al.
7,731,604 B2 6/2010 Wahl et al.
7,744,487 B2 6/2010 Tavares et al.
7,803,068 B2 9/2010 Clausen et al.
7,811,180 B2 10/2010 Roach et al.
7,922,604 B2 4/2011 Roach et al.
7,976,403 B2 * 7/2011 Gilbert ..... A63B 60/02 473/309
7,998,001 B2 8/2011 Soracco
8,088,025 B2 1/2012 Wahl et al.
8,157,670 B2 4/2012 Oldknow et al.
8,157,673 B2 4/2012 Gilbert et al.
8,221,263 B2 * 7/2012 Tavares ..... A63B 53/047 473/332
8,388,464 B2 3/2013 Gilbert et al.
8,647,218 B2 2/2014 Gilbert et al.
8,690,705 B2 4/2014 Molinari
8,753,220 B2 6/2014 Roach et al.
8,911,302 B1 12/2014 Ivanova et al.
8,920,258 B2 12/2014 Dolezel et al.
8,926,448 B1 1/2015 Ivanova et al.
8,939,848 B2 1/2015 Soracco et al.
8,968,114 B2 3/2015 Boyd et al.
8,973,243 B2 3/2015 Su
9,056,231 B2 6/2015 Wallans
9,199,141 B2 12/2015 Cardani et al.
9,259,629 B2 2/2016 Gilbert et al.
9,283,448 B2 3/2016 Sander
9,370,697 B2 6/2016 Beno et al.
9,381,407 B2 7/2016 Dolezel et al.
9,381,409 B1 7/2016 Griffin et al.
9,387,370 B2 7/2016 Hebreo et al.
9,555,296 B2 * 1/2017 Gilbert ..... A63B 53/047
9,586,104 B2 3/2017 Roach
9,675,852 B2 6/2017 Westrum
9,821,203 B2 11/2017 Dolezel et al.
9,895,584 B1 2/2018 Su
10,039,963 B2 8/2018 Ripp et al.
10,052,535 B1 8/2018 Westrum et al.
10,076,692 B2 9/2018 Gilbert et al.
10,112,084 B2 10/2018 Stokke et al.
2005/0014573 A1 * 1/2005 Lee ..... A63B 53/047 473/291
2005/0020378 A1 1/2005 Krumme et al.
2005/0037860 A1 2/2005 Gilbert et al.
2005/0096151 A1 5/2005 Hou et al.
2007/0049403 A1 3/2007 Chen
2007/0265107 A1 11/2007 Wang et al.
2008/0058117 A1 3/2008 Roach
2008/0242444 A1 10/2008 Park et al.
2009/0149277 A1 6/2009 Deng et al.
2009/0163295 A1 6/2009 Tseng
2009/0280923 A1 11/2009 Park et al.
2010/0151962 A1 6/2010 Breier et al.
2011/0034273 A1 2/2011 Clausen et al.
2011/0250985 A1 * 10/2011 Stites ..... A63B 53/06 473/332
2011/0269571 A1 11/2011 Gilber et al.
2012/0289360 A1 11/2012 Breier et al.
2014/0274456 A1 9/2014 Cardani et al.
2015/0111663 A1 4/2015 Kuhar et al.
2015/0157905 A1 6/2015 Kim et al.
2015/0209630 A1 7/2015 Kawaguchi et al.
2015/0273287 A1 10/2015 Doi et al.
2016/0184669 A1 6/2016 Deshmukh et al.
2016/0287955 A1 10/2016 Ritchie et al.
2016/0296809 A1 10/2016 Golden et al.
2016/0346638 A1 12/2016 Snyder
2017/0065858 A1 3/2017 Tassistro et al.
2017/0080301 A1 3/2017 Dolezel et al.
2017/0259134 A1 9/2017 Ines et al.
2018/0140910 A1 * 5/2018 Parsons ..... A63B 53/0466
2018/0221726 A1 8/2018 Westrum et al.
2018/0221730 A1 8/2018 Petersen et al.
2019/0118049 A1 4/2019 Tassistro et al.
2019/0299068 A1 * 10/2019 Hosooka ..... A63B 53/0475

OTHER PUBLICATIONS

International Search Report and Written Opinion for Int'l Patent Application No. PCT/US2019/019661, filed on Feb. 26, 2019.
International Search Report and Written Opinion for Int'l Patent Application No. PCT/US2020/036497, dated Jun. 5, 2020.

* cited by examiner

MULTI-MATERIAL IRON GOLF CLUB HEAD

RELATED APPLICATIONS

This is a continuation-in-part of U.S. patent application Ser. No. 16/286,462, filed Feb. 26, 2019, which claims benefit of U.S. Provisional Patent Application No. 62/635,020, filed Feb. 26, 2018; U.S. Provisional Patent Application No. 62/713,424, filed Aug. 1, 2018; and U.S. Provisional Patent Application No. 62/768,543, filed Nov. 16, 2018. This further claims the benefit of U.S. Provisional Patent Application No. 62/857,741, filed Jun. 5, 2019; U.S. Provisional Patent Application No. 62/865,831, filed Jun. 24, 2019; and U.S. Provisional Patent Application No. 62/925,912, filed Oct. 25, 2019. The contents of all the aforementioned applications are fully incorporated herein by reference.

TECHNICAL FIELD

The present disclosure relates generally to golf equipment, and more particularly, to a multi-material iron golf club head, and methods to manufacture said golf club head.

BACKGROUND

Typically, iron-type golf club heads comprise various styles, such as muscle-back, cavity-back, or tour irons. Golfers having a high skill level with a low handicap prefer to play compact and aesthetically sleek tour irons. Tour irons have a higher loft, lower center of gravity (hereafter "CG"), shorter length of shaft, a smaller profile, and a thinner top line. Tour irons generally have a sleek, classic look and a desirable sound. Forged tour irons are, in particular, thought to offer an improved "feel" over other types of irons, such as cast irons, and provide aesthetic sight lines. Generally, low handicap golfers, such as tour players, desire iron type club heads with the CG low and close to the face of the club. Tour irons allow these golfers to further shape their shots by manipulating the part of the club face that impacts the golf ball, because of a smaller sweet spot for straight flight. Although challenging for a high handicap golfer to use effectively, tour irons fill a niche demand for the highly skilled and often low handicap golfers.

On the other hand, game improvement irons are typically designed to cater to high handicap golfers who desire increased forgiveness and higher loft in their irons. High handicap golfers tend to play iron type club heads with a higher moment of inertia (MOI), which gives the club head more forgiveness. Game improvement irons, such as deep cavity back, muscle-back, or hollow-bodied irons, allow for perimeter weighting, which increases the forgiveness of the club head, and results in greater distance due to the face having room to bend. However, game improvement irons understandably "feel" less like a solid-bodied tour iron and can sound less pure to golfers who are accustomed to traditional solid irons. Game improvement irons have a large profile, resulting in a bulky feel. These game improvement irons can also have a thick top line and other shaping features that many golfers consider less aesthetically pleasing. The golf club head described herein caters to aspiring golfers who desire a club that shares the benefits of both game improvement and tour irons.

There is a need in the art for a club head having the compact size and solid feel and sound of traditional tour irons, without sacrificing the high moment of inertia and perimeter weighting of traditional game improvement irons, that can be used by mid-low handicap players.

Figure 1:
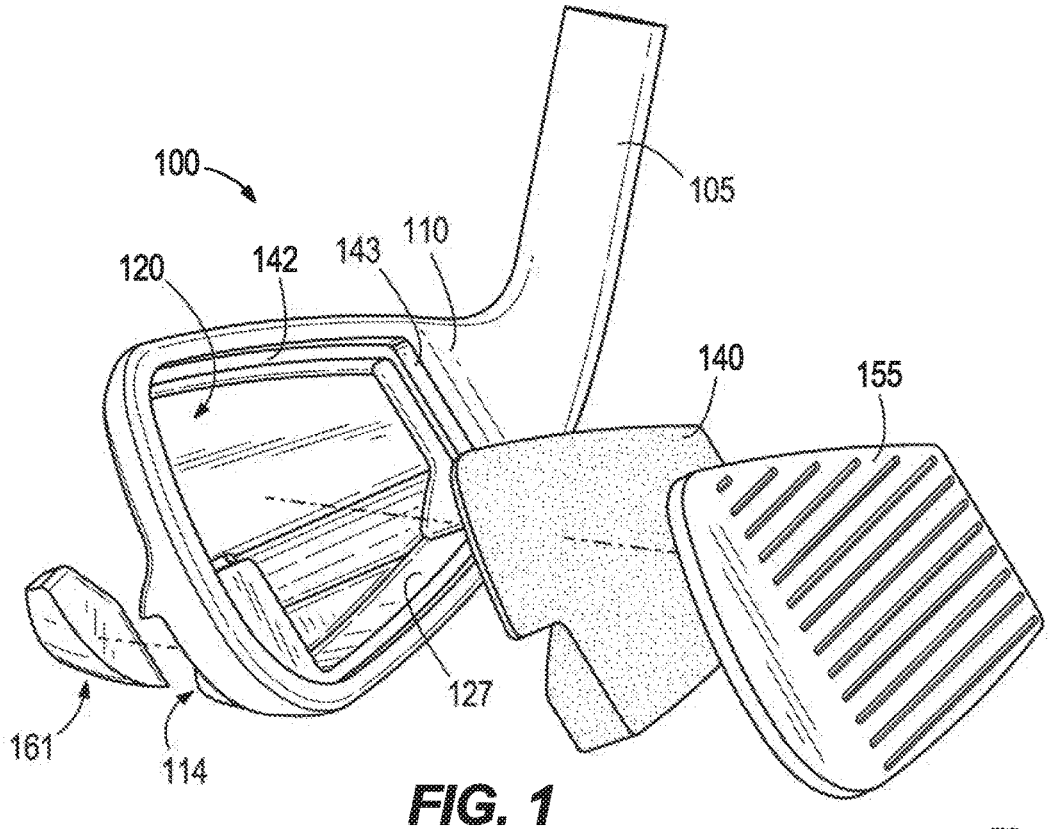
FIG. 1 shows an exploded perspective view of a golf club head according to an embodiment.

It is well understood by those familiar with golf that tour irons are visibly distinct from game-improvement irons by both their size and appearance. Accordingly, tour irons comprise design requirements different than game-improvement irons. The golf clubs described herein satisfy a market demand for tour style irons while retaining the functional benefits of game-improvement irons.

Specifically, the golf club head described herein shares the aesthetically appealing features of tour irons (e.g. compact size, forged, solid feel), and the performance advantages of game-improvement irons (e.g. perimeter weighting and high forgiveness). Described herein is a golf club head having a body that forms a cavity, wherein an insert can fit within the cavity, and the cavity can be enclosed by a cap in the rear of the body or by a faceplate of the body. The insert can alternately be exposed to the exterior of the club head through one or more openings to maximize the mass of the insert and benefit the weight distribution within the club head. Accordingly, the golf club head provides a golfer with iron clubs having a tour style while retaining a level of forgiveness necessary for an intermediate or beginner skill golfer to make the most accurate shots possible for their skill level. Generally, tour irons are designed for highly skilled golfers or low handicap to mid handicap players, while game-improvement irons are designed for low to intermediate skill level golfers also having higher handicaps (over 10). The golf club head described herein provides an option for the golfer who desires to play with a set of tour irons but lacks the skills to use traditional tour irons.

Additionally, the golf club head provides an option for the highly skilled golfer who desires to increase the accuracy of their shots through a high-MOT design. Although the golf club head described herein can comprise a MOT that is lower than certain game-improvement or standard irons, the club head nonetheless comprises a MOT that is higher than other golf club heads within the same category, namely tour or small profile irons. Furthermore, the disclosed golf club head provides a low CG that is desirable for high skill golfers. The golf club head described herein can be exemplified by, but not limited to, these embodiments.

The golf club head can be manufactured by methods that include swedging (swagging) the faceplate onto the body of the golf club head. A boundary between the faceplate and the body after swedging can be laser welded in a surface fusions treatment process. The insert is not damaged by the swedging or laser welding.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DETAILED DESCRIPTION

Described herein is a golf club having a hollow golf club head, or partially/nearly hollow golf club head, each of which comprise a low-density insert (The hollow golf club head or partially/nearly hollow golf club head is hereafter referred to as "golf club head."). The golf club has a golf club head, a shaft, and a grip. The golf club head comprises a body having a hosel, a front, a rear, a top rail, and a sole.

The body can comprise a cavity. The faceplate, the sole, the rear and the top rail enclose a cavity. In some embodiments, the cavity of the golf club head can be enclosed from the front by the faceplate. In some embodiments, the cavity can open at the rear of the club, partially exposing the cavity. An insert can fit within the cavity. The front of the golf club head can further comprise a faceplate, which encloses the cavity from the front.

One embodiment of the golf club head described herein includes a body that forms a cavity and a low-density insert, wherein the cavity opens towards the front of the golf club head. The body has an internal cavity formed in the center of the club head. The body can be cast or forged. The cavity can receive and harbor the low-density insert.

The golf club head has a low-density center, a high-density perimeter, and, as mentioned above, a low-density insert to move weight to the perimeter thereby improving overall foregiveness. The insert comprises a low-density material, such as aluminum, titanium, or a composite. Filling the cavity with a solid insert improves the acoustics and the feel of the golf club head over other similar hollow-bodied irons. In some embodiments, adhesives and/or tape are used to further secure the insert into the cavity and to prevent rattling.

The faceplate encloses the front opening of the golf club head and forms the cavity. Swedging, press-fitting, and other low-temperature methods are used for securing the faceplate. TIG welding is not used. In some embodiments, the faceplate can be further secured to the body by laser welding, because laser welding is very precise and does not create a large heat-affected zone (hereafter "HAZ") to affect the insert, tape, and/or adhesives. If the faceplate is TIG welded onto the front of the golf club head body, the insert, tape, and/or adhesives are exposed to high temperatures and are damaged, thereby corrupting the weight distribution of the insert and corrupting the material properties of the tape and/or adhesives.

A high-density perimeter of the golf club head can be also accomplished by a toe weight and/or a tip weight in the hosel. In some embodiments, the body can further comprise a toe cavity. A toe weight can be mounted within the toe cavity. The toe weight comprises a high-density material, such as tungsten. Additionally, in some embodiments, the golf club head can include a toe screw weight for swing weighting.

In a second embodiment of the golf club head, the cavity of the body is exposed via an opening in the upper portion of the rear. Similar to the first embodiment, the golf club head of the second embodiment comprises a body and a low-density insert. The body can be cast or forged. The body comprises a rear opening in an upper portion of the body. The low-density insert is housed in the cavity of the body. In this embodiment, the insert comprises a material that can be injected into the cavity, such as a thermoplastic composite, foam, or other filler damping material.

The golf club head further comprises a faceplate that forms a front boundary of the cavity. An injection molding process can form the low-density insert within the cavity of the body. The golf club head can further include a toe weight in a toe cavity of the body and/or a tip weight in the hosel for perimeter weighting. Additionally, the golf club head can include a toe screw weight for swing weighting.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "front," "back," "rear," "top," "bottom," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The term "couple" and similar terms should be broadly understood and refer to connecting two or more elements, mechanically and/or otherwise. For example, two or more mechanical elements may be mechanically coupled, but not be electrically or otherwise coupled. Coupling may be for any length of time, e.g., permanent or semi-permanent or only for an instant.

The term MOI as described herein can be a quantity expressing a body's tendency to resist angular acceleration. MOI is also known as angular mass or rotational inertia. MOI determines the torque needed to achieve a desired angular acceleration about a rotational axis. A higher MOI gives a club head more forgiveness, meaning the golfer will notice more consistent shots even when the golf ball is struck with a portion of the strike-face that is off-center. MOI is raised by moving weight away from the center of the golf club head and towards the perimeter of the golf club head. In order to preserve a desirable overall golf club head weight, to increase MOI, the center of a golf club head must comprise either a cavity or a lighter material than the main golf club head.

The aspects of the golf club described herein may be applied to one or more golf clubs within a set of irons. In some embodiments, the set of irons comprises irons having varying club head size, shaft length, lie angle, loft angle, head weight, and/or other parameters. Each club head in the set of irons can be numbered according to convention with numbers ranging from 1 to 10. Most commonly a set is numbered from 3 to 9. Furthermore, the set of irons can comprise one or more wedges, which have a loft angle higher than the numbered irons.

In some embodiments, the golf club head can be a wedge. In many embodiments, the loft angle of the golf club head is less than approximately 50 degrees, less than approximately 49 degrees, less than approximately 48 degrees, less than approximately 47 degrees, less than approximately 46 degrees, less than approximately 45 degrees, less than approximately 44 degrees, less than approximately 43 degrees, less than approximately 42 degrees, less than approximately 41 degrees, or less than approximately 40 degrees. Further, in many embodiments, the loft angle of the golf club head is greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

In many embodiments, the loft angle of the golf club head is less than approximately 64 degrees, less than approximately 63 degrees, less than approximately 62 degrees, less than approximately 61 degrees, less than approximately 60 degrees, less than approximately 59 degrees, less than approximately 58 degrees, less than approximately 57 degrees, less than approximately 56 degrees, less than approximately 55 degrees, or less than approximately 54 degrees. Further, in many embodiments, the loft angle of the golf club head is greater than approximately 46 degrees, greater than approximately 47 degrees, greater than approximately 48 degrees, greater than approximately 49 degrees, greater than approximately 50 degrees, greater than approximately 51 degrees, or greater than approximately 52 degrees.

In many embodiments, the golf club head can comprise a total volume of between 1.9 cubic inches and 2.7 cubic inches. In some embodiments, the total volume of the golf club head can be between 1.9 cubic inches and 2.4 cubic inches, 2.0 cubic inches and 2.5 cubic inches, 2.1 cubic inches and 2.6 cubic inches, 2.2 cubic inches and 2.7 cubic inches, 2.3 cubic inches and 2.7 cubic inches, or 2.4 cubic inches and 2.7 cubic inches. In other embodiments, the total volume of the golf club head 100 can be 1.9 cubic inches, 2.0 cubic inches, 2.1 cubic inches, 2.2 cubic inches, 2.3 cubic inches, 2.4 cubic inches, 2.5 cubic inches, 2.6 cubic inches, or 2.7 cubic inches.

In many embodiments, the golf club head can comprise a total mass of between 200 grams and 300 grams. In some embodiments, the golf club head can comprise a total mass of between 200 grams and 210 grams, 210 grams and 220 grams, 220 grams and 230 grams, 230 grams and 240 grams, 240 grams and 250 grams, 250 grams and 260 grams, 255 grams and 260 grams, 260 grams to 270 grams, 265 grams to 275 grams, 270 grams and 280 grams, 275 grams and 280 grams, or 250 grams and 270 grams. In other embodiments, the total mass can be 200 grams, 205 grams, 210 grams, 220 grams, 225 grams, 230 grams, 235 grams, 240 grams, 245 grams, 250 grams, 255 grams, 260 grams, 265 grams, 270 grams, 275 grams, 280 grams, 285 grams, 290 grams, 295 grams, or 300 grams.

The golf club head described herein can be viewed from various perspectives, while in address position, including but not limited to: a front view, a rear view, a toe-side view, a heel-side view, a top view, a sole view, and various perspective views. For example, the front view of the golf club head 100, views the club head from a direction forward of the loft plane 20, parallel to the ground plane 10. The rear view of the golf club head 100 views the club head from a direction rearward of the rear 103, parallel to the ground plane 10. The toe-side view of the golf club head 100 views the club head from a toe-to-heel direction that is parallel to the ground plane 10. The heel-side view of the golf club head 100 views the club head from a heel-to-toe direction that parallel to the ground plane 10. The sole view of the golf club head 100 views the club head from a sole-to-top direction orthogonal to the ground plane 10. The top view of the golf club head 100 views the club head from a top-to-sole direction orthogonal to the ground plane 10.

I. GOLF CLUB HEAD WITH INSERT AND ENCLOSING FACEPLATE

Described herein is a golf club head 100. The golf club head 100 can be a tour style golf club head with forgiveness as discussed above. The golf club head 100 can comprises a body having a cavity that houses an insert. The golf club head comprises a faceplate, a body, and an insert. The body comprises an upper portion, a lower portion, a sole, a rear, and a top rail. The rear can further comprise an inflection seam. The inflection seam is the boundary between the upper portion and lower portion of the golf club head. The faceplate and a portion of the body define a striking surface of the golf club head. The faceplate, the sole, the rear, and the top rail enclose a cavity.

The cavity of the body opens towards the front of the golf club head and is enclosed by a faceplate. The faceplate can be swedged and laser welded to the body. The club head is a tour iron club head, and has a volume between 1.8 cubic inches and 2.7 cubic inches (30 cubic centimeters (cc) and 45 cc). The body of the golf club head can be cast or forged from a metal material.

The insert comprises a low-density material and fills the cavity formed by the body of the golf club head. Reducing mass in the center of the golf club head allows extra mass to be concentrated at its perimeter to increase moment of inertia values of the golf club head. As discussed above, the golf club head comprises a lower portion and an upper portion. The lower portion comprises a depth greater than the upper portion. The lower portion thereby has more mass concentrated on the peripheral heel end, toe end, and the sole. Lowering the mass of the body results in a low CG, which increases launch angle and reduces spin. As introduced above, there is a need in the art for an iron that couples tour iron sizing with a comparatively high moment of inertia from perimeter weighting and a low CG from low positioning of mass. In some embodiments, a tip weight positioned in the hosel and/or a toe weight positioned in a toe cavity of the body provide additional perimeter weighting.

A. Parts of the Golf Club Head

Turning to FIGS. 1-13, the golf club head 100 comprises a faceplate 155, a body 110, and an insert 140 as discussed above. The body 110 may further comprise an upper portion 108, a lower portion 109, a sole 107, a rear 103, a toe side 101, a heel side 102, and a top rail 106. The faceplate 155 and a portion of the body may define a strikeface 111. The faceplate 155, the sole 107, the rear 103, and the top rail 106 enclose a cavity 120. The upper portion 108 is bounded by the top rail 106. The lower portion 109 is bounded by the sole 107. The rear 103 may comprise an inflection seam 130. The inflection seam 130 can stretch from the toe side 101 to the heel side 102 of the golf club head. The inflection seam 130 bounds the upper portion 108 to the top rail 106. The inflection seam 130 bounds the lower portion 109 to the sole 107. The inflection seam 130 marks the end of a uniform upper portion depth 116, as described below. As shown in FIGS. 4-12, the inflection seam 130 is depicted as an inflection point in any cross-sectional view taken in a top rail-to-sole direction from the toe-side view.

Figure 2:
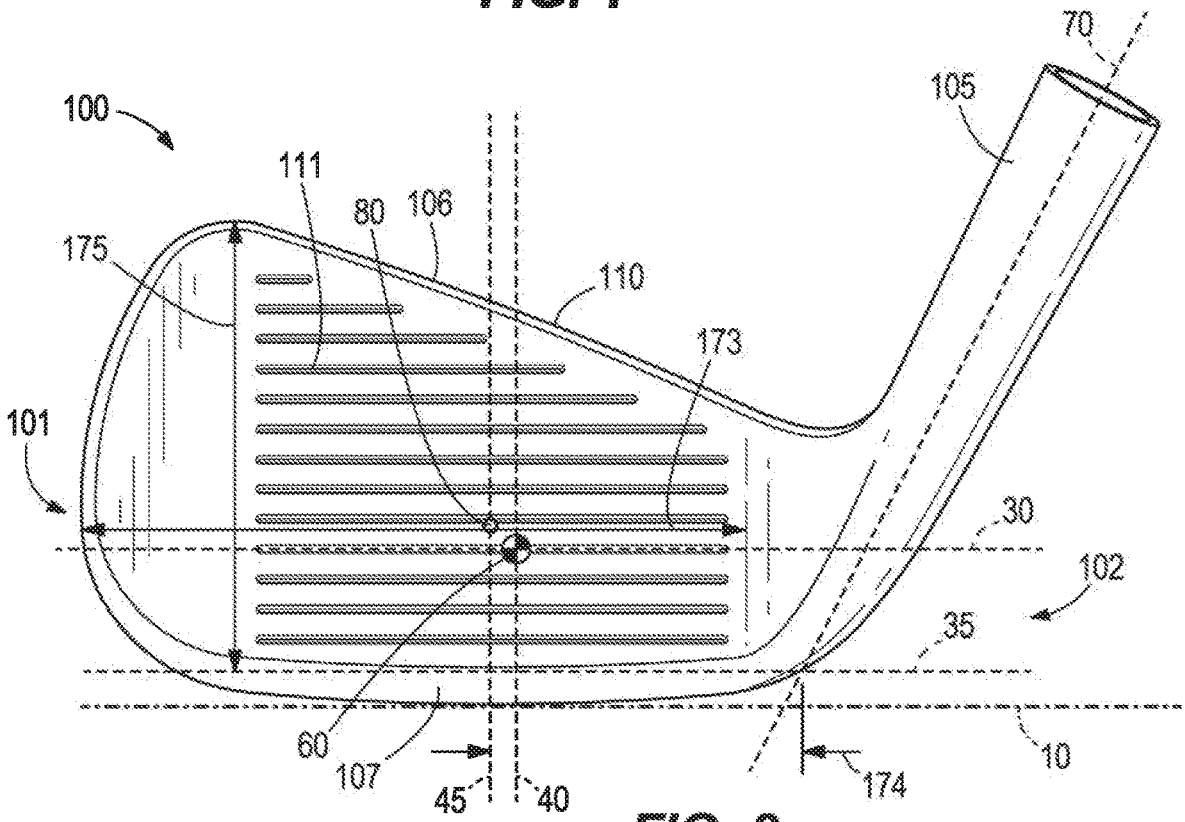
FIG. 2 shows a front view of the golf club head of FIG. 1.
Figure 3:
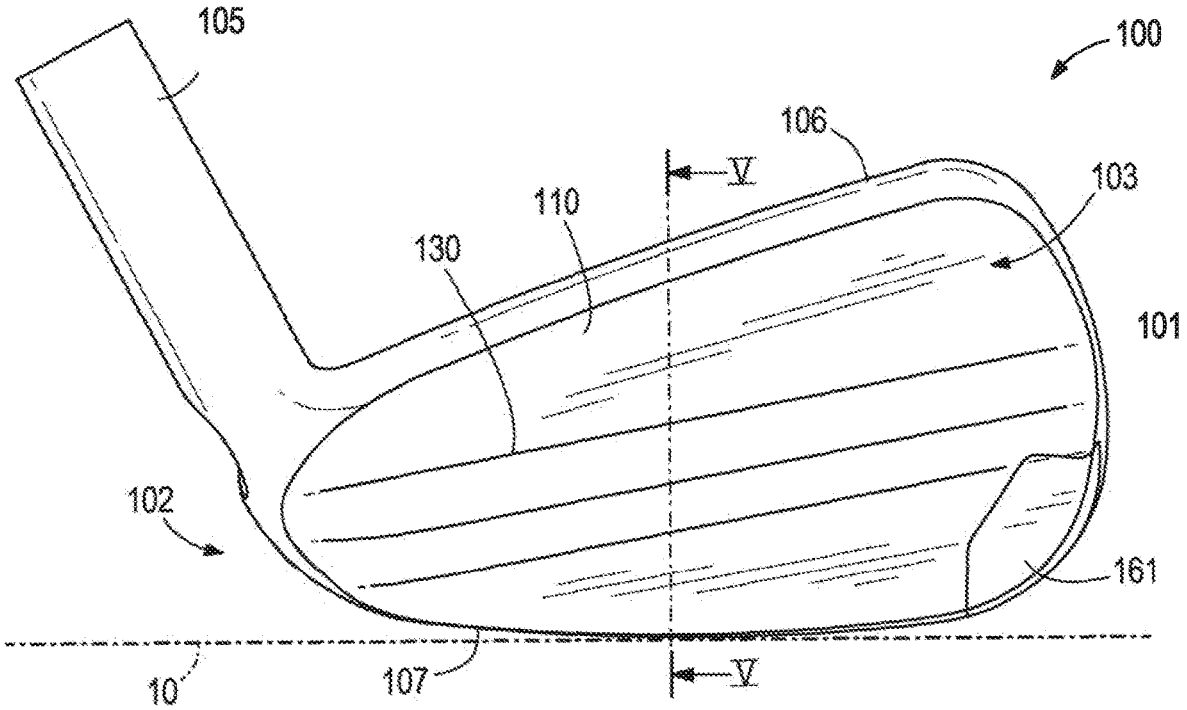
FIG. 3 shows a rear view of the golf club head of FIG. 1.
Figure 4:
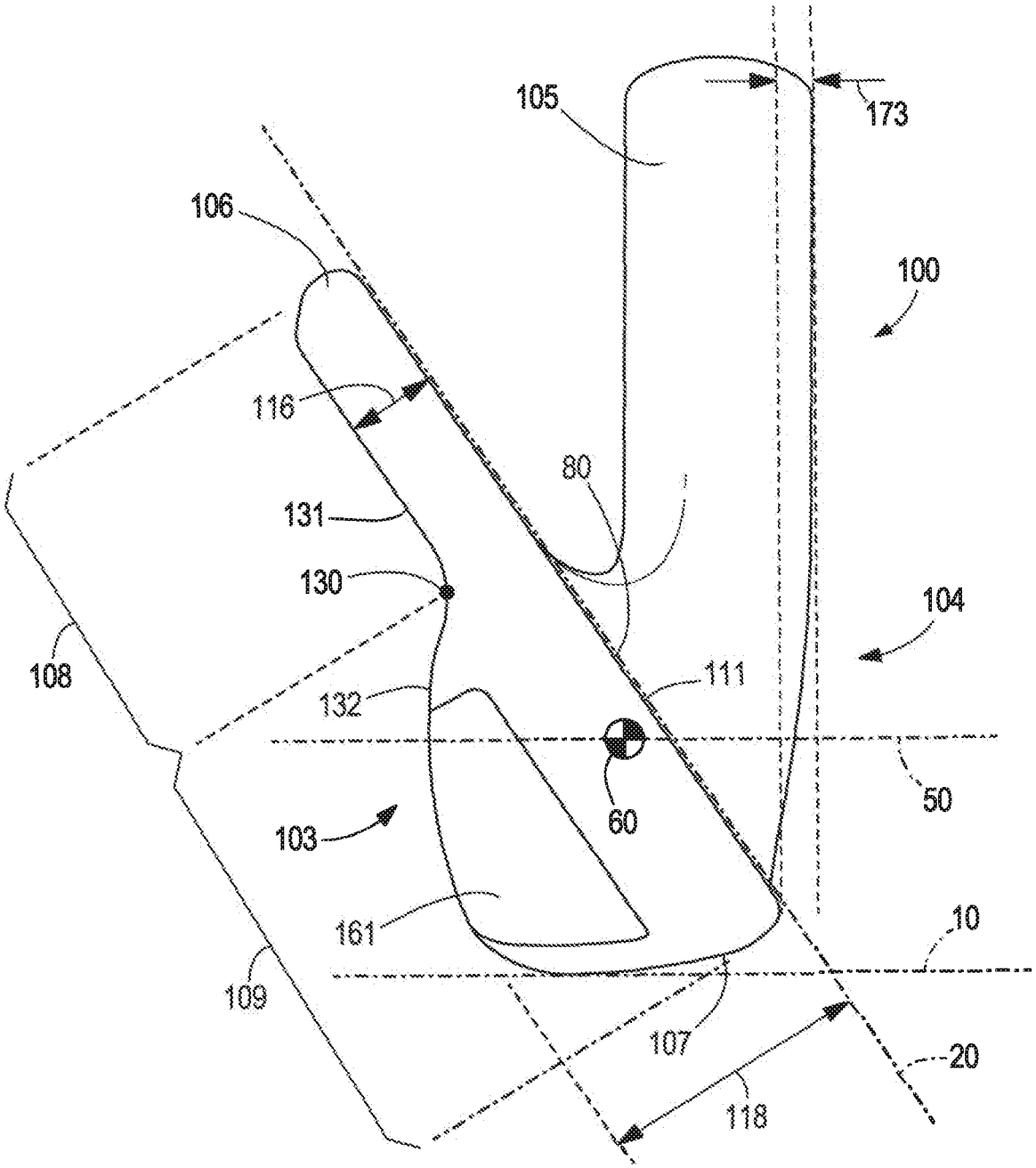
FIG. 4 shows toe-side view of the golf club head of FIG. 1.

As illustrated in FIGS. 2 and 3, a ground plane 10 provides a reference for the ground when the golf club is at address position. As illustrated in FIG. 4, a face plane 20 is parallel to the strikeface 111. As illustrated in FIG. 2, a centerplane 45 is perpendicular to the ground plane 10, perpendicular to the loft plane 20, and coincident with a centerpoint 80 of the strikeface 111. As shown in FIGS. 2 and 4, the golf club head 100 can have a coordinate system centered around the CG 60 of the golf club head 100. Golf club head 600, described below, can have similar coordinate axes. An x-axis 30 reference axis extends in a toe-to-heel direction and through the CG 60. The x-axis 30 is parallel with the strikeface. A y-axis 40 reference axis extends in a top rail-to-sole direction and through the CG 60. The y-axis 40 is orthogonal to the ground plane 10 when the golf club head 100 is at address position. A z-axis 50 reference axis extends in a front-to-rear direction and through the CG 60. The z-axis 50 is parallel to the ground plane 10 and perpendicular to the x-axis 30 and the y-axis 40. Furthermore, a hosel axis 70 reference axis extends through the concentric center of the hosel 105. A lead edge axis 35 is parallel to the ground plane 10, extends in a heel-to-toe direction, and is coincident with a point that is lowest on the generally planar strikeface 111 along the center of the strikeface 111. A lead edge plane is coincident with the lead edge axis 35 and parallel to the ground plane 10.

1) Upper and Lower Portion of the Golf Club Head

Figure 5:
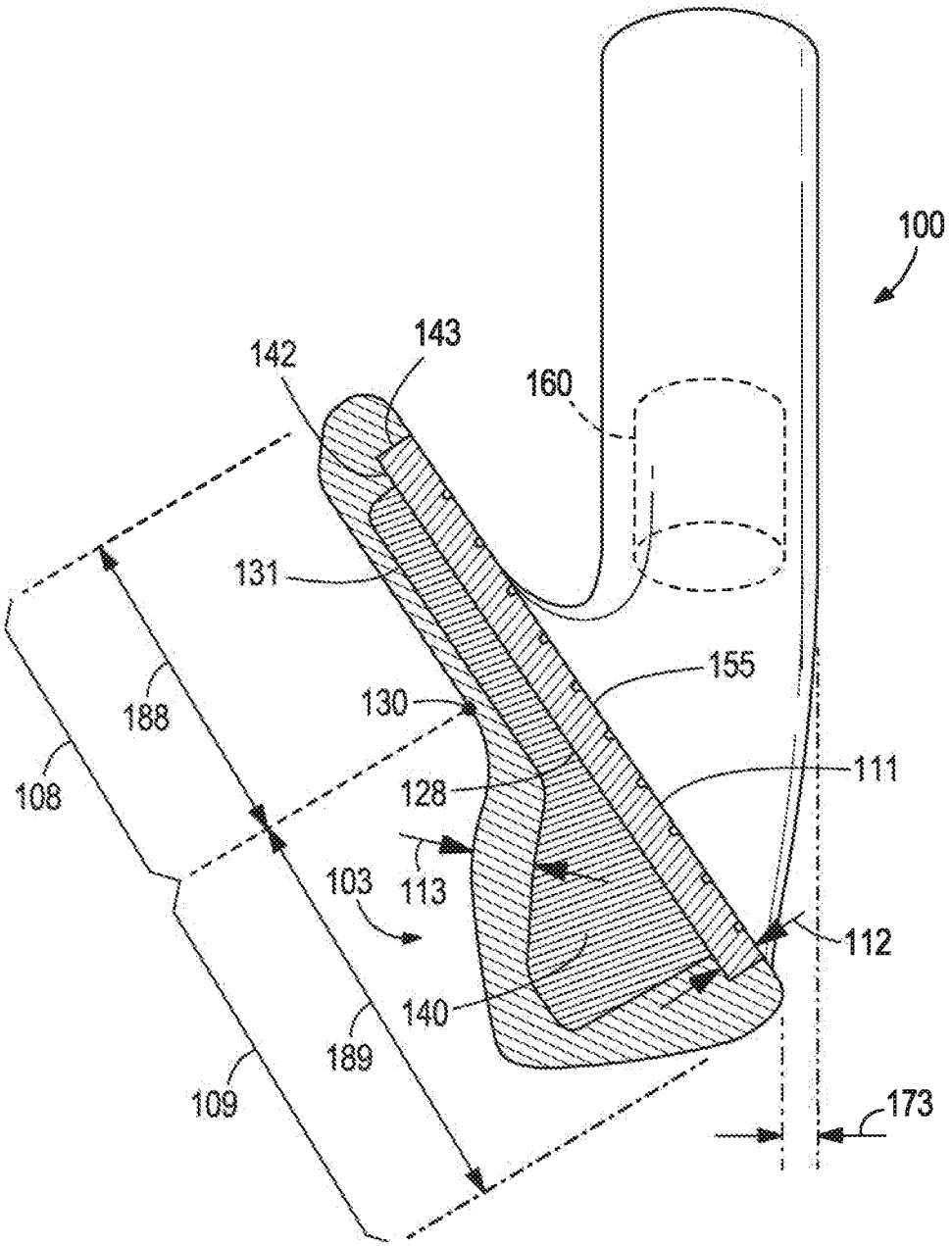
FIG. 5 shows a cross-sectional toe-side view of the golf club head of FIG. 1, along the line V-V in FIG. 3.

As illustrated in FIGS. 4 and 5, the golf club head 100 comprises the upper portion 108 and the lower portion 109. As discussed above, the upper portion 108 can be separated from the lower portion 109 by the inflection seam 130. The upper portion 108 of the rear 103 of the body can comprise a uniform depth 116, measured perpendicular to the loft plane 20, from the strikeface 111 to the rear 103. The rear 103 comprises an upper wall 131 and a lower wall 132. By staying substantially parallel to the loft plane 20, the upper wall of the rear 103 enables a constant depth 116 in the upper portion 108 of the golf club head 100. At the inflection seam 130, the rear contour transitions between the upper portion 108 and the lower portion 109 of the golf club head 100, causing a shift in the depth of the golf club head 100. This change in depth leads to the lower portion 109 having a greater depth 118 than the upper portion 108, as described below. The greater depth of the lower portion 109 is beneficial for lowering the CG of the golf club head 100 and improving launch characteristics.

This contour of the rear 103 of the golf club head 100 enables mass to be placed lower in the golf club head 100 than in golf club heads with a flat rear design. By moving mass lower in the club head, the CG is lowered. This allows for improved ball launch and spin characteristics of the golf ball when impact by the golf club head 100. The full benefits of the CG location are best understood by way of comparison to a golf club head with a flat rear, as provided below in Example 3. In some embodiments, the golf club head 100 can comprise a CG that is lower than the CG of a flat back comparison golf club head by between 0.030 inch and 0.050 inch. In some embodiments, the CG is lowered by between 0.030 inch and 0.032 inch, 0.032 inch and 0.034 inch, 0.034 inch and 0.036 inch, 0.036 inch and 0.038 inch, 0.038 inch and 0.040 inch, 0.040 inch and 0.042 inch, 0.042 inch and 0.044 inch, 0.044 inch and 0.046 inch, 0.046 inch and 0.048 inch, or 0.048 inch and 0.050 inch.

Figure 18:
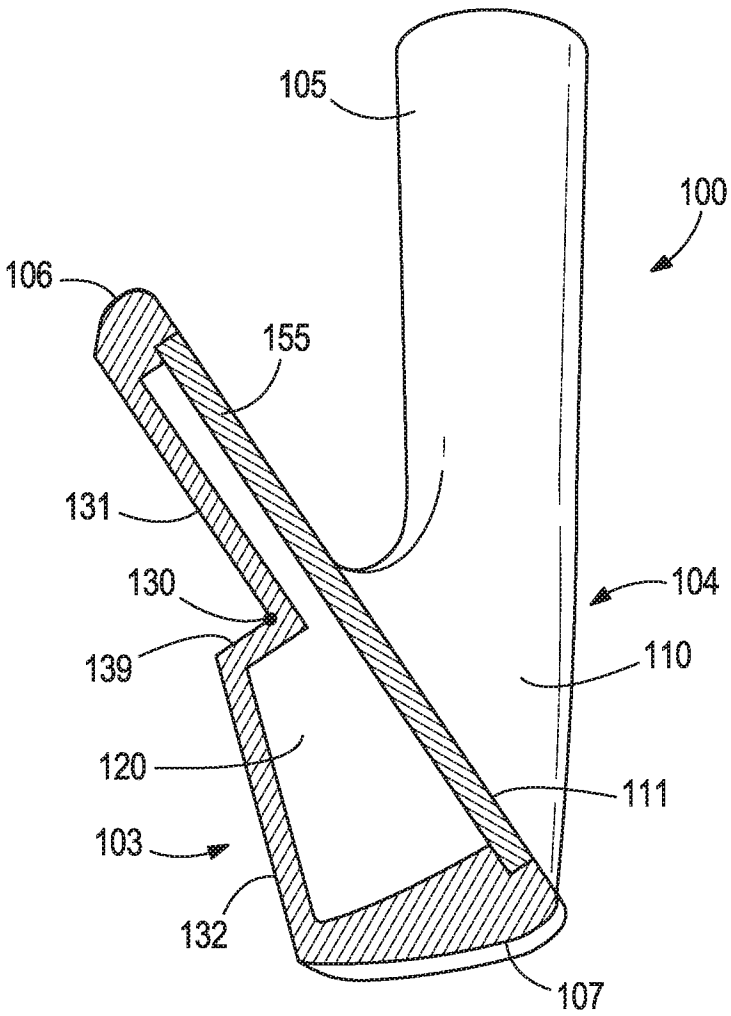
FIG. 18 shows a cross-sectional toe-side view of a golf club head, according to an embodiment having a rear shelf angled at 90 degrees from the loft plane.

The rear contour can vary between embodiments in order to allow the upper portion 108 and the lower portion 109 to have different depths, volumes, or masses. As shown in the cross sections of FIGS. 17 and 18, in some embodiments, the lower wall 132 of the rear 103 can comprise a shelf 139 just below the inflection seam 130. The shelf 139 can be between the upper wall 131 and the remainder of the lower wall 132. In these embodiments, the shelf 139 extends backwards and/or downwards from the inflection seam 130. In some embodiments, such as the one illustrated in FIG. 18, the shelf 139 is approximately perpendicular to the loft plane 20. By varying the rear contour, the depths, volumes, or masses of the upper and lower portions 108, 109 can be altered, which affects the location of the CG and the value of the MOI.

2) Heights of the Upper Portion and Lower Portion

As illustrated in FIGS. 4 and 5, the golf club head 100 comprises the upper portion 108 and the lower portion 109, which are divided by the inflection seam 130. The upper portion 108 comprises a height 188 measured along the centerplane 45 from the top rail 106 to the inflection seam 130, in a direction parallel to the loft plane 20. The upper portion height 188 can be between 0.60 inch and 0.90 inch. In some embodiments, the upper portion height 188 can be between 0.60 inch and 0.65 inch, 0.65 inch and 0.70 inch, 0.70 inch and 0.75 inch, 0.75 inch and 0.80 inch, 0.80 inch and 0.85 inch, 0.085 inch and 0.90 inch, 0.60 inch and 0.70 inch, 0.70 inch and 0.80 inch, or 0.80 inch and 0.90 inch.

The lower portion 109 comprises a height 189 measured along the centerplane 45 from the top rail 106 to the inflection seam 130, in a direction parallel to the loft plane 20. The lower portion height 189 can be between 0.80 inch and 1.10 inch. In some embodiments, the lower portion height 189 can be between 0.80 inch and 0.85 inch, 0.85 inch and 0.90 inch, 0.90 inch and 0.95 inch, 0.95 inch and 1.0 inch, 1.0 inch and 1.05 inch, 1.05 inch and 1.10 inch, 0.9 inch and 1.0 inch, or 1.0 inch and 1.1 inch.

A ratio of the upper portion height 188 and the lower portion height 189 can be between 9:8 (54:48) and 6:11 (54:99). In some embodiments, the ratio of the upper portion height 188 and the lower portion height 189 can be between 9:8 (54:48) and 6:8 (54:72), 6:8 (54:72) and 9:11 (54:66), or 9:11 (54:66) and 6:11 (54:99). A higher ratio of the upper and lower portion heights 188, 189 can result in a lower CG because the lower portion 109 comprises a greater depth and mass, as described below. A low CG improves launch and spin characteristics by reducing the torque imparted to the golf club head 100 upon impact with a golf ball. A low CG can also increase the ball speed and improve the feel of the golf club head 100.

3) Depths of the Upper Portion and Lower Portion of the Golf Club Head

As illustrated in FIGS. 4 and 5, the upper portion 108 of the golf club head 100 can comprise a uniform depth. The upper portion depth 116 of club head 100 can be between 0.200 inch and 0.250 inch. In some embodiments, the upper portion depth 116 can be between 0.200 inch and 0.210 inch, 0.205 inch and 0.215 inch, 0.210 inch and 0.220 inch, 0.215 inch and 0.225 inch, 0.220 inch and 0.230 inch, 0.225 inch and 0.235 inch, 0.230 inch and 0.240 inch, 0.235 inch and 0.245 inch, 0.240 inch and 0.250 inch, or 0.245 inch and 0.250 inch.

The lower portion 109 comprises a depth 118 measured perpendicular to the loft plane 20 from the strikeface 111 to an outer surface of the rear 103, along the centerplane 45. The lower portion depth 118 can vary in a top rail-to-sole direction and/or in a heel-to-toe direction. The lower portion depth 118 is equal or greater in depth than the depth of the upper portion 116 of the golf club head 100. The lower portion depth 118 can be between 0.270 inch and 0.780 inch. In other embodiments, the lower portion depth 118 can be between 0.270 inch and 0.320 inch, 0.320 inch and 0.380 inch, 0.380 inch and 0.430 inch, 0.430 inch and 0.480 inch, 0.480 inch and 0.530 inch, 0.530 inch and 0.580 inch, 0.580 inch and 0.630 inch, 0.630 inch and 0.680 inch, 0.680 inch and 0.730 inch, 0.730 inch and 0.780 inch, 0.270 inch and 0.470 inch, 0.320 inch and 0.520 inch, 0.370 inch and 0.570 inch, 0.420 inch and 0.620 inch, 0.470 inch and 0.670 inch, 0.420 inch and 0.620 inch, 0.470 inch and 0.670 inch, 0.520 inch and 0.720 inch, or 0.570 inch and 0.770 inch.

In the toe 101 and the heel 102 of the club head 100, the lower portion depth 118 can differ from the lower portion depth 118 at the centerplane 45. A minimum lower portion depth 118 in the toe 101 can be between 0.300 inch and 0.460 inch. In other embodiments, the lower portion depth 118 in the toe region 101 can be between 0.300 inch and 0.320 inch, 0.320 inch and 0.330 inch, 0.330 inch and 0.340 inch, 0.340 inch and 0.360 inch, 0.360 inch and 0.380 inch, 0.380 inch and 0.400 inch, 0.400 inch and 0.420 inch, 0.420 inch and 0.440 inch, or 0.440 inch and 0.460 inch.

The lower portion depth 118 at the heel 102 can differ from the lower portion depth at the centerplane 45 as well. A minimum lower portion depth 118 in the heel region 102 can be between 0.270 inch and 0.315 inch. In other embodiments, the lower portion depth 118 in the heel region 102 can be between 0.270 inch and 0.280 inch, 0.280 inch and 0.290 inch, 0.290 inch and 0.300 inch, 0.300 inch and 0.310 inch, 0.310 inch and 0.320 inch, 0.320 inch and 0.340 inch, 0.340 inch and 0.360 inch, 0.360 inch and 0.380 inch, 0.380 inch and 0.400 inch, 0.400 inch and 0.420 inch, 0.420 inch and 0.440 inch, or 0.440 inch and 0.460 inch.

A maximum depth of the club head 100 is located within the lower portion 109 of the body 110. The maximum of depth of the club head 100 is measured perpendicular to the loft plane 20 from the strikeface 111 to an outer surface of the rear 103. The maximum depth can be between 0.670 inch to 0.770 inch. In other embodiments, the maximum depth can be between 0.670 inch to 0.690 inch, 0.690 inch and 0.710 inch, 0.710 inch and 0.730 inch, 0.730 inch and 0.750 inch, or 0.750 inch and 0.770 inch.

In some embodiments, a ratio between the upper portion depth 116 and the lower portion depth 118 can be between 1:3 and 4:5. In some embodiments, the ratio between the upper 116 and lower 118 depths can be between 1:3 and 1:2, between 1:2 and 2:3, or between 2:3 and 4:5. In club heads with a greater ratio between the upper portion depth 116 and the lower portion depth 118, the lower portion extends further rearward. Conversely, in club heads with a lesser ratio between the upper portion depth 116 and the lower portion depth 118, the lower portion does not protrude as far rearward. These embodiments appear sleeker and can resemble thin profile tour irons.

4) Volume of the Upper Portion and Lower Portion of the Golf Club Head and

Cavity

Referring to FIGS. 4 and 5, the upper and lower portions 108, 109 of the golf club head 100 can comprise a volume. The volume is measured from a plane adjacent the heel 102 and coincident with an edge/periphery of the faceplate 155 to the toe 101. The volume of the upper portion 108 can be between 0.20 cubic inches and 0.60 cubic inches. In some embodiments, the volume of the upper portion 108 can be between 0.20 cubic inches and 0.30 cubic inches, 0.25 cubic inches and 0.35 cubic inches, 0.30 cubic inches and 0.40 cubic inches, 0.35 cubic inches and 0.45 cubic inches, 0.40 cubic inches and 0.50 cubic inches, 0.45 cubic inches and 0.55 cubic inches, or 0.50 cubic inches and 0.60 cubic inches. In some embodiments, the volume of the upper portion 108 is 0.48 cubic inches.

As illustrated in FIG. 5, the upper portion 108 and the lower portion 109 together form the body 110, which defines the cavity 120. A portion of the cavity 120 within the upper portion 108 of the body 110 can have a volume between 0.05 cubic inches and 0.40 cubic inches (0.82 cc and 6.55 cc). In some embodiments, the cavity volume in the upper portion 108 can be between 0.05 cubic inches and 0.15 cubic inches, 0.10 cubic inches and 0.20 cubic inches, 0.15 cubic inches and 0.25 cubic inches, 0.20 cubic inches and 0.30 cubic inches, 0.25 cubic inches and 0.35 cubic inches, 0.30 cubic inches and 0.40 cubic inches, or 0.35 cubic inches and 0.45 cubic inches. In some embodiments, the cavity volume in the upper portion 108 is 0.17 cubic inches. In some embodiments, a ratio of the club head upper portion volume to the cavity volume within the upper portion can range between 11:10 and 12:1.

To properly place the CG low within the golf club head 100, the golf club head 100 below the inflection seam 130 (i.e. the lower portion 109), is larger in volume than the golf club head 100 above the infection seam 130 (i.e. the upper portion 108). The volume of the lower portion 109 of the club head 100 is measured the same as the upper portion 108 (i.e , measured from a plane adjacent the heel 102 and coincident with an edge/periphery of the faceplate 155 to the toe). The volume of the lower portion 109 can be between 1.15 cubic inches and 1.55 cubic inches. In some embodiments, the volume of the lower portion 109 can be between 1.15 cubic inches and 1.35 cubic inches, 1.25 cubic inches and 1.45 cubic inches, 1.35 cubic inches and 1.55 cubic inches, 1.20 cubic inches and 1.30 cubic inches, 1.30 cubic inches and 1.40 cubic inches, or 1.40 cubic inches and 1.50 cubic inches. In some embodiments, the volume of the upper portion is 1.36 cubic inches.

A portion of the cavity 120 within the lower portion 109 can have a volume between 0.15 cubic inches and 0.60 cubic inches (2.46 cc and 9.83 cc). In some embodiments, the cavity volume in the lower portion 109 can be between 0.15 cubic inches and 0.25 cubic inches, 0.20 cubic inches and 0.30 cubic inches, 0.25 cubic inches and 0.35 cubic inches, 0.30 cubic inches and 0.40 cubic inches, 0.35 cubic inches and 0.45 cubic inches, 0.40 cubic inches and 0.50 cubic inches, 0.45 cubic inches and 0.55 cubic inches, or 0.50 cubic inches and 0.60 cubic inches. In some embodiments, the cavity volume in the lower portion 109 is 0.37 cubic inches. In some embodiments, a ratio of the club head lower portion volume to the cavity volume within the lower portion can range between 1.1:1 and 10:1.

5) Overall Volume of the Cavity

Referring back to FIG. 1, the golf club head 100 can comprise the body 110 comprising a cavity 120 in a central portion of the golf club head 100. The cavity 120 is filled with the low-density insert 140, which increases the forgiveness of the golf club head 100 without sacrificing the solid feel and look of a tour iron. The forgiveness of the golf club head 100 corresponds to the amount of perimeter weighting, which is affected by the volume of the cavity 120. A larger cavity eliminates more mass from a central region of the golf club head 100 than a smaller cavity. Consequently, a larger cavity allows more weight to be positioned on the perimeter of the golf club head 100.

The cavity 120 can have a volume between 0.2 cubic inches and 0.8 cubic inches (3.28 cc and 13.11 cc). In some embodiments, the cavity 120 volume can be between 0.2 cubic inches and 0.3 cubic inches, 0.2 cubic inches and 0.25 cubic inches, 0.25 cubic inches and 0.30 cubic inches, 0.30 cubic inches and 0.40 cubic inches, 0.30 cubic inches and 0.35 cubic inches, 0.35 cubic inches and 0.40 cubic inches, 0.40 cubic inches and 0.50 cubic inches, 0.40 cubic inches and 0.45 cubic inches, 0.45 cubic inches and 0.50 cubic inches, 0.50 cubic inches and 0.60 cubic inches, 0.50 cubic inches and 0.55 cubic inches, 0.55 cubic inches and 0.60 cubic inches, 0.60 cubic inches and 0.70 cubic inches, 0.60 cubic inches and 0.65 cubic inches, 0.65 cubic inches and 0.70 cubic inches, 0.70 cubic inches and 0.80 cubic inches, 0.70 cubic inches and 0.75 cubic inches, 0.75 cubic inches and 0.80 cubic inches. In other embodiments, the cavity 120 can have a volume of 0.20 cubic inch, 0.22 cubic inch, 0.24 cubic inch, 0.26 cubic inch, 0.28 cubic inch, 0.30 cubic inch, 0.32 cubic inch, 0.34 cubic inch, 0.36 cubic inch, 0.38 cubic inch, 0.40 cubic inch, 0.42 cubic inch, 0.44 cubic inch, 0.46 cubic inch, 0.48 cubic inch, 0.50 cubic inch, 0.52 cubic inch, 0.54 cubic inch, 0.56 cubic inch, 0.58 cubic inch, 0.60 cubic inch, 0.62 cubic inch, 0.64 cubic inch, 0.66 cubic inch, 0.68 cubic inch, 0.70 cubic inch, 0.72 cubic inch, 0.74 cubic inch, 0.76 cubic inch, 0.78 cubic inch, or 0.80 cubic inch.

The cavity 120 can have a volume that is between 5% and 60% of the total club head volume, described above. In some embodiments, the cavity 120 can have a volume that is between 5% and 10%, 10% and 30%, 15% and 35%, 20% and 40%, 25% and 45%, 30% and 50%, 35% and 55%, or 40% and 60% of the total club head volume. In one embodiment, the volume of the cavity 120 is between 17% and 32% of the club head volume.

Increasing the volume of the cavity 120 results in the elimination of weight from the central region of body 110. This saved weight can be redistributed around the perimeter of the golf club head 100 to give the golf club head 100 greater forgiveness. The heights, depths, and volumes of the upper and lower portions 108, 109 of the body 110 provide the club head 100 with a low-positioned CG 60. Therefore, the golf club head 100 comprises a lower CG than a golf club head having a flat rear, as exemplified in Example 3 below. As described above, the golf club head 100 can comprise a CG 60 that is lower than the CG of a flat back comparison golf club head by between 0.030 inch and 0.050 inch. The lower CG 60 causes the golf club head 100 to have better launch characteristics, better spin characteristics, and higher ball speed than a flat back golf club head.

6) Thickness Profiles of the Golf Club Head

The thickness of the rear 103 of the body 110 also affects the weighting and thereby the CG location of the golf club head 100. The thickness is measured from an exterior surface of the rear 103 to an interior surface of the rear 103 within the cavity 120. In some embodiments, the rear 103 of the body 110 is thicker adjacent the sole 107 of the body 110. Due to the density of the body 110 material, the greater thickness adjacent the sole 107 moves mass downward compared to a golf club head body having a uniform rear thickness. As illustrated in the cross-section of FIG. 5, the rear 103 of the body 110 can have a thickness 113. The rear thickness 113 can range between 0.030 inch and 0.100 inch. In some embodiments, the thickness 113 can be 0.030 inch, 0.040 inch, 0.050 inch, 0.060 inch, 0.070 inch, 0.080 inch, 0.090 inch, or 0.100 inch. The rear thickness 113 can be constant across the rear 103. In some embodiments, the rear thickness 113 varies across the rear 103 in a heel-to-toe direction and/or in a top rail-to-sole direction. Varying the thickness 113 of the rear 103 can assist in moving mass towards the sole 107 and rear 103 of the golf club head 100. Shifting the mass towards the sole 107 and rear 103 lowers the CG, which improves launch characteristics, improves spin characteristics, and increases ball speed.

7) Cavity of the Body

As illustrated in FIGS. 1 and 5, body 110 can comprise an internal peripheral edge 127 that defines the cavity 120 outer boundaries. The internal peripheral edge 127 circumscribes the cavity 120. The peripheral edge 127 internally bounds the top rail 106, sole 107, toe 101, and heel 102. The internal peripheral edge 127 can follow the contours of the external edge of the golf club head 100. Because the peripheral edge 127 of the cavity 120 extends as close to the edges of the golf club head 100 as possible, the size of the cavity 120 is maximized. Consequently, the size of the low-density insert 140 and its weighting benefits are also maximized.

In some embodiments, not depicted, the peripheral edge 127 gently tapers so that in a cross-section of the golf club head 100, taken in a front-to-rear direction, the cavity 120 covers a larger area closer to the front 104 and smaller area closer to the rear 103. In these embodiments, this tapered geometry enables the larger area adjacent the front 104 to harbor more surface area of the low-density insert thereby placing it closer to the front 104. Less internal cavity area is left for the low density insert and more of the high density material is left in the rear 103 of the golf club head 100. Thus, the shaping of the cavity 120 can enable the placement of more mass adjacent the rear 103 and sole 107 of the golf club head 100, shifting the CG down and back.

8) Indentation in the Cavity of the Golf Club Head

As shown in FIGS. 1 and 5, the front 104 of the body 110 further comprises an indentation 142 for receiving the faceplate 155. The indentation 142 connects to a front opening of the cavity 120, but is not considered part of the cavity 120. The indentation 142 comprises a peripheral edge 143 that generally follows the contours of the golf club head 100, including, but not limited to, the top rail 106, an edge of the body within the toe 101, the sole 107, and a roughly vertical dividing line adjacent the heel 102. The peripheral edge 143 of the indentation 142 is offset from the internal peripheral edge 127 that defines the cavity 120. The footprint of the indentation 142, as bounded by the peripheral edge 143, is larger than the area circumscribed by the internal peripheral edge 127 at a front of the cavity 120. The indentation 142 has a depth approximately equivalent to the thickness of the faceplate 155, described below.

The faceplate 155 aligns with the indentation 142 and sits within the cavity 120 and is seated on the indentation 142. The insert 140 (as described below) fits within the cavity to a volume that is flush with the indentation 142. The remaining volume of the cavity 120 is filled by the faceplate 155 that seats on the indentation 142. Together, the insert 140 and the faceplate 155 fill the entire volume of the cavity 120 and the indentation 142 of the golf club head 100. The insert 140 does not cover the indentation 142, but rather sits flush with the indentation 142. Thereby, the insert 140 does not interfere with the faceplate 155 seating on the indentation 142.

In other embodiments as described below, the insert 140 does not fill the volume of the cavity 120 to the indentation 142, but only a portion. Again, these embodiments entail an insert 140 that does not interfere with the faceplate 155 seating on the indentation 142.

B. Inserts of the Golf Club Head

In contrast to traditional, single-material tour irons, the golf club head 100 comprises a low-density insert 140 that fits within the cavity 120 of the body 110. As illustrated in FIG. 1, the insert 140 is shaped to fit within the cavity 120. The insert 140 completely fills or partially fills the cavity 120, as described above. In some embodiments, the insert 140 shares wall geometry with the cavity 120. The shape of the insert 140 can be identical or almost identical to the shape of the cavity 120. In embodiments where the insert substantially fills the cavity 140, the volume and other dimensions of the insert 120 approximately correspond to the respective volume and other dimensions of the cavity 140. As described below, manufacturing tolerances and the insertion of tape and/or adhesive into the cavity 120 can necessitate a slightly smaller volume for the insert 140 compared to the cavity 120.

1) Multi-Material (Multi-Density) Inserts

Referring to FIGS. 6-9, in some embodiments, a multi-material insert 440 is employed in place of the insert 140.

The multi-material insert 440 can comprise dimensions and a volume similar to the dimensions and volume of insert 140. The multi-material insert 440 can comprise a first portion 450 and a second portion 460 of different materials having different densities. In some embodiments, the first portion 450 is a low-density portion and the second portion 460 is a weight. Adding weight to a lower portion of the insert 440 lowers the CG 60 of the golf club head 100, which improves launch characteristics and increases ball speed. Adding weight to lower the CG 60 can also increase ball speed and improve the feel of the golf club head 100. In other embodiments, the first portion 450 is a vibration damping material, and the second portion 460 is a low-density material. Forming the first portion 450 from a vibration damping material can affect the feel and sound of the golf club head 100. The feel, sound, and perimeter weighting of the golf club head 100 can be altered by forming the insert 440 from multiple materials.

The insert 440 can be formed with the first portion 450 and the second portion 460 in any orientation or combination with respect to each other, so long as the first and second portions 450, 460 form an insert 440 configured to fit within the cavity 120 of the body 110 as described above. The first portion 450 can be separate from the second portion 460 or integrally formed into a single multi-material insert 440. Various embodiments of a multi-material insert 440, 440B, 440C, and 440D are depicted in FIGS. 6-9 and described below.

Figure 6:
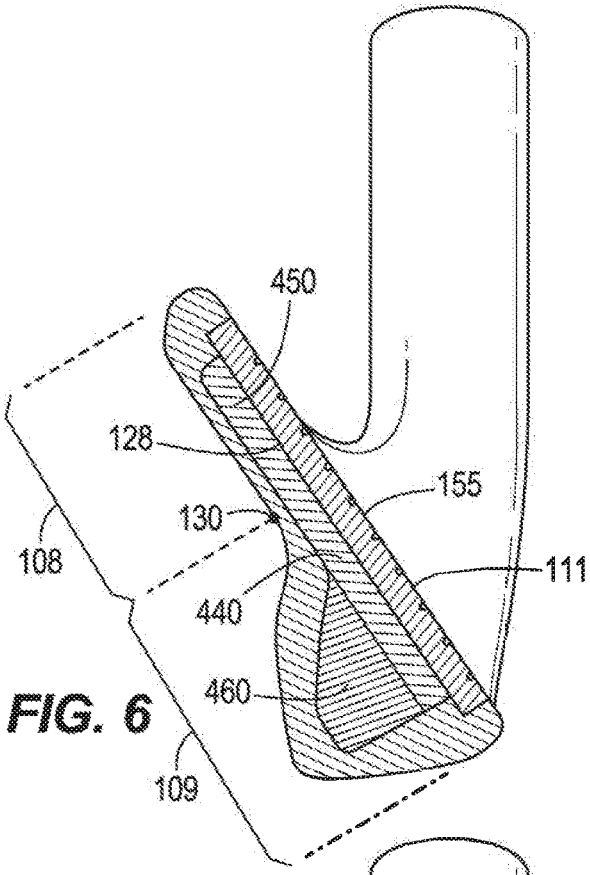
FIG. 6 shows a cross-sectional toe-side view of the golf club head of FIG. 1, along the line V-V in FIG. 3, according to a first embodiment with a multi-material insert.

Referring to FIG. 6, the insert 440 comprises a first portion 450 and a second portion 460. Insert 440 can be designed to fit within the cavity 120 of golf club head 100. The cross-sectional cutaway of FIG. 6 is taken along the centerplane 45 of the golf club head 100. The first portion 450 of the insert 440 is adjacent the strikeplate 155 and comprises a first material. The second portion 460 of the insert 440 is adjacent the rear 103 of the body 110 and comprises a second material. The first portion 450 overlaps the second portion 460. The first portion 450 of the insert 440 comprises a front surface that abuts a rear surface 128 of the faceplate 155. The second portion 460 does not engage the faceplate 155. The second portion 460 comprises a front surface that engages a rear surface of the first portion 450. The second portion 460 is confined within a section of the cavity 120 within the lower portion 109 of the golf club head 100.

In some embodiments, the engaging surfaces of one or both of the first and second portions 450, 460 comprise small features (not shown) that extend out from the generally planar surfaces to increase the engagement surface area. These small features can comprise protrusions, lips, ribs, hooks, or any other suitable feature. These features allow the first portion 450 to be secured onto the second portion 460 through a molding process or co-molding process.

Figure 7:
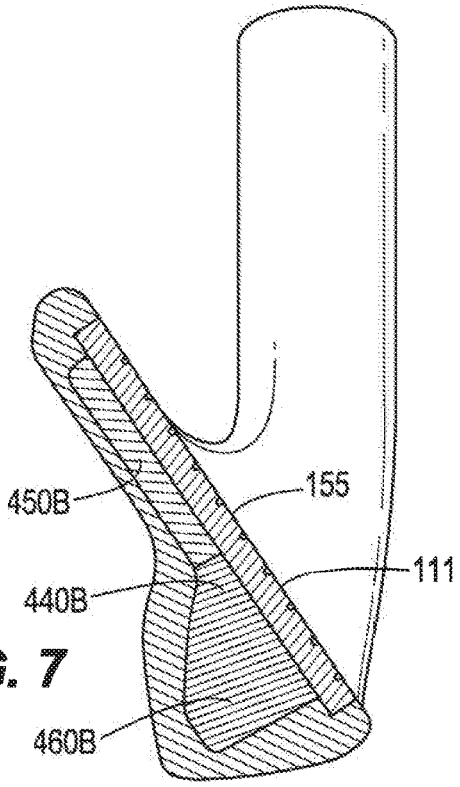
FIG. 7 shows a cross-sectional toe-side view of the golf club head of FIG. 1, along the line V-V in FIG. 3, according to a second embodiment with a multi-material insert.
Figure 8:
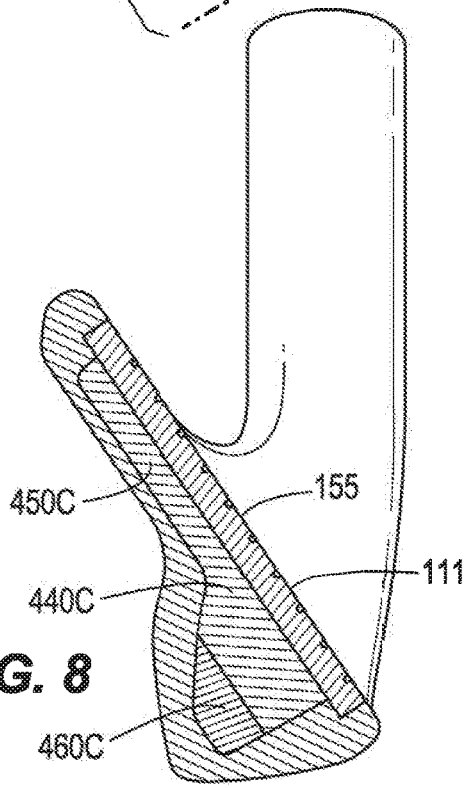
FIG. 8 shows a cross-sectional toe-side view of the golf club head of FIG. 1, along the line V-V in FIG. 3, according to a third embodiment with a multi-material insert.
Figure 9:
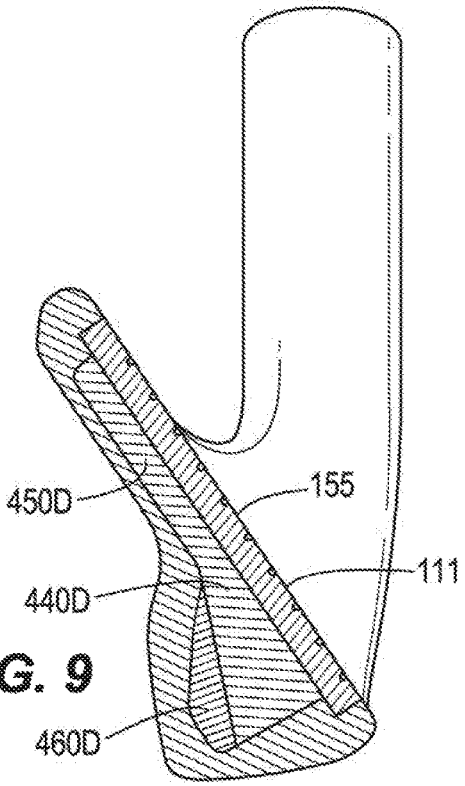
FIG. 9 shows a cross-sectional toe-side view of the golf club head of FIG. 1, along the line V-V in FIG. 3, according to a fourth embodiment with a multi-material insert.

Turning now to FIGS. 7-9, three more example embodiments of multi-material inserts are depicted within a cross-sectional view of the club head 100, taken along the centerplane 45. The second embodiment of a multi-material insert 440B comprises a first portion 450B and a second portion 460B, arranged as illustrated in FIG. 7. In this embodiment, the first portion 450B forms an upper section of the insert 440B and the second portion 460B forms a lower section of the insert 440B. Both the first portion 450B and the second portion 460B are flush against the faceplate 155. The first portion 450B fills the section of the cavity 120 within the upper portion 108 of the body 110. The second portion 460B fills the section of the cavity 120 within the lower portion 109 of the body 110. The second portion 460B is flush against the entire interior sole wall of the cavity 120.

The third embodiment of a multi-material insert 440C comprises a first portion 450C and a second portion 460C, arranged as illustrated in FIG. 8. In this embodiment, the first portion 450C comprises a majority of the volume of the insert 440C. The first portion 450C extends partially into a rear end of the insert 440C. The entire second portion 460C is located rearward of the first portion 450C. The first portion 450C is flush against the faceplate 155 from the top rail 106 to the sole 107 in the cavity of the golf club head 100. The second portion 460C does not engage the faceplate 155. The second portion 460C partially fills and is completely located in the section of the cavity 120 within the lower portion 109 of the body 110. The second portion 460C engages a section of an interior sole wall and rear backwall of the cavity 120. In some embodiments, the second portion 460C is formed from a high density material.

The fourth embodiment of a multi-material insert 440D comprises a first portion 450D and a second portion 460D, arranged as illustrated in FIG. 9. In this embodiment, the first portion 450D extends partially into a rear end of the insert 440D. The first portion 450D engages the second portion 460D along a plane that is angled with respect to the loft plane 20. Furthermore, the first portion 450D is wider adjacent a bottom of the insert 440D than adjacent a top of the insert 440D. With respect to the golf club head 100, the first portion 450D is wider adjacent the sole 107 than adjacent the top rail 106. The first portion 450D is flush against the faceplate 155 from the top rail 106 to the sole 107 in the cavity 120 of the golf club head 100. The second portion 460D does not engage the faceplate 155. The second portion 460D partially fills and is completely located in the section of the cavity 120 within the lower portion 109 of the body 110. The second portion 460C engages a rear backwall of the cavity 120. In some embodiments, the second portion 460D is formed from a high density material. The golf club head 100 having the multi-material insert 440 offers feel and sound improvements over a tour iron lacking an insert.

In yet another embodiment of the golf club head 100 having a multi-material insert, not shown, the second portion, similar to second portions 460, 460B, 460C, 460D, can be located primarily in the toe 101 of the golf club head 110. This provides a toe weighting effect, acting similar to the toe weight 161, described below. Embodiments with the second portion of the insert acting as a toe weight have no need for an external toe weight. This can improve the aesthetics and simplify manufacturing by eliminating the need for welding in a toe weight.

2) Weight-Saving Insert

In some embodiments, a weight-saving insert 240 is employed in place of the insert 140. The weight-saving insert 240, illustrated in FIGS. 10-13, comprises a shape and size similar to the insert 140. In other words, the weight-saving insert 240 is configured to fit within the cavity 120 of the golf club head 100. The weight-saving insert 240 is divided into an insert upper portion 250 (toward the top rail of the golf club head) and an insert lower portion 260 (toward the sole of the golf club head). The insert upper portion 250 can be separated from the insert lower portion 260 by an insert inflection seam 245. The insert upper portion 250 can be solid. The insert lower portion 260 comprises a recess 269 extending inward from a front surface 241 of the insert 240, giving the insert lower portion 260 a shelled-out structure, which reduces the insert weight.

The insert 240 comprises a front surface 241, a rear surface 242, a perimeter 244, and an insert inflection seam 245. A depth 243 of the insert 240 can be measured perpendicular to the front surface 241 in a front-to-rear direction. The front surface 241 is roughly parallel to the loft plane 20. In some embodiments, a portion of the rear surface 242 within the insert upper portion 250 is also roughly parallel to the loft plane 20. The lower portion 260 of the insert 240 has a depth 243 that is greater than the insert upper portion 250. The insert upper portion 250 has a maximum depth that is less than the maximum depth of the insert lower portion 260. In some embodiments, the insert upper portion 250 comprises a uniform depth 243. The ratio of the depth 243 of the insert upper portion 250 to the insert lower portion 260 can range from 1:3 to 1:10.

The insert upper and lower portions 250, 260 can each comprise a length, measured in a heel-to-toe (generally horizontal) direction. The maximum insert upper portion length 248 can be greater than the maximum insert lower portion length 249. In some embodiments, the shorter lower portion 260 is due to a toe weight that occupies room in the lower portion of the golf club 100. Because of the toe weight in these embodiments, the lower portion of the insert cavity is shorter than the upper portion of the insert cavity.

Figure 13:
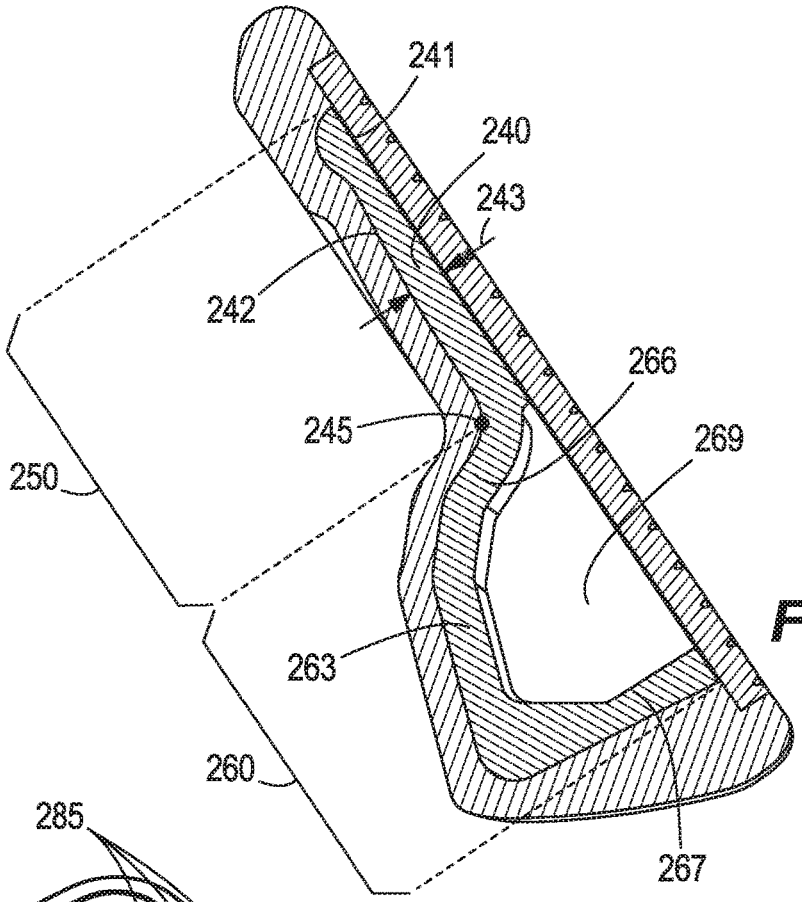
FIG. 13 shows a cross-sectional view, along line XII-XII, of the weight-saving insert of FIG. 10, in the context of a golf club head.

The insert upper portion 250 is solid and bounded by the insert perimeter 244. The insert upper portion 250 perimeter comprises a top rail edge 256, a toe-side edge 251, and a heel-side edge 252. The insert perimeter 244 can be configured to lie flush against walls of the cavity 120. In some embodiments, the toe-side edge 251 has a bend to connect the longer insert upper portion 250 to the insert lower portion 260. The insert upper portion 250 forms part of the front surface 241 of the insert 240. The front surface 241 of the insert 240 is adjacent and/or lies flat against a back of the faceplate of the club head, as illustrated in FIG. 13.

The insert lower portion 260 comprises a rear wall 263, a toe end wall 261, a heel end wall 262, a bottom wall 267, and a top wall 266 that together form a recess 269 (or cavity) within the insert 240. In some embodiments, the recess 269 opens only towards the faceplate, not other walls of the cavity 120. In some embodiments, there are one or more ribs 268 across the recess 269 to provide structural support to the insert 240. The one or more ribs 268 can additionally provide structural support to the face. The one or more ribs 268 can be oriented approximately orthogonal to the faceplate when the insert 240 is installed in the club head body. The one or more ribs 268 can be oriented approximately parallel to a top rail-to-sole direction. The one or more ribs 268 can alter the feel or sound of the club at impact with a golf ball. In some embodiments, at least one of the ribs 268 can comprise a round peg shutoff point (not shown) to accommodate the gating shutoff, necessary for the die casting manufacturing method. In other embodiments, the one or more ribs 268 are thick enough to be shutoff without the need for a round peg shutoff point.

Figure 10:
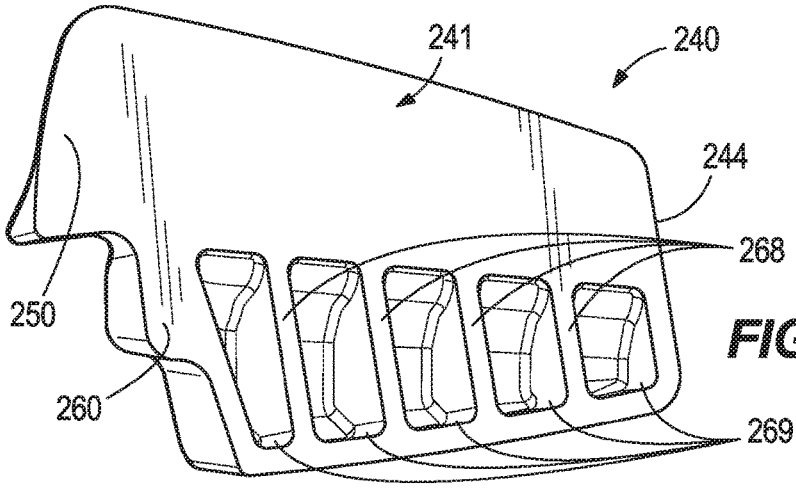
FIG. 10 shows a front perspective view of a weight-saving insert, according to an embodiment.
Figure 11:
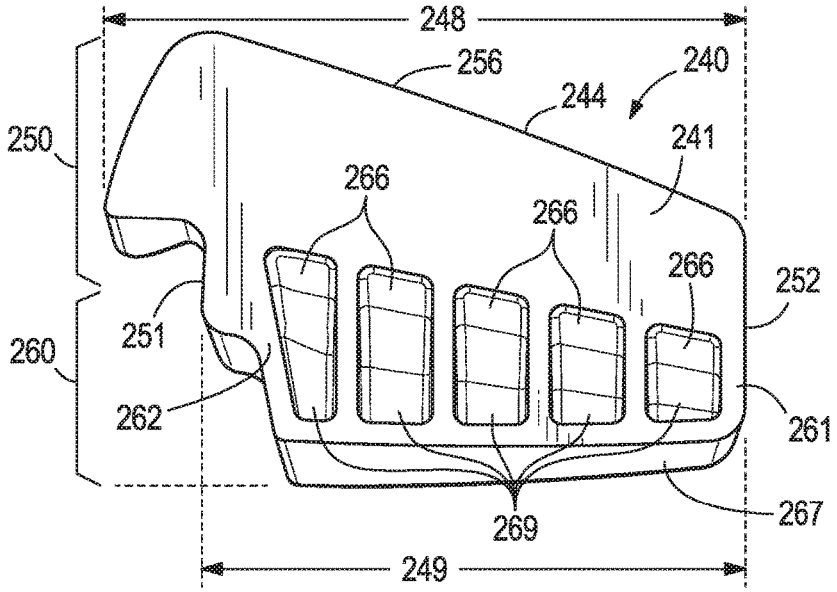
FIG. 11 shows a front view of the weight-saving insert of FIG. 10.
Figure 12:
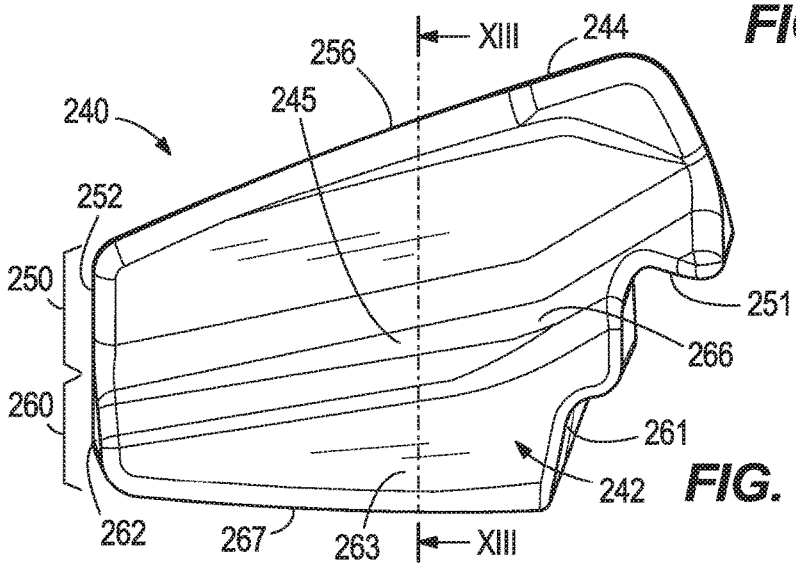
FIG. 12 shows a rear view of the weight-saving insert of FIG. 10.

The one or more ribs 268 divide, separate, and/or subdivide the insert recess 269 into multiple sections or one or more small recesses. In some embodiments, the one or more ribs 268 subdivide the lower portion 260 into 2, 3, 4, 5, 6, 7, or 8 sections or small recesses. The insert illustrated in FIGS. 10 and 11 is subdivided into five recess sections.

The lower portion recess 269 reduces the material volume of the insert 240, thus reducing the weight of the insert 240. In some embodiments, the weight-saving insert 240 can weigh between 5-10 grams less than a similar insert lacking the weight-saving recess. In some embodiments, the weight-saving insert 240 can weigh less than a similar insert lacking the weight-saving recess by between 5 and 6 g, 5.5 and 6.5 g, 6 and 7 g, 6.5 and 7.5 g, 7 and 8 g, 7.5 and 8.5 g, 8 and 9 g, 8.5 and 9.5 g, or 9 and 10 g. In some embodiments, the weight-saving insert 240 can weigh approximately 5 g, 6 g, 7 g, 8 g, 9 g, or 10 g less than a similar insert lacking the weight-saving recess. For example, in one comparison, a 7-iron weight-saving insert weights 7.1 grams less than a 7-iron solid aluminum insert, such as the one described for golf club head 100 above.

Figure 14:
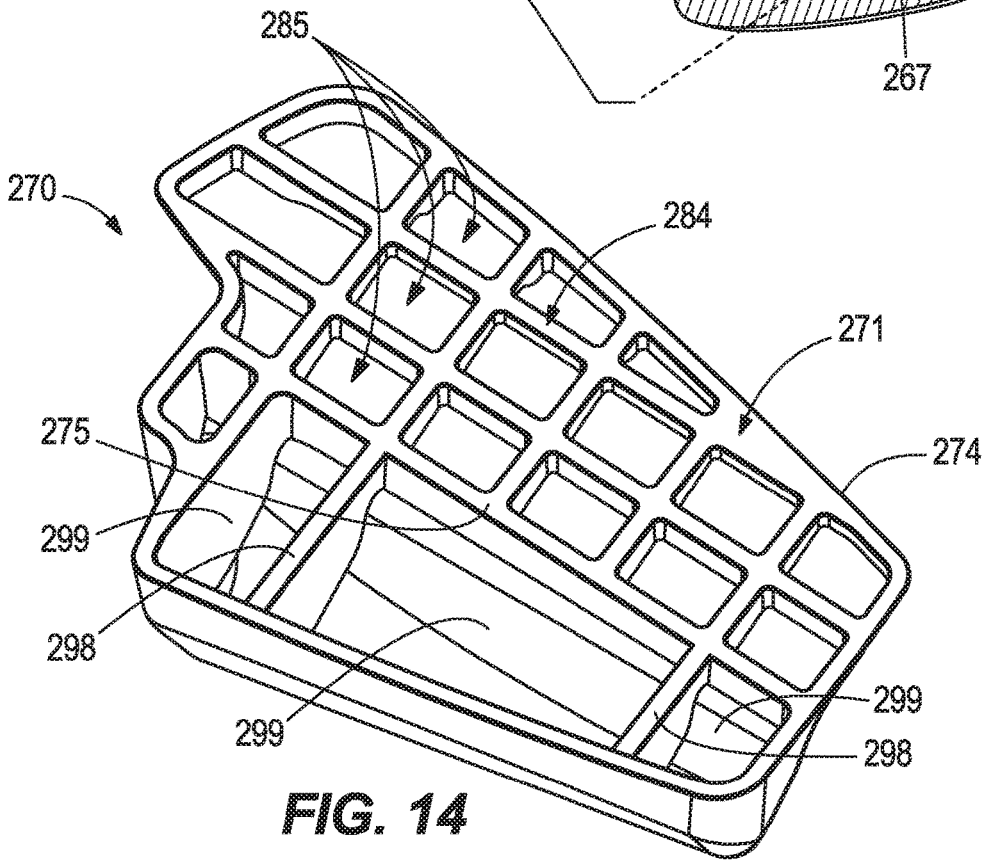
FIG. 14 shows a front perspective view of a second weight-saving insert, according to an embodiment.
Figure 15:
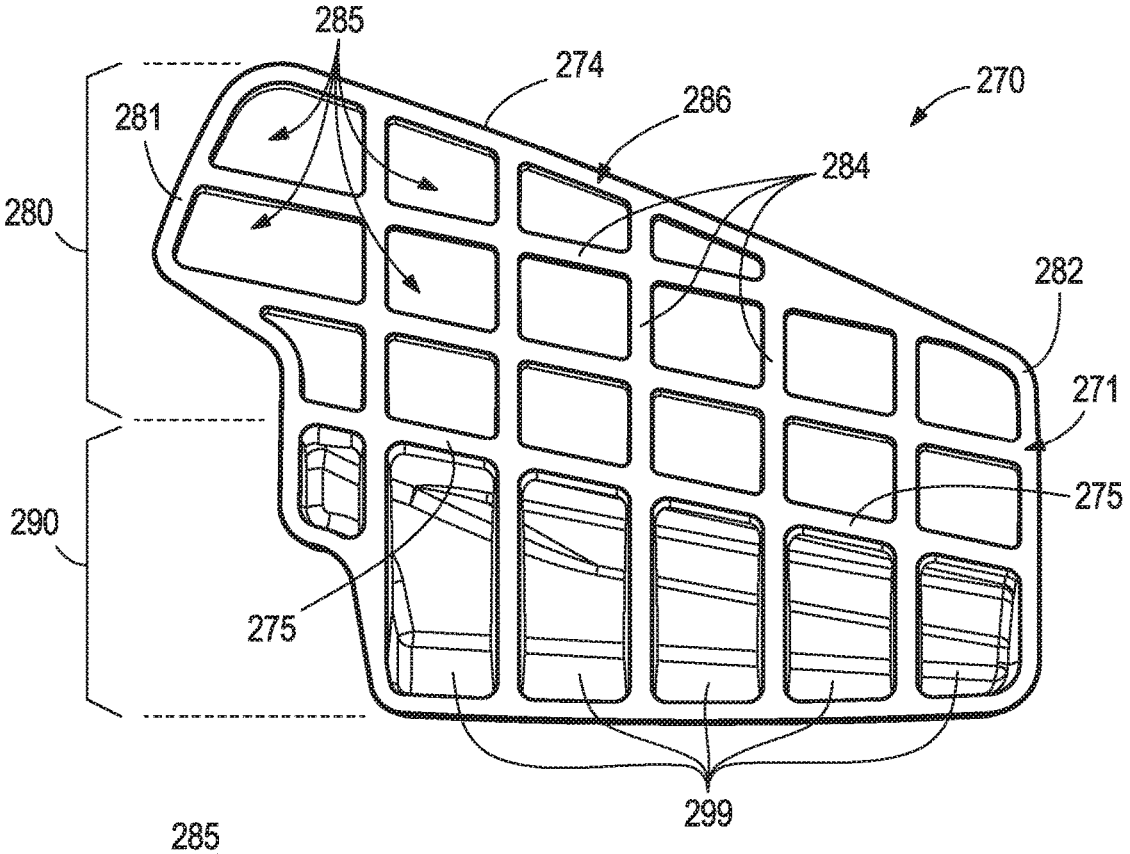
FIG. 15 shows a front view of the weight-saving insert of FIG. 14.
Figure 16:
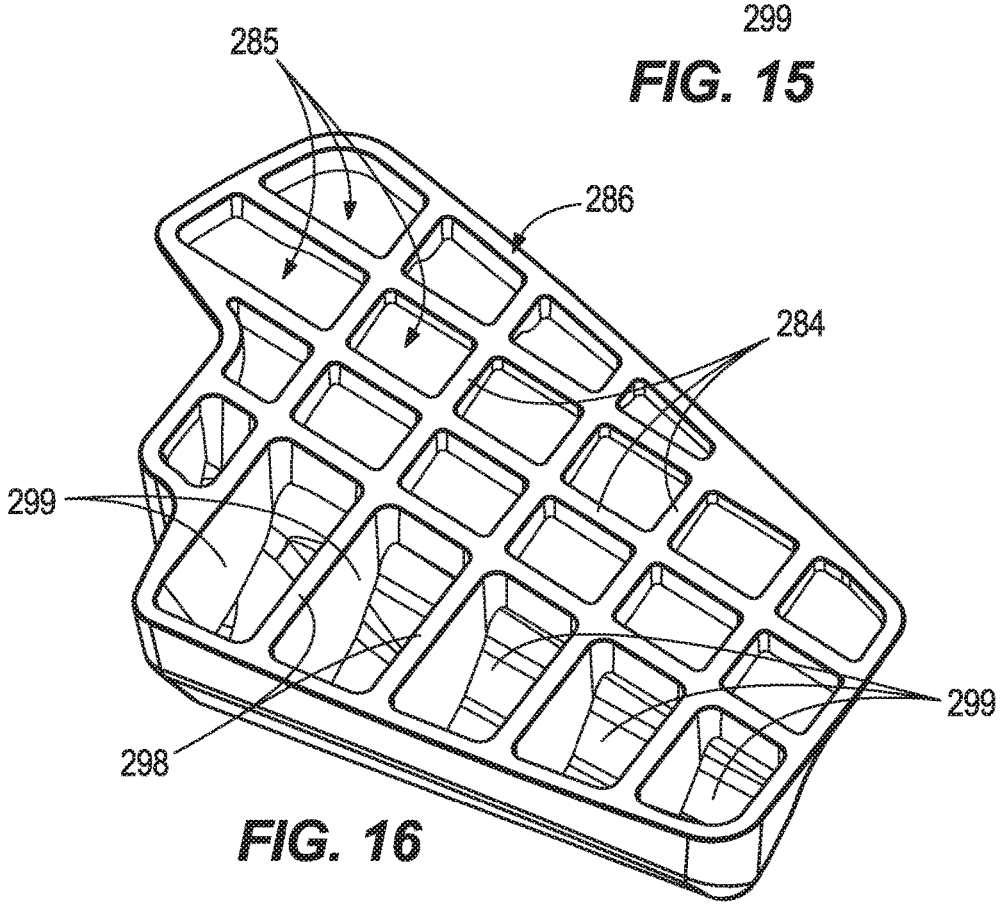
FIG. 16 shows a front perspective view of a variation of the weight-saving insert of FIG. 14.
Figure 17:
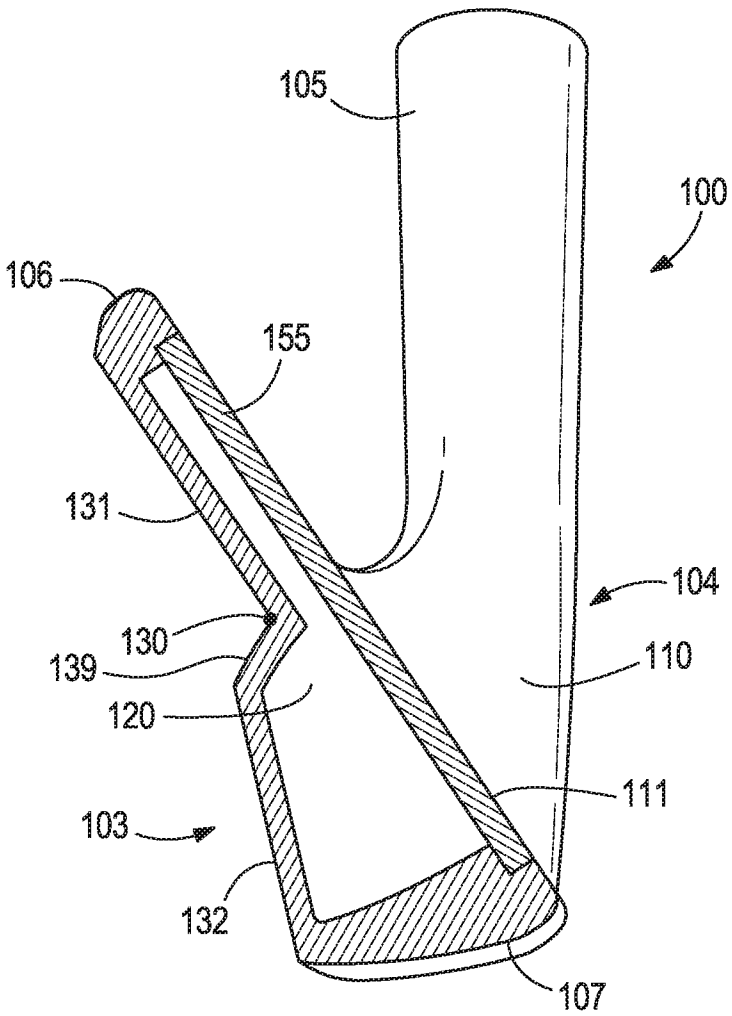
FIG. 17 shows a cross-sectional toe-side view of a golf club head, according to an embodiment having a rear shelf.

A second embodiment of a weight-saving insert 270 is depicted in FIGS. 14-16. A variation on this embodiment is depicted in FIG. 17. The weight-saving insert 270 is similar to the weight-saving insert 240. The weight-saving insert 270 comprises a front surface 271, a rear surface, a perimeter 274, and an insert inflection seam 275. A depth of the weight-saving insert 270 can be similar to the depth of weight-saving insert 240. An insert upper portion 280 is defined above the insert inflection seam 275, and an insert lower portion 290 is defined below the insert inflection seam 275. The insert upper portion 280 comprises at least one connecting rail 284 that forms two or more apertures 285 (or weight-saving zones). The two or more apertures 285 reduce the material needed to form the insert 270 and therefore also reduces the weight of the insert 270.

Within the insert upper portion 280, the perimeter 274 forms a frame to support the at least one connecting rail 284. The perimeter 274 comprises a top rail 286, a heel end rail 282, and a toe end rail 281. The heel end rail 282 and toe end rail 281 connect the top rail 286 to the insert lower portion 290. The insert upper portion 280 can be integrally formed with the insert lower portion 290 at the insert inflection seam 275. The at least one connecting rail 284 extends from one end of the perimeter frame to another end of the perimeter frame. The at least one connecting rail 284 can extend in a toe-to-heel direction, a top rail-to-sole direction, or in a direction angled from either of the aforementioned directions. The at least one connecting rail 284 can comprise one, two, three, four, five, six, seven, eight, nine, ten or more connecting rails 284.

The insert upper portion 280 can comprise subsets of connecting rails 284. In some embodiments, a subset of the connecting rails 284 can be horizontally positioned (generally in a toe-to-heel direction). In some embodiments, a subset of the connecting rails 284 can be vertically positioned (generally in a top rail-to-sole direction). In some embodiments, the horizontally positioned subset of connecting rails 284 intersects the vertically positioned subset of connecting rails 284.

The two or more apertures 285 can comprise a void, aperture, recess, hole, or area devoid of material. The two or more apertures 285 are formed by the perimeter 274 and at least one connecting rail 284. In some embodiments, the two or more apertures 285 are arranged in a grid pattern across the insert upper portion 280. Some of the rails 284 forming the two or more apertures 285 can comprise round shutoff points at their intersections (not shown), serving the same functionality as the shutoff points (not shown) on the insert lower portion 290. The pattern of apertures 285 helps reduce the weight of the insert 270.

The insert lower portion 290 of the second weight saving insert 270 is similar to the insert lower portion 250 of the first weight-saving insert 240. In the embodiment depicted in FIGS. 14-16, the insert comprises two ribs 298, subdividing the lower portion recess 299 into three recess sections. The three recess sections can have unequal sizing, due to the position of the ribs 298 adjacent either end of the recess 299. In the embodiment depicted in FIG. 16, the insert 270 comprises five ribs 298, subdividing the lower portion recess 299 into six recess sections. In some embodiments (not shown), one or more gate shutoff points can be positioned coincident with the one or more ribs 298.

The insert lower portion recess 299 and the insert upper portion apertures 285 reduce the material volume of the insert 270, thus reducing the weight of the second weight-saving insert 270. In some embodiments, the second weight-saving insert 270 can weigh between 5-12 grams less than a similar insert lacking the weight-saving recess 299 and apertures 285. In some embodiments, the weight-saving insert 270 can weigh less than a similar insert lacking the weight-saving recess 299 and apertures 285 by between 5 and 6 g, 5.5 and 6.5 g, 6 and 7 g, 6.5 and 7.5 g, 7 and 8 g, 7.5 and 8.5 g, 8 and 9 g, 8.5 and 9.5 g, 9 and 10 g, 9.5 and 10.5 g, 10 and 11 g, 10.5 and 11.5 g, or 11 and 12 g. In some embodiments, the weight-saving insert 270 can weigh approximately 5 g, 6 g, 7 g, 8 g, 9 g, 10 g, 11 g, or 12 g less than a similar insert lacking the weight-saving recess 299 and apertures 285.

3) Volume of the Cavity Filled by Insert of the Golf Club Head

As mentioned above, the insert 140 can fully or partially fill the cavity 120 of the golf club head 100. The insert 140 can fill a volume of the cavity 120 between 80% and 100%. In some embodiments, the insert 140 can fill a volume of the cavity 120 between 80% and 85%, 85% and 90%, 90% and 95%, 95% and 100%, 80% and 90%, or 90% and 100%. In contrast to traditional hollow body irons, the golf club head 100 does not comprise a fully air-filled cavity. Rather, the cavity 120 is at least partially filled with the insert 140.

Referring back to FIGS. 6-9, in embodiments having a multi-material insert, such as insert 440, the first portion 450 can fill a majority of the cavity 120. The second portion 460 can fill the remainder of the cavity 120. In some embodiments, not depicted, the first and second portions together only partially fill the cavity 120. In embodiments having a multi-material insert 440, the first portion 450 can fill between 20% to 90% of the volume of the cavity 120. In some embodiments, the first portion 450 can fill between 20% and 30%, 30% and 40%, 40% and 50%, 50% and 60%, 60% and 70%, 70% and 80%, or 80% and 90%. The second portion 460 can fill between 10% to 80% of the volume of the cavity 120. In some embodiments, the second portion 460 can fill between 10% and 20%, 20% and 30%, 30% and 40%, 40% and 50%.

The volumes of the first and second portions 450, 460 affect the overall weighting of the golf club head 100 because the first and second portions 450, 460 are formed with different materials having different densities, as described in detail below. In the design of a golf club head, many design parameters must be considered together. By forming the insert from multiple materials, the mass placement can be controlled to increase perimeter weighting and lower the CG, leading to improved launch characteristics and higher ball speeds.

4) Tape Layers Combined with Insert in the Golf Club Head

Figure 19:
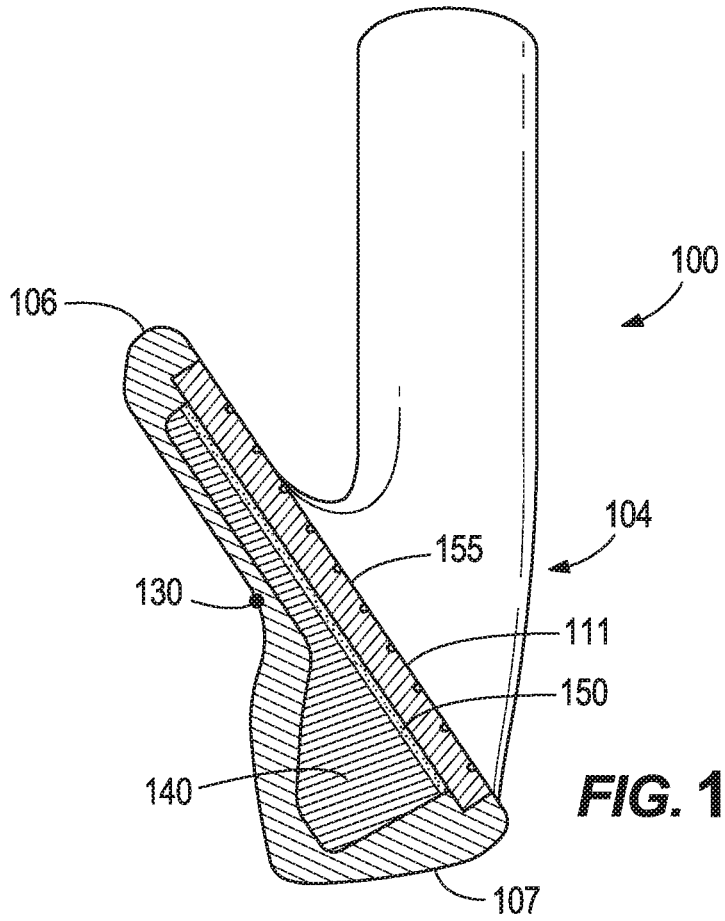
FIG. 19 shows a cross-sectional toe-side view of the golf club head of FIG. 1, along the line V-V in FIG. 3, including a tape layer.

In some embodiments, a tape layer 150 is placed within the cavity 120 between the insert 140 and the strikeface 111. As seen in FIG. 19, the tape layer 150 is sandwiched between the insert 140 and the faceplate 155. Golf club head embodiments having a multi-material insert, such as 440, can similarly comprise a tape layer 150 between the first portion 450 and the faceplate 155 or between the first portion 450 of the insert 440 and the body 110. Within the golf club head 100, the insert 140 fits within the body 110, the tape layer 150 can optionally lay on the insert 140, and the faceplate 155 covers the tape layer 150 and fills the indentation 142 of the body 110.

In some embodiments, not shown, a second tape layer can lie flush with an interior surface of the rear 103 of the body 110 within the cavity 120. The second tape layer can be sandwiched between the rear 103 of the body 110 and the insert 140. In some embodiments, a third tape layer can lie flush at a bottom of the cavity 120. The third tape layer can be sandwiched between the sole 107 of the body 110 and the insert 140. The golf club head 100 can comprise one or more of the first tape layer 150, the second tape layer, and the third tape layer.

The tape layer 150, second tape layer, or third tape layer can comprise a material such as a very high bond (hereafter "VHB") tape. The VHB tape is compressible, such that an original thickness of the tape layer 150 (measured orthogonal to the strikeface 111) when initially provided is greater than a thickness of the compressed tape layer within the assembled golf club head 100. The second and third tape layers can be similarly compressible. The compressible nature of the one or more tape layers reduces the likelihood of rattling caused by manufacturing tolerances between the body 110 and the insert 140. Furthermore, the one or more tape layers can provide vibration damping as well as positively affect the feel and sound of the golf club head 100.

C. Faceplate of the Golf Club Head

The full golf club head 100 is formed by the combination of the body 110, the insert 120, and the faceplate 155. The body 110 comprises an opening of the cavity 120 at the front 104 of the golf club head 100. The opening is covered by the faceplate 155, to entirely enclose the cavity 120 and the insert 140. As shown in FIGS. 2 and 3, the cavity 120 and the insert 140 are not visible from the outside of the golf club head 100 when the insert 140 is positioned within the cavity 120. By concealing the insert 140 within the golf club head 100, the look of the golf club head 100 can resemble the look of traditional tour irons.

Consequently, a portion of the front 104 of the body 110 and the faceplate 155 form the strikeface 111. The strikeface 111 can cover between 70% and 95% of the surface area of the front 104 of the golf club head 100. In some embodiments, the strikeface 111 can cover between 70% and 80%, 75% and 85%, 80% and 90%, or 85% and 95% of the surface area of the front of the golf club head 100. Furthermore, a front surface of the strikeface 111 may comprise one or more grooves. In some embodiments, the grooves extend beyond the edge of the faceplate 155 and onto a portion of the body 110.

The faceplate 155 can comprise a different material than the body 110, as described below. In some embodiments, the material of the faceplate 155 is stronger than the material of the body 110. To exploit the benefits of the faceplate 155 material, the majority of the strikeface 111 is formed by the faceplate 155. The faceplate 155 can form between 50% and 95% of the surface area of the front 104 of the golf club head 100. In some embodiments, the faceplate 155 can form between 50% and 60%, 60% and 70%, 70% and 80%, 80% and 90%, or 85% and 95% of the surface area of the strikeface 111. Despite having different materials, the faceplate 155 and the body 110 portion of the strikeface 111 both give a solid feel because the insert 140 solidly supports the faceplate 155. The body 110, the insert 140, and the faceplate 155 can all contribute to a consistent feel and sound for the golf club head 100 when the golf club head 100 impacts a golf ball on various regions of the faceplate 155.

1) Other Faceplate Characteristics

The support provided to the faceplate 155 by the insert 140 enables a thin faceplate 155 to be used in the golf club head 100. As illustrated in FIG. 5, the faceplate 155 of the golf club head 100 has a thickness 112. The thickness 112 can range between 0.030 inch and 0.100 inch. In some embodiments, the faceplate thickness 112 can be 0.030 inch, 0.040 inch, 0.050 inch, 0.060 inch, 0.070 inch, 0.080 inch, 0.090 inch, or 0.100 inch. The faceplate thickness 112 can be constant across the faceplate 155. In some embodiments, the faceplate thickness 112 can vary in a heel-to-toe direction or in a top rail-to-sole direction. In some embodiments, the faceplate thickness 112 can vary in a radial direction from a center of the faceplate 155.

In other embodiments, the faceplate 155 can further comprise variable thickness regions. In some embodiments, a central region of the faceplate 155 can be thicker than a peripheral region of the faceplate 155. In some embodiments, the thickened central region can comprise an elliptical shape. The thickness of the faceplate 155 can taper from the central towards a periphery of the faceplate 155.

D. Other Peripheral Weights (Tip Weights, Toe Weights) in the Golf Club Head

Figure 20:
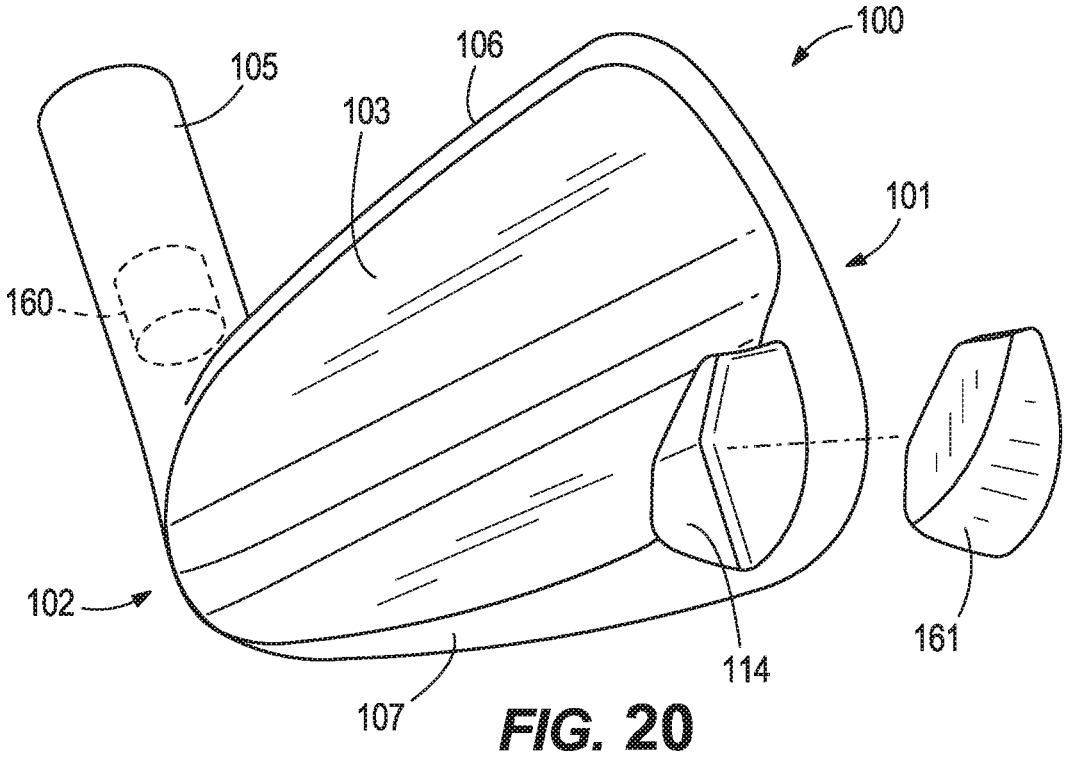
FIG. 20 shows a rear perspective view of the golf club head of FIG. 1, including an exploded view of the toe cavity and toe weight.
Figure 21:
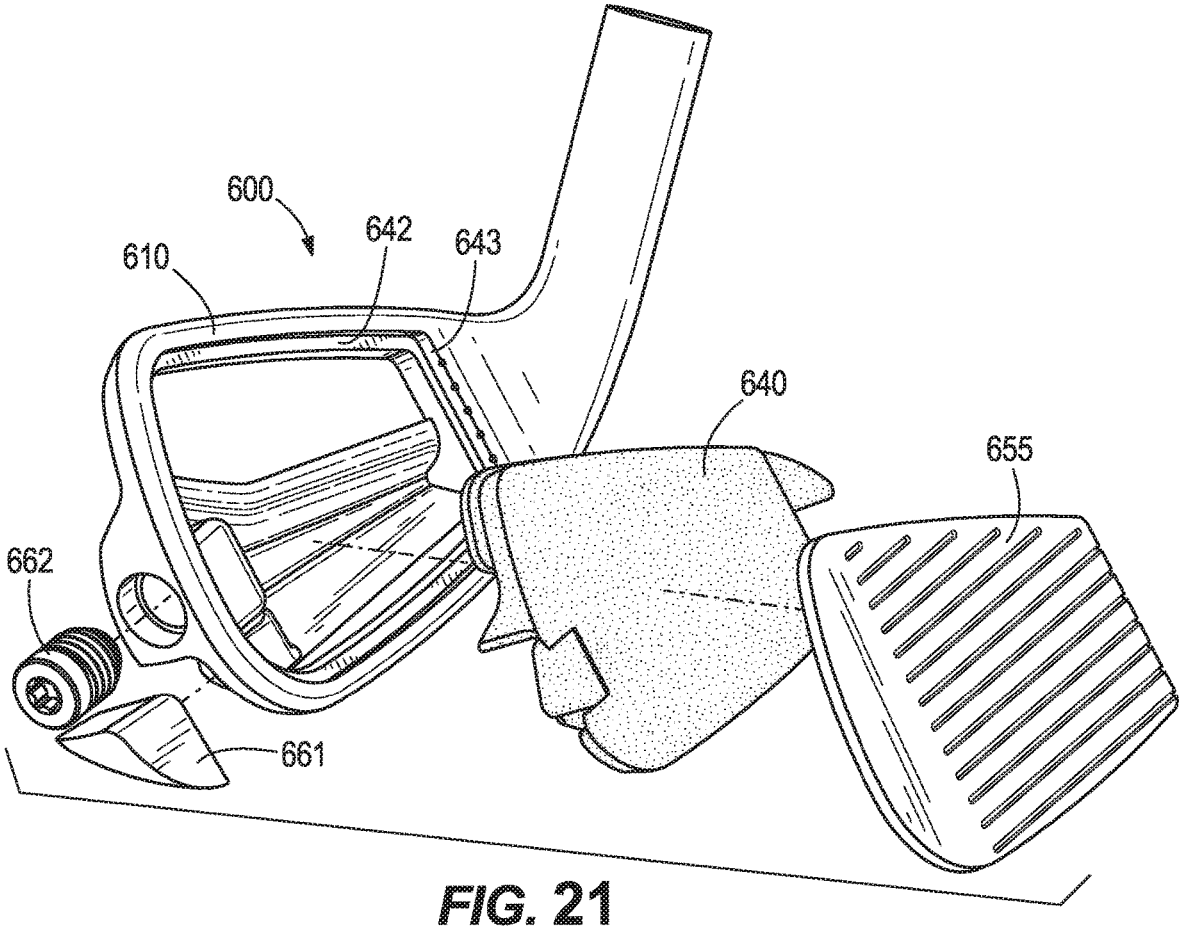
FIG. 21 shows an exploded view of a golf club head, according to a second embodiment.
Figure 22:
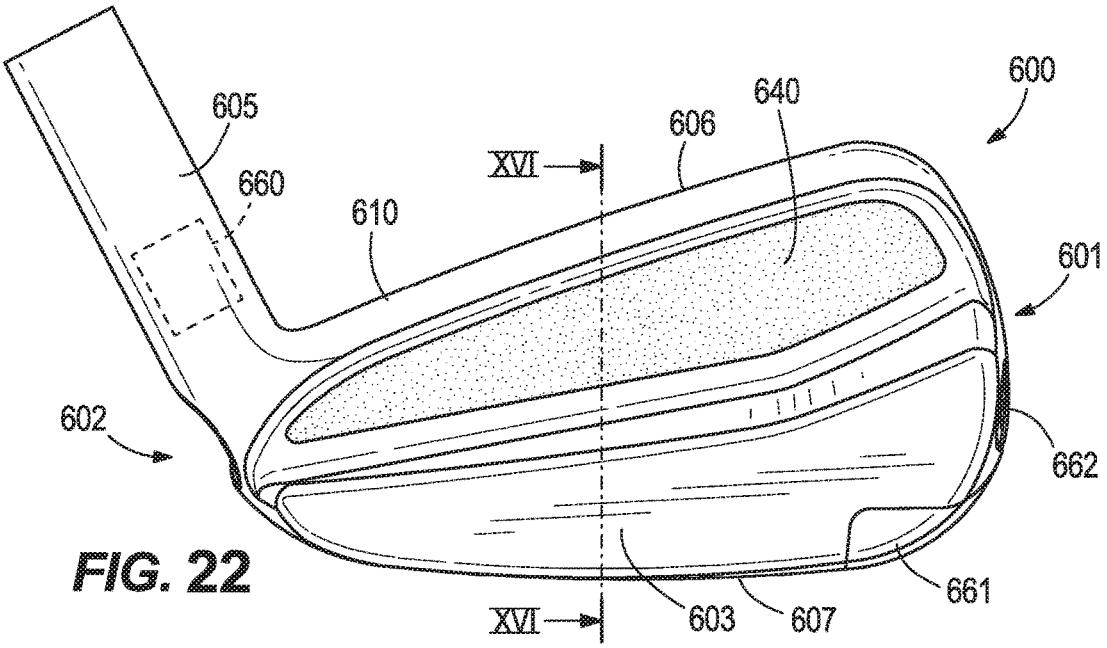
FIG. 22 shows a rear view of the golf club head of FIG. 21.
Figure 23:
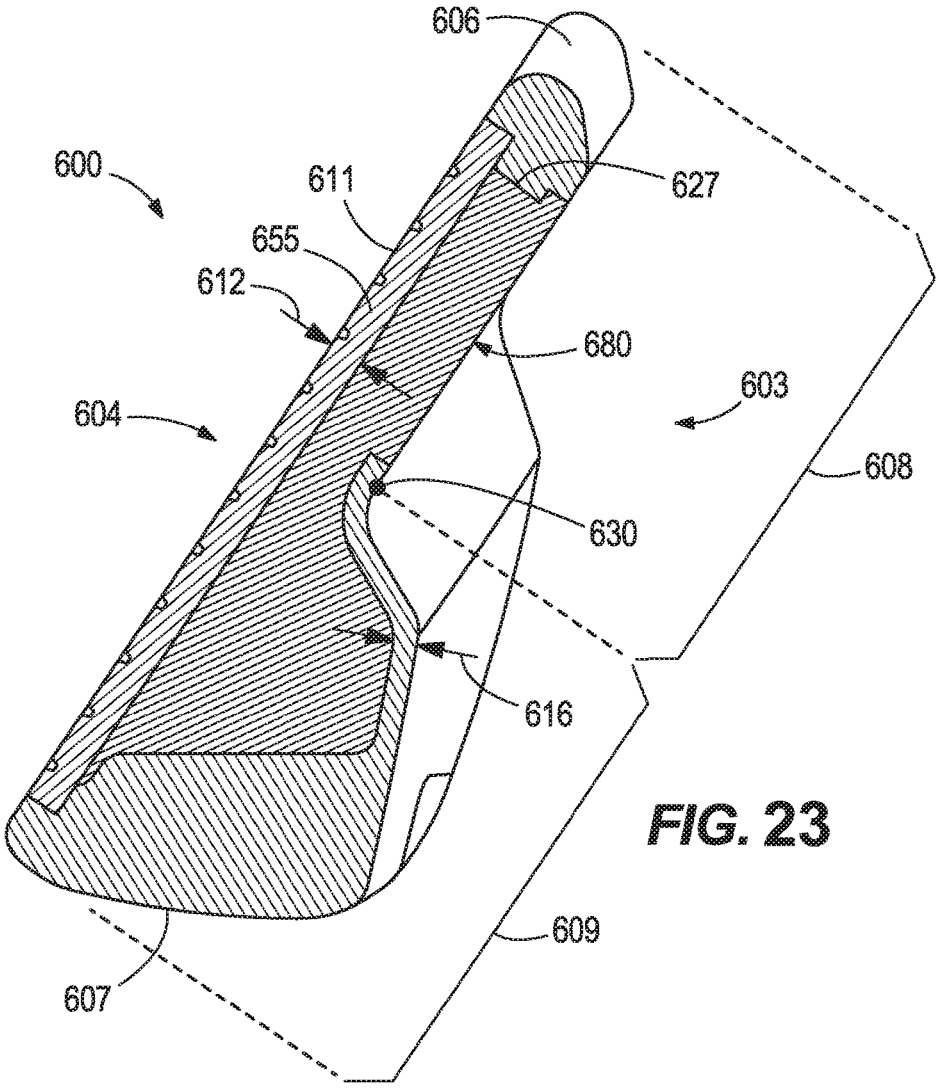
FIG. 23 shows a cross-sectional heel-side view of the golf club head of FIG. 21, along the line XVI-XVI in FIG. 22.

In addition to the perimeter weighting and swing characteristics provided by the insert 140 and the body 110, the golf club head 100 can further comprise other perimeter types of weights. In some embodiments, the golf club head 100 can further comprise a tip weight 160. The tip weight 160 is a weight that fits at the juncture between the hosel 105 and the golf club shaft. The tip weight 160 provides additional perimeter weighting to the club head 100. As illustrated in FIG. 20, the tip weight 160 fits within the hosel 105 of the body 110. The tip weight 160 can be cylindrical, spherical, cube-shaped, or any other suitable shape. The tip weight 160 may be located higher or lower in the hosel 105 than is pictured in FIG. 20.

As illustrated in FIGS. 1 and 20, the body 110 of the golf club head 100 can further comprise a toe cavity 114. The toe cavity 114 is designed to house a toe weight 161, which improves the perimeter weighting and swing characteristics of the golf club head 100. FIGS. 3 and 4 illustrate the toe cavity 114 with the toe weight 161 installed. FIG. 20 illustrates the toe weight 161 removed from the toe cavity 114. In some embodiments, the toe cavity 114 is located partially in the sole 107 and partially in the toe 101. In some embodiments, the toe cavity 114 is located fully in the toe 101 of the golf club head 100, adjacent the sole 107. In some embodiments, the toe cavity 114 is located completely in the sole 107, adjacent the toe 101. In some embodiments, the toe cavity 114 is located completely in the toe 101. In some embodiments, the toe cavity 114 is located in the center of the toe 101, approximately half way between the top rail 106 and the sole 107.

In some embodiments, the toe cavity 114 is visible from the rear view of the body 110 of the club head 100. In other embodiments, the toe cavity 114 is not visible from the rear view of the body 110. In some embodiments, the toe cavity 114 is visible from the toe-side view of the body 110. In other embodiments, the toe cavity 114 is not visible from the toe-side view of the body 110. In some embodiments, the toe cavity 114 is visible from the sole view of the body 110. In other embodiments, the toe cavity 114 is not visible from the sole view of the body 110. In the embodiment of FIGS. 1-13, the toe cavity 114 is visible from the rear view, the sole view, and the toe-side view.

The toe weight 161 is shaped to match the contours of the toe cavity 114 of the body 110. An external wall of the toe weight 161 is designed follow the curve of the golf club head body 110. In some embodiments, the mass of the toe weight 161 can be between 5% and 45% of the mass of the body 110. In some embodiments, the mass of the toe weight 161 can be between 5% and 20%, 5% and 15%, 10% and 20%, 15% and 25%, 20% and 40%, 20% and 30%, 30% and 40%, or 35% and 45% of the mass of the body 110.

In some embodiments, the body 110 of the golf club head 100 can further comprise a toe screw weight port, not depicted, in the toe 101. The golf club head 100 can further comprise a toe screw weight that fits within the screw weight port. In some embodiments, the toe screw weight can comprise a weight between 2 grams and 15 grams, as described below. A screw weight having one weight value can be exchanged for a different screw weight having a different weight value in order to customize the golf club head 100 to a golfer's swing.

In some embodiments, there is a combination of weights as described above including the insert, toe weight, tip weight, and the toe screw weight. Other embodiments can comprise a multi-material insert combined with one or more of a toe weight, a tip weight, and a toe screw weight. Yet other embodiments comprise a weight-saving insert combined with one or more of a toe weight, a tip weight, and a toe screw weight. For example, some embodiments comprise a weight-saving insert, a tip weight, and a toe screw weight.

E. Materials

The materials that form the body 110, the insert 140, and the faceplate 155 affect the mass distribution of the golf club head 100. Consequently, the MOI and CG of the golf club head 100 are also affected by the densities of the materials. Furthermore, the materials provide the strength and flexibility necessary for the golf club head 100. The golf club head 100 comprises one or more, two or more, three or more, or four or more materials. In some embodiments, the materials may be a first density, second density, third density, fourth density, fifth density or sixth density.

In some embodiments, the faceplate 155 can comprise a first material of a first density. The body 110 can comprise a second material of a second density. The insert 140 can comprise a third material of a third density. The third density can be less than the first density and/or the second density. In some embodiments, the faceplate 155 can be the same material as the body 110 (and thereby the same densities). As discussed above and in some embodiments, the insert 440 can comprise two or more materials wherein the materials are a different density over each other, and can be different or the same over the materials of the faceplate 155 and/or the body 110.

1) Body Materials

The body 110 may comprise a material, such as steel, a steel alloy, or any other suitable material. In some embodiments, the body 110 can comprise a material of a density that is different over the faceplate 155 and the insert 140. The material can comprise a material selected from the group consisting of a steel-based material or a steel alloy. In some embodiments, the body material can be 8620 carbon steel, which comprises iron and approximately 0.17-0.23% wt. carbon, 0.15-0.35% wt. silicon, 0.60-0.90% wt. manganese, 0.15-0.30% wt. molybdenum, 0.40-0.70% wt. nickel, 0.40-0.65% wt. chromium, 0.040% wt. phosphorus, and trace amounts of other elements. In some embodiments, the body material can be 300 grade steel, which comprises iron and approximately 18-19% wt. nickel, 8.5-9.5% wt. cobalt, 4.6-5.2% wt. molybdenum, 0.5-0.8% wt. titanium, 0.05-0.15% wt. aluminum, and trace amounts of other elements.

In some embodiments, the body material can be maraging steel, which comprises iron and approximately 17-19% wt. nickel, 8-12.5% wt. cobalt, 3.0-5.2% wt. molybdenum, 0.15-1.6% wt. titanium, 0.05-0.15% wt. aluminum, and trace amounts of other elements. The density of the body 110 material can range between 7.70 and 8.10 grams per cubic centimeter (hereafter "g/cc"). In some embodiments, the density of the body material can be 7.70 g/cc, 7.75 g/cc, 7.80 g/cc, 7.85 g/cc, 7.90 g/cc, 7.95 g/cc, 8.05 g/cc, or 8.10 g/cc. In one embodiment, the density of the body material is 7.85 g/cc.

2) Insert Materials

The insert 140 comprises a material, such as titanium, a titanium alloy, aluminum, an aluminum alloy, an elastomer, a polymer matrix composite, any other suitable low density material, or any other suitable density material that is lower than the body 110 material. The aluminum alloy can be high strength aluminum alloy, or a composite aluminum alloy coated with a high-strength alloy. The polymer matrix composite can be a glass-filled elastomer, a stainless steel-filled elastomer, a tungsten-filled elastomer, a thermoplastic polyurethane (TPU), a thermoplastic elastomer (TPE), or any other elastomer matrix composite, a Kevlar® (aramid) fiber-reinforced polymer, a carbon-fiber reinforced polymer, or any combination of a suitable resin and a suitable reinforcing fiber. The polymer matrix composite material can be an elastomer matrix composite. In some embodiments the metal material can be a steel-based material, a titanium-based material, an aluminum alloy, a titanium alloy, or any combination thereof. The steel-based material can be a 17-4 PH stainless steel, 431, 455, 475, C300, a maraging steel, or other types of stainless steel. The aluminum alloy can be high strength aluminum alloy, or a composite aluminum alloy coated with a high-strength alloy. The titanium alloy can be Ti-9S, Ti-6-4, and Ti-15-3-3-3. The titanium alloy can be an $\alpha$-$\beta$ titanium alloy.

The insert 140 may comprise a material of a density that is different over the body 110 and the faceplate 155. Suitable materials for the insert 140 can include any materials that have a density lower than the density of the body material. In some embodiments, particularly ones with a metal insert material, the density of the insert 140 material can range between 2.4 to 5.0 g/cc. In some embodiments, the density of the insert 140 material can be 2.4 g/cc, 2.5 g/cc, 2.6 g/cc, 2.7 g/cc, 2.8 g/cc, 2.9 g/cc, 3.0 g/cc, 3.1 g/cc, 3.2 g/cc, 3.3 g/cc, 3.4 g/cc, 3.5 g/cc, 3.6 g/cc, 3.7 g/cc, 3.8 g/cc, 3.9 g/cc, 4.0 g/cc, 4.1 g/cc, 4.2 g/cc, 4.3 g/cc, 4.4 g/cc, 4.5 g/cc, 4.6 g/cc, 4.7 g/cc, 4.8 g/cc, 4.9 g/cc, or 5.0 g/cc. In one embodiment, the insert 140 material is aluminum and the density of the insert 140 material is approximately 2.7 g/cc. In another embodiment, the insert 140 material is titanium and the density of the insert 140 material is approximately 4.5 g/cc.

In some embodiments, particularly ones with a polymer matrix composite material, the density of the insert 140 can range between 1.0 and 12.0 g/cc. In polymer matrix composite material preferred embodiments, the density of the insert 140 can range between 1.0 g/cc and 5.0 g/cc. In some embodiments, the density of the insert 140 can be 1.0 g/cc, 1.5 g/cc, 2.0 g/cc, 2.5 g/cc, 3.0 g/cc, 3.5 g/cc, 4.0 g/cc, 4.5 g/cc, or 5.0 g/cc. When the density of the insert 140 is low, a central portion of the club head that houses the insert 140 is lighter, allowing weight to be redistributed to the periphery of the club head. The redistributed weight increases the MOI.

In some embodiments of the golf club head 100, the insert 440 comprises distinct portions formed from different materials and different densities. In some embodiments, the first and second portions 450, 460 of the insert 440 can each be formed from any of the materials mentioned above for the single-material insert. In some embodiments, the first portion 450 of the insert 140 is formed from an elastomer or polymer matrix composite material, comprising a density between 0.8 g/cc and 1.4 g/cc, and the second portion 460 of the insert 440 is formed from aluminum or an aluminum alloy, comprising a density between 1.5 g/cc and 3.0 g/cc.

In some embodiments of the golf club head 100, the first portion 450 of the insert 440 can comprise any of the material mentioned above having a density between 1.0 g/cc and 12.0 g/cc. In some embodiments, the second portion 460 of the insert 440 can comprise a material that has a density higher than the density of the body material. In some embodiments, the second portion 460 of the insert 440 can be a weight portion comprising any of the materials described below for the toe weight 161 and having a density between 14.0 and 19.6 g/cc. In some of these embodiments, the toe weight 161 is not necessary, because the second portion 460 of the insert 140 serves a similar purpose.

The weight of the insert 140 or 440 can range between 10 grams and 50 grams. In some embodiments, the weight of the insert 140 can be 10 grams, 11 grams, 12 grams, 13 grams, 14 grams, 15 grams, 16 grams, 17 grams, 18 grams, 19 grams, 20 grams, 21 grams, 22 grams, 23 grams, 24 grams, 25 grams, 26 grams, 27 grams, 28 grams, 29 grams, 30 grams, 31 grams, 32 grams, 33 grams, 34 grams, 35 grams, 36 grams, 37 grams, 38 grams, 39 grams, 40 grams, 41 grams, 42 grams, 43 grams, 44 grams, 45 grams, 46 grams, 47 grams, 48 grams, 49 grams, or 50 grams. In multi-material insert embodiments where the second portion 460 of the insert comprises a material similar to the material of the toe weight 161 described below, the insert 140 or 440, and the weight of the insert 140 or 440 can range between 10 grams and 70 grams. In some embodiments, the weight of the multi-material insert 140 or 440 can be between 10 grams and 20 grams, 20 grams and 30 grams, 30 grams and 40 grams, 40 grams and 50 grams, 50 grams and 60 grams, or 60 grams and 70 grams.

Furthermore, the insert 140 and 440 provides structural support to the strikeface 111. For embodiments having a metal insert material, the insert 140 or 440 or a portion of the insert 140 or 440 can comprise a Rockwell B hardness between 30 HRB and 100 HRB. In some embodiments, the insert 140 or 440 or a portion of the insert 140 or 440, can have Rockwell B hardness between 30 HRB and 40 HRB, 40 HRB and 50 HRB, 50 HRB and 60 HRB, 60 HRB and 70 HRB, 70 HRB and 80 HRB, 80 HRB and 90 HRB, 90 HRB and 100 HRB. In other embodiments the insert 140 or a portion of the insert 140 can have a Rockwell B hardness of 30 HRB, 31 HRB, 32 HRB, 33 HRB, 34 HRB, 35 HRB, 36 HRB, 37 HRB, 38 HRB, 39 HRB, 40 HRB, 41 HRB, 42 HRB, 43 HRB, 44 HRB, 45 HRB, 46 HRB, 47 HRB, 48 HRB, 49 HRB, 50 HRB, 51 HRB, 52 HRB, 53 HRB, 54 HRB, 55 HRB, 56 HRB, 57 HRB, 58 HRB, 59 HRB, 60 HRB, 61 HRB, 62 HRB, 63 HRB, 64 HRB, 65 HRB, 66 HRB, 67 HRB, 68 HRB, 69 HRB, 70 HRB, 71 HRB, 72 HRB, 73 HRB, 74 HRB, 75 HRB, 76 HRB, 77 HRB, 78 HRB, 79 HRB, 80 HRB, 81 HRB, 82 HRB, 83 HRB, 84 HRB, 85 HRB, 86 HRB, 87 HRB, 88 HRB, 89 HRB, 90 HRB, 91 HRB, 92 HRB, 93 HRB, 94 HRB, 95 HRB, 96 HRB, 97 HRB, 98 HRB, 99 HRB, or 100 HRB. For other embodiments having a metal insert the insert 140 or 440 or a portion of the insert 140 or 440 can comprise a Rockwell C hardness between 30 HRC and 60 HRC. In some embodiments, the insert 140 or 440 can have a hardness between 30

HRC and 40 HRC, 35 HRC and 45 HRC, 40 HRC and 50 HRC, 45 HRC and 50 HRC, or 50 HRC and 60 HRC. In other embodiments, the insert can have a Rockwell C hardness of 30 HRC, 31 HRC, 32 HRC, 33 HRC, 34 HRC, 35 HRC, 36 HRC, 37 HRC, 38 HRC, 39 HRC, 40 HRC, 41 HRC, 42 HRC, 43 HRC, 44 HRC, 45 HRC, 46 HRC, 47 HRC, 48 HRC, 49 HRC, 50 HRC, 51 HRC, 52 HRC, 53 HRC, 54 HRC, 55 HRC, 56 HRC, 57 HRC, 58 HRC, 59 HRC, or 60 HRC. For some embodiments comprising a titanium or titanium alloy insert 140 or 440, the insert hardness is 44 HRC.

3) Faceplate Materials

The faceplate 155 can be formed from a faceplate material. In some embodiments, the faceplate material is the same material as the body 110 material. In other embodiments, the faceplate material is a different material than the body material. In some embodiments, the faceplate 155 can comprise a material of a density that is different over the body 110 and the insert 140.

The faceplate material can be a steel-based material, a titanium-based material, a titanium alloy, or any combination thereof. The steel-based material can be a carbon steel, a 17-4 PH stainless steel, 431, 455, 475, C300, a maraging steel, or other types of stainless steel. The titanium alloy can be Ti-7S+ (ST721), Ti-9S, Ti-6-4, Ti-15-3-3-3, or any other suitable titanium alloy. The titanium alloy may be an $\alpha$-$\beta$ titanium alloy. In embodiments where the faceplate 155 is a titanium-based material, an aluminum alloy, a titanium alloy, or any combination thereof, the density of the faceplate 155 material can range between 2.6 and 8.7 g/cc. In some embodiments, the density of the faceplate material can be 2.6 g/cc, 2.8 g/cc, 3.0 g/cc, 3.2 g/cc, 3.4 g/cc, 3.6 g/cc, 3.8 g/cc, 4.0 g/cc, 4.2 g/cc, 4.4 g/cc, 4.6 g/cc, 4.8 g/cc, 5.0 g/cc, 5.2 g/cc, 5.4 g/cc, 5.6 g/cc, 5.8 g/cc, 6.0 g/cc, 6.2 g/cc, 6.4 g/cc, 6.6 g/cc, 6.8 g/cc, 7.0 g/cc, 7.2 g/cc, 7.4 g/cc, 7.6 g/cc, 7.8 g/cc, 8.0 g/cc, 8.2 g/cc, 8.4 g/cc, 8.6 g/cc, or 8.7 g/cc. In embodiments where the faceplate 155 is a steel-based material, the density of the faceplate material can range between 7.7 g/cc and 8.1 g/cc.

4) Tip Weight Material

The tip weight 160 can comprise a material that is different over the material of the body 110, faceplate 155, and the insert 140 or 440. The tip weight 160 comprises a high-density material, such as tungsten or any other suitable metal or metal alloy material. The density of the tip material 160 can range between 1.1 g/cc and 19.6 g/cc. In some embodiments, the density of the tip weight 160 material can be 1.1 g/cc, 1.5 g/cc, 2.0 g/cc, 2.5 g/cc, 3.0 g/cc, 3.5 g/cc, 4.0 g/cc, 4.5 g/cc, 5.0 g/cc, 5.5 g/cc, 6.0 g/cc, 6.5 g/cc, 7.0 g/cc, 7.5 g/cc, 8.0 g/cc, 8.5 g/cc, 9.0 g/cc, 9.5 g/cc, 10.0 g/cc, 10.5 g/cc, 11.0 g/cc, 11.5 g/cc, 12.0 g/cc, 12.5 g/cc, 13.0 g/cc, 13.5 g/cc, 14.0 g/cc, 14.5 g/cc, 15.0 g/cc, 15.5 g/cc, 15.8 g/cc, 16.0 g/cc, 16.2 g/cc, 16.4 g/cc, 16.6 g/cc, 16.8 g/cc, 17.0 g/cc, 17.2 g/cc, 17.4 g/cc, 17.6 g/cc, 17.8 g/cc, 18.0 g/cc, 18.2 g/cc, 18.4 g/cc, 18.6 g/cc, 18.8 g/cc, 19.0 g/cc, 19.2 g/cc, 19.4 g/cc, or 19.6 g/cc. The weight of the tip weight 160 can range between 0 grams and 18 grams. In some embodiments, the weight of the tip weight 160 can be 0 grams (in the embodiment where there is no tip weight), 1 grams, 2 grams, 3 grams, 4 grams, 5 grams, 6 grams, 7 grams, 8 grams, 9 grams, 10 grams, 11 grams, 12 grams, 13 grams, 14 grams, 15 grams, 16 grams, 17 grams, or 18 grams. In most embodiments, the tip weight 160 ranges between 0 grams and 9 grams.

5) Toe Weight Material

The toe weight 161 can comprise a material that is different over the material of the body 110, faceplate 155, the tip weight 160, and the insert 140 or 440. The toe weight 161 comprises a high-density material, such as tungsten or any other suitable metal or metal alloy material. The density of the toe weight 161 material can range between 14.0 and 19.6 g/cc. In some embodiments, the density of the toe weight 161 material can be 14.0 g/cc, 14.2 g/cc, 14.4 g/cc, 14.6 g/cc, 14.8 g/cc, 15.0 g/cc, 15.2 g/cc, 15.4 g/cc, 15.6 g/cc, 15.8 g/cc, 16.0 g/cc, 16.2 g/cc, 16.4 g/cc, 16.6 g/cc, 16.8 g/cc, 17.0 g/cc, 17.2 g/cc, 17.4 g/cc, 17.6 g/cc, 17.8 g/cc, 18.0 g/cc, 18.2 g/cc, 18.4 g/cc, 18.6 g/cc, 18.8 g/cc, 19.0 g/cc, 19.2 g/cc, 19.4 g/cc, or 19.6 g/cc. The weight of the toe weight 161 can range between 10 grams and 40 grams. In some embodiments, the weight of the toe weight 161 can be 10 grams, 11 grams, 12 grams, 13 grams, 14 grams, 15 grams, 16 grams, 17 grams, 18 grams, 19 grams, 20 grams, 21 grams, 22 grams, 23 grams, 24 grams, 25 grams, 26 grams, 27 grams, 28 grams, 29 grams, 30 grams, 31 grams, 32 grams, 33 grams, 34 grams, 35 grams, 36 grams, 37 grams, 38 grams, 39 grams, and 40 grams. In some embodiments, the weight of the toe weight 161 can range between 12 grams and 26.5 grams.

6) Toe Screw Weight Material

The toe screw weight (swing weight) can comprise any high-density material similar to the high-density materials of the tip weight or the toe weight. The density of the toe screw material can be similar to the density of the tip weight materials. The weight of the toe screw weight can be similar to the weight of the tip weight, described above.

II. GOLF CLUB HEAD WITH REAR OPENING

Described herein is a golf club head 600. Like golf club head 100, golf club head 600 can be a tour style golf club head with forgiveness as discussed above. The golf club head 100 can comprises a body 610 having a cavity 620 that houses an insert 640. The golf club head 600 comprises a faceplate 655, a body 610, and an insert 640. The body 610 comprises an upper portion 608, a lower portion 609, a sole 607, a rear 603, and a top rail 606. The rear 603 can further comprise an inflection seam 630. The inflection seam 630 is the boundary between the upper portion 608 and lower portion 609 of the golf club head 600. The faceplate 655 and a portion of the body define a strikeface 611 (striking surface) of the golf club head. The faceplate 655, the sole 607, the rear 603, and the top rail 606 enclose a cavity 620.

FIGS. 21-32 depict a golf club head 600 similar to golf club head 100. The golf club head 600 comprises a body 610 forming a cavity 620, a faceplate 655, a rear opening 680 and a low-density insert 640 in the cavity. The body 610 comprises an upper portion 608, a lower portion 609, a sole 607, a rear 603, and a top rail 606. The rear 603 can further comprise an inflection seam 630. The inflection seam 630 is the boundary between the upper portion 608 and lower portion 609 of the golf club head 600. The faceplate 655 and a portion of the body 610 define a strikeface 611 (striking surface) of the golf club head 600.

The body 610 is similar to body 110. The faceplate 655, the sole 607, and the rear 603 form a cavity 620 with a rear opening 680 in the upper portion 608 of the golf club head 600. The rear opening 680 of the body 610 partially exposes the cavity 620. After assembly, the insert 640 is visible through the opening 680 in the rear 603. The body 610 further comprises an indentation 642 in the front 604 of the body 610 for receiving the faceplate 655 similar to the indentation 142 described above for club head 100.

The insert 640 harbors within the cavity 620. The insert 640 can comprise a non-metal or polymer based material. The insert material can be injected into the cavity 620 of the golf club head 600 through the rear opening 680 to form the insert 640 within the cavity 620. In other embodiments, the insert 640 can comprise a metal material, similar to the insert 140 described above. The faceplate 655 encloses the cavity 620 at a front 604 of the golf club head 600. The faceplate 655 and a front 604 of the body 610 together define a strikeface 611.

The golf club head 600 is a tour iron club head, and has a volume between 1.8 cubic inches and 2.7 cubic inches (30 cubic centimeters (cc) and 45 cc). The body 610 of the golf club head 600 can be cast or forged from a metal material.

The insert 640 comprises a low-density material and fills the cavity 620 formed by the body 610 of the golf club head 600. Reducing mass in the center of the golf club head 600 allows extra mass to be concentrated at its perimeter to increase moment of inertia values of the golf club head 600. As discussed above, the golf club head 600 comprises a lower portion 609 and an upper portion 608. The lower portion 609 comprises a depth greater than the upper portion 608. The lower portion 609 thereby has more mass concentrated on the peripheral heel 602, toe 601, and the sole 607. Lowering the mass of the body 610 results in a low CG 60, which increases launch angle, reduces spin, and increases ball speed. As introduced above, there is a need in the art for an iron that couples tour iron sizing with a comparatively high moment of inertia from perimeter weighting and a low CG from low positioning of mass. In some embodiments, a tip weight 660 positioned in the hosel and/or a toe weight 661 positioned in a toe cavity 614 of the body 610 provide additional perimeter weighting. In some embodiments, a toe screw weight 662 (swing weight) positioned in a toe screw weight cavity 663 (swing weight cavity) of the body 610 provides additional perimeter weighting.

The golf club head 600 can be described with the same reference planes and axes as golf club head 100. The definitions of the ground plane 10, loft plane 20, centerplane 45, centerpoint 80, lead edge axis 35, lead edge plane, x-axis 30, y-axis 40, z-axis 50, and hosel axis 70 remain the same for golf club head 600 as for golf club head 100.

A. Parts of the Golf Club Head

As discussed above and illustrated in FIGS. 22 and 23, the body 610 comprises at least an upper portion 608, a lower portion 609, a sole 607, a top rail 606, a rear 603, a front 604, a toe 601, a heel 602, and a hosel 605 respectively similar to the upper portion 108, the lower portion 109, sole 107, top rail 106, rear 103, front 104, toe 101, heel 102, and hosel 605 of golf club head 100. In some embodiments, the faceplate 655 that is welded or swedged (swagged) over the front opening of the body 610.

The body 610 comprises an inflection seam 630 and rear contours similar to the inflection seam 130 and rear contours of golf club head 100. The heights of the upper and lower portions 608, 609, the depths of the upper and lower portions 608, 609, and the thickness of the rear 603 are similar to the heights of the upper and lower portions 108, 109, the depths of the upper and lower portions 108, 109, and the thickness of the rear 103 of golf club head 100.

The body 610 further comprises an opening wall 682 in the rear of the body 610. The opening wall 682 defines the rear opening 680. The rear opening 680 of the body 610 is located in upper portion 608 of the club head 600, which is above the inflection seam 630. The uniform depth of the upper portion 608 in conjunction with the location of the rear opening 680 fully in the upper portion 608 allows for a flat surface surrounding the opening 680. On all sides of the opening wall 682 of the body 610 (the rear opening 680), an exterior surface of the golf club head 600 is planar. This planar surface is necessary to provide a seal around the rear opening 680 during injection of the insert material into the cavity 620 during manufacturing, as described further below.

To identify the size of the rear opening 680, a projected area can be taken of the rear 603 (not including the hosel 605 or the sole 607), parallel to the loft plane 20. The projected area of the rear 603 can be compared to the projected area circumscribed by the opening wall 682. The opening wall 682 circumscribes (the rear opening covers) an area between 25% and 50% of a projected area of a rear 603 of the club head 600. In some embodiments, the opening wall 682 can circumscribe a percent of the rear area between 25% and 30%, 25% and 35%, 30% and 40%, 35% and 45%, 40% and 50%, or 45% and 50%. In other embodiments, the opening wall 682 can circumscribe a percent of the rear area of 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49%, or 50%.

In some embodiments, the insert 640 is visible through the rear opening 680. In some embodiments, between 10% and 60% of the insert can be visible through the rear opening 680. In some embodiments, between 10% and 20%, 15% and 25%, 20% and 30%, 25% and 35%, 30% and 40%, 35% and 45%, 40% and 50%, 45% and 55%, or 50% and 60% of the insert 640 can be visible through the rear opening 680. In some embodiments, a badge, not shown, is placed over the rear opening 680. In these embodiments, the badge can cover between 10% and 60% of the insert. In some embodiments, the badge can cover between 10% and 20%, 15% and 25%, 20% and 30%, 25% and 35%, 30% and 40%, 35% and 45%, 40% and 50%, 45% and 55%, or 50% and 60% of the insert 640.

The rear 603 with an opening wall 682 defining a rear opening 680 contributes to a low mass of the upper portion 608. Filling the rear opening 680 with a material having a density lower than the density of the body material results in a golf club head 600 having a low CG. Reducing the mass of the upper portion 608 both lowers CG and allows weight to be distributed to the perimeter to improve the golf club head's forgiveness. Various design parameters can contribute to a low mass of the upper portion. As described above for golf club head 100, the keeping a uniform upper portion depth also contributes to a low mass of the upper portion 608.

Since the material used to form the body 610 generally has a higher density than the material of the insert 640, the mass of the upper portion 608 can be reduced by replacing the portion of the rear body 610 circumscribed by the opening wall 682 with insert material. When compared to a similar golf club head having a solid rear formed fully from a body material, the golf club head 600 comprises a lower CG because of the rear opening 680. The percent projected area of the opening 680 and the density of the insert material can reduce the mass of the upper portion 608 by between 1 gram and 17 grams. In some embodiments, the mass of the upper portion 608 can be reduced by between 1 gram and 3 grams, 3 grams and 5 grams, 5 grams and 7 grams, 7 grams and 9 grams, 9 grams and 11 grams, 11 grams and 13 grams, 13 grams and 15 grams, or 15 grams and 17 grams. In other embodiments, the mass of the upper portion 608 can be reduced by 1 gram, 2 grams, 3 grams, 4 grams 5 grams, 6 grams, 7 grams, 8 grams, 9 grams, 10 grams, 11 grams, 12 grams, 13 grams, 14 grams, 15 grams, 16 grams, or 17 grams. This reduction in the mass of the upper portion 108 of the body 610 assists in lowering the CG, improving launch and spin characteristics and increasing ball speed.

The body 610 of the golf club head 600 defines the cavity 620. The cavity 620 of the body 610 can be configured to receive a low-density insert 640 that increases the MOI of the golf club head 600 without sacrificing the desirable solid feel of a tour iron. The regions, volumes, and contours of the cavity 620 are similar to the regions, volumes, and contours of cavity 120. Adjacent a front opening of the cavity 620, the body 610 comprises an internal peripheral edge 627, similar to the internal peripheral edge 127 of golf club head 100. The sole 607, the top rail 606, the rear 603, the internal peripheral edge 627, and the faceplate 655 define the cavity 620. The cavity 620 both connects to the rear opening 680 of the body 610 and is enclosed at the front 604 of the body 610 by the faceplate 655. The cavity 620 is exposed through the rear opening 680 of the rear 603 of the body 610.

B. Insert of the Golf Club Head

The insert 640 is configured to fit within the cavity 620 of the body 610 in order to increase the MOI and retain the solid feel of the golf club head 600. The volume of the insert 640 can be similar to the volume of the insert 140 of golf club head 100. In some embodiments, the volume of the insert 640 can be greater than the volume of the cavity 620 because the insert 640 extends beyond the cavity 620 into the rear opening 680.

Figure 26:
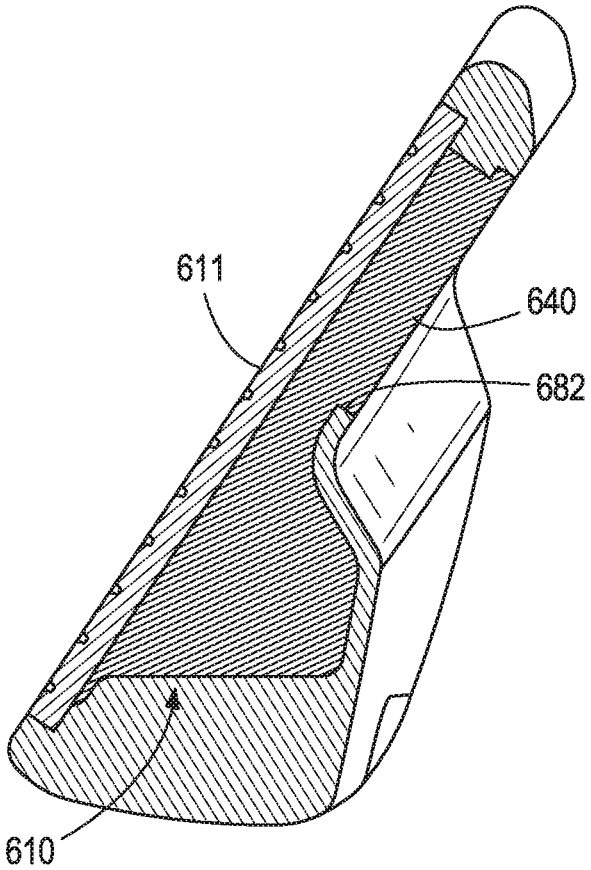
FIG. 26 shows a cross-sectional heel-side view of the golf club head of FIG. 21, along the line XVI-XVI in FIG. 22.
Figure 27:
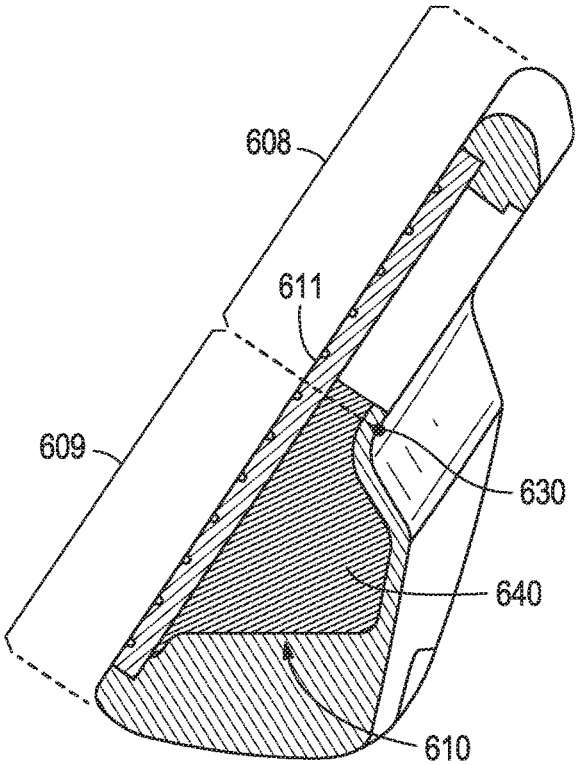
FIG. 27 shows a cross-sectional heel-side view of the golf club head of FIG. 21, along the line XVI-XVI in FIG. 22, according to a first embodiment with a partial-fill insert.
Figure 28:
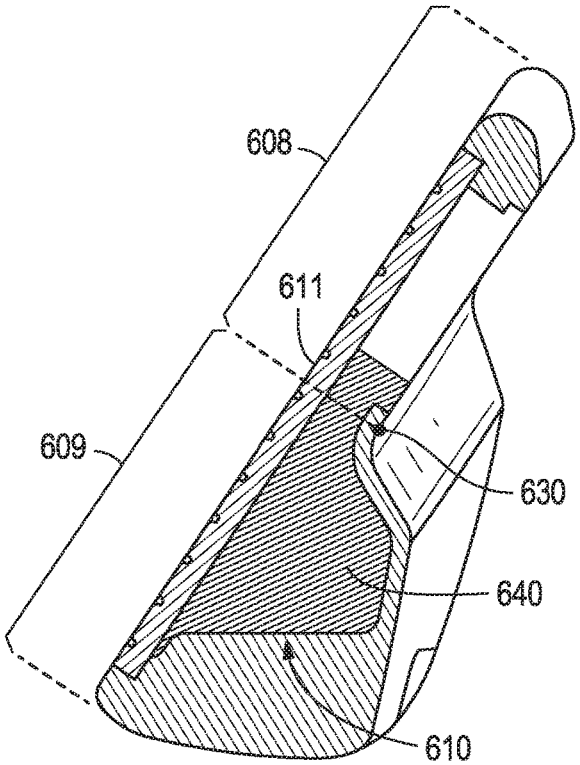
FIG. 28 shows a cross-sectional heel-side view of the golf club head of FIG. 21, along the line XVI-XVI in FIG. 22, according to a second embodiment with a partial-fill insert.
Figure 29:
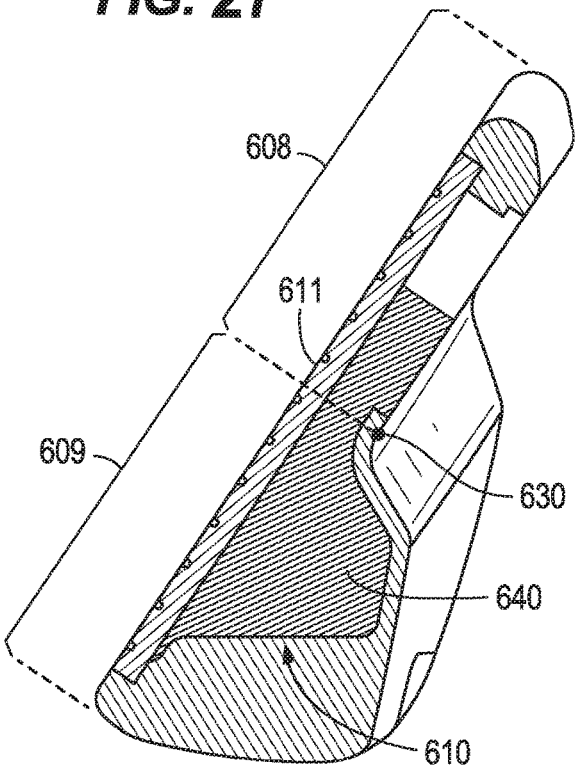
FIG. 29 shows a cross-sectional heel-side view of the golf club head of FIG. 21, along the line XVI-XVI in FIG. 22, according to a third embodiment with a partial-fill insert.
Figure 30:
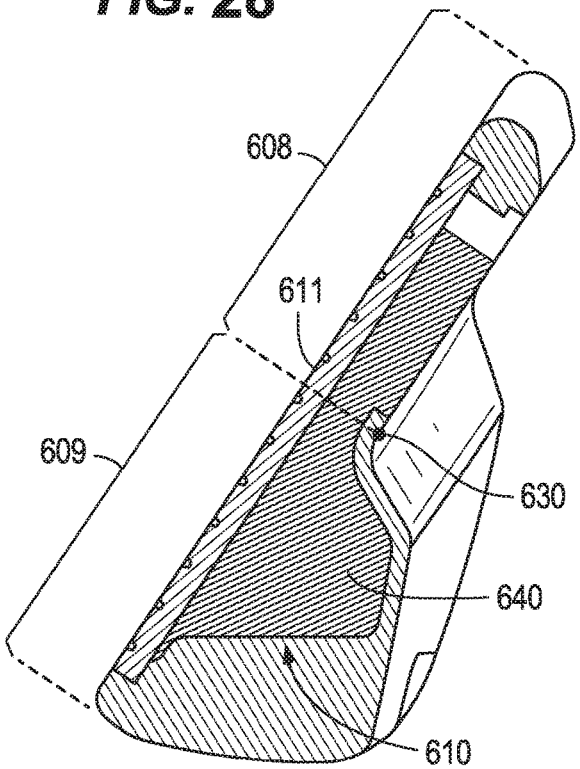
FIG. 30 shows a cross-sectional heel-side view of the golf club head of FIG. 21, along the line XVI-XVI in FIG. 22, according to a fourth embodiment with a partial-fill insert.

The insert 640 completely fills or partially fill the cavity 620, as described above for golf club head 100. The insert 640 can fill a percent volume of the cavity 620, as described for golf club head 100. In some embodiments, as illustrated in FIG. 26, the insert 640 can fill 100% of the cavity 620 and extend into the rear opening 680. As illustrated in FIG. 27, the insert 640 can fill 60% of the cavity 620. As illustrated in FIG. 28, the insert 640 can fill 70% of the cavity 620 and extend partially into the rear opening 680. As illustrated in FIG. 29, the insert 640 can fill 80% of the cavity 620 and extend partially into the rear opening 680. As illustrated in FIG. 30, the insert 640 can fill 90% of the cavity 620 and extend partially into the rear opening 680. In some embodiments, not shown, the insert 640 can fill only the cavity 620 and not fill the rear opening 680. In some embodiments, the insert 640 can comprise a metal material and fill only the cavity 620. In this example embodiment, not shown, the opening wall 682 of the body 610 can taper to blend into the insert 640, providing a less distinct boundary for the rear opening 680.

In some embodiments, the insert 640 is formed prior to insertion into golf club head 600, as described below. In other embodiments, the insert 640 is formed within the cavity 620 of the body 610. In these embodiments, the opening wall 682 that forms the rear opening 680 can serve as a port for the insert 640 to be injected into the cavity 620, as described below.

C. Cavity of the Body

A front surface of the body cavity 620 can be enclosed by the faceplate 655. The faceplate 655 and the strikeface 611 can be similar to the faceplate 155 and strikeface 611 of golf club head 100. However, in some embodiments, the strikeface 611 can be integrally formed with the body 610. The strikeface 611 comprises a thickness 612 similar to the thickness 112 of strikeface 111 of golf club head 100.

The body 610 is partially or fully filled by the insert 640, which is secured within the golf club head 600 by the faceplate 655. In some embodiments, the cavity 620 further houses a tape layer 150 and/or adhesive, similar to the tape layer 150 and/or adhesive of golf club head 100.

Figure 31:
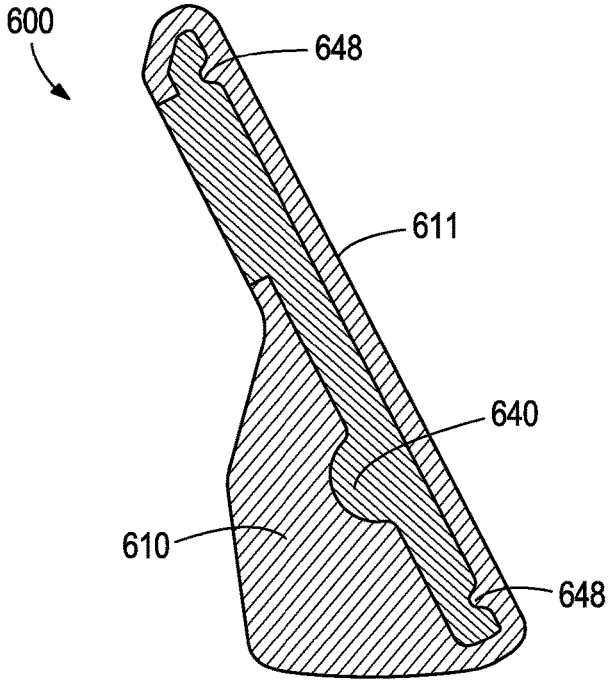
FIG. 31 shows a variation of the golf club head of FIG. 22, with the rear enclosed.
Figure 32:
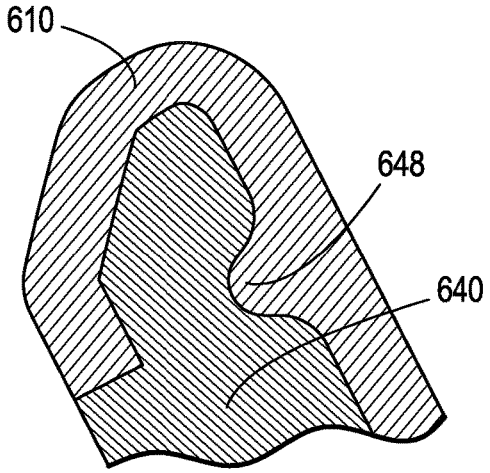
FIG. 32 shows a variation of the golf club head of FIG. 22, with the rear enclosed and a securing feature.

The cavity 620 can change dimensions in a toe-to-heel direction. In some embodiments, the rear 603 of the golf club head 600 comprises a thick region, as illustrated in FIG. 31. This thick region of the body 610 can provide extra weighting to a specific region of the golf club head 600. Furthermore, as illustrated in FIGS. 31 and 32, a weld bead 648, protrusion, dimple, or seam (hereafter collectively referred to as "weld bead") can interrupt the cavity 620. The weld bead can be located along a peripheral edge of the faceplate 655. In some embodiments, the weld bead 648 is produced during the manufacturing step of welding the faceplate 655 onto the body 610 to form the strikeface 611. As illustrated in FIGS. 31 and 32, the weld bead 648 can extend backwards from a rear surface of the strikeface 611. In some embodiments, the weld bead 648 not only structurally bonds the strikeplate 655 to the body 610, but also assists in holding the insert 640 within the cavity 620. The weld bead 648 can be a locking geometry. The weld bead 648 can cordon off a peripheral region of the cavity 620 that has a front to rear depth that is greater that the front to rear depth of the cavity at the weld bead. This change in depth of the cavity 620 caused by the weld bead 648 enables the insert to have a thicker or deeper (front to rear) dimension adjacent the top rail 606 and the sole 607 than at the weld bead 648, preventing the insert from sliding, moving, or dislodging in a top to sole direction.

F. Other Peripheral Weights (Tip Weights, Toe Weights) in the Golf Club Head

In some embodiments, the golf club head 600 further comprises a shaft tip weight 660, similar to the shaft tip weight 160 of golf club head 100. In some embodiments, the body 610 further comprises a toe cavity 614 housing a toe weight 661, similar to the toe cavity 114 and toe weight 161 of golf club head 100.

Figure 24:
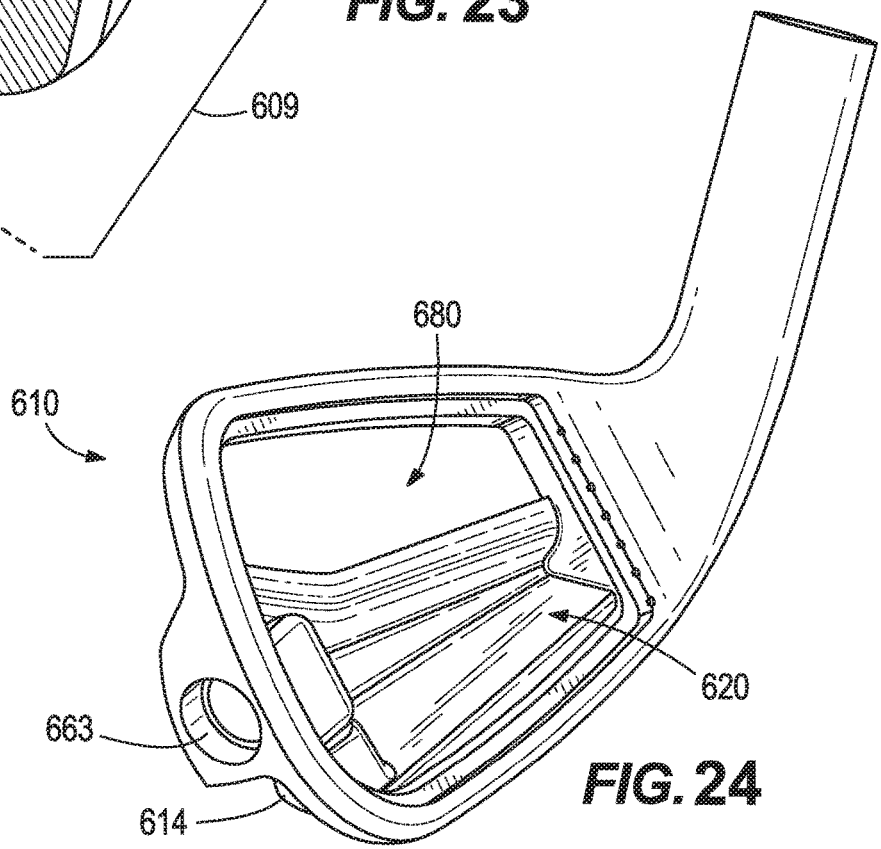
FIG. 24 shows a front perspective view of the body of the golf club head of FIG. 21.
Figure 25:
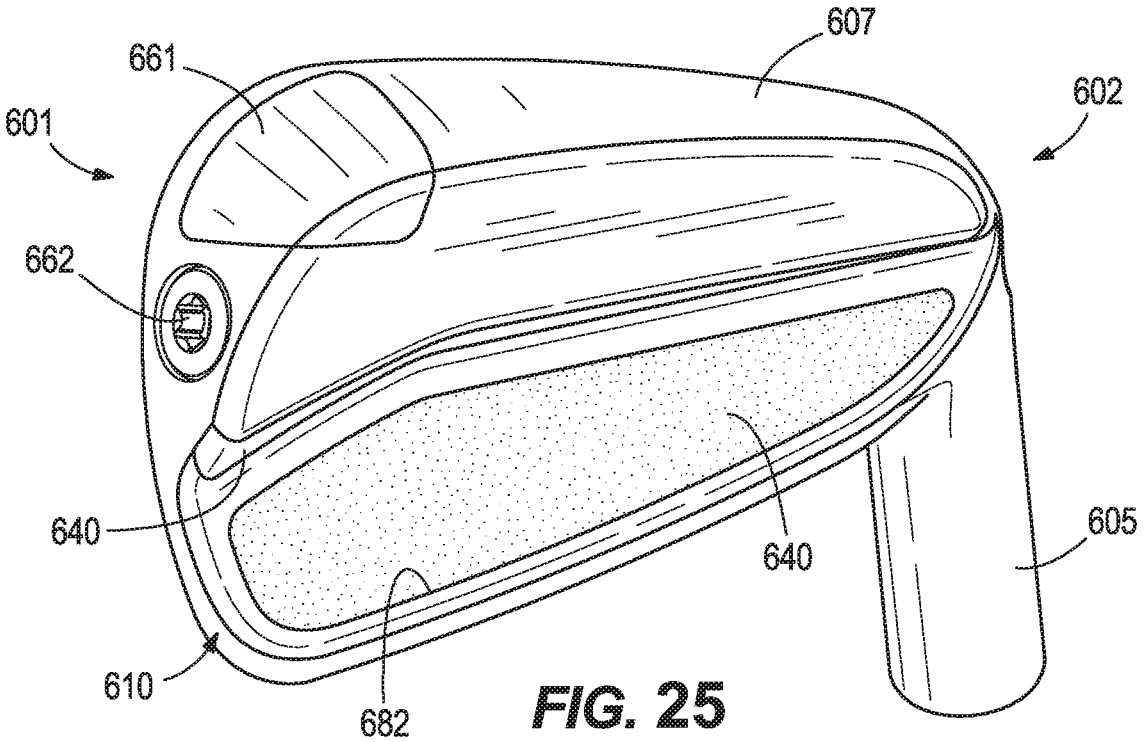
FIG. 25 shows a rear perspective view of the golf club head of FIG. 21.

As depicted in FIGS. 24 and 25, the golf club head 600 can further comprise a toe screw cavity 663 and a toe screw weight 662 for adjusting swing weighting. The toe screw weight 662 can comprise a weight between 2 grams and 15 grams, as described for the optional toe screw weight of golf club head 100. The toe screw weight 662 can be removed and replaced with a different screw weight 662 having a different weight value to customize the golf club head 600 to a golfer's swing.

Figure 33:
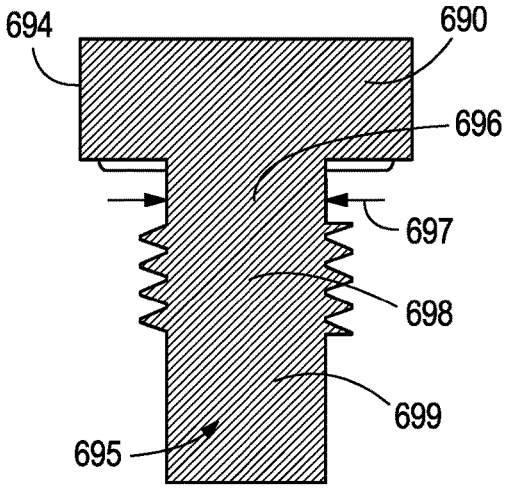
FIG. 33 shows a side view of a toe screw weight, according to an embodiment.
Figure 34:
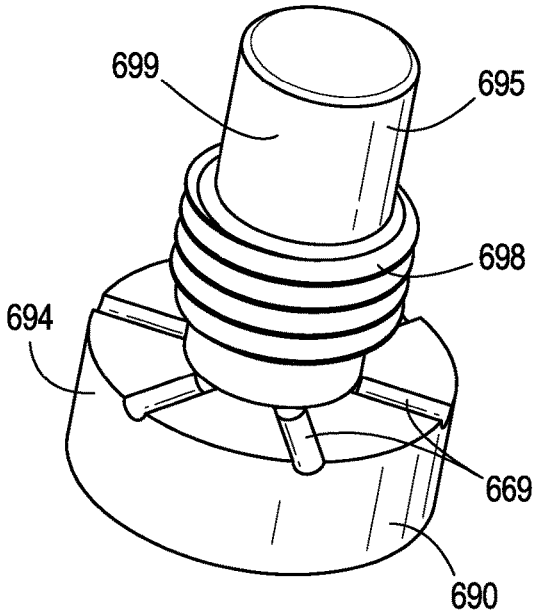
FIG. 34 shows a perspective view of the toe screw weight of FIG. 33.

As illustrated in FIGS. 33 and 34, the toe screw weight 662 of the golf club head 600 can comprise a head 690 and a shaft 695. The head 690 can comprise an outer surface 691, an inner surface 692, and an outer rim 694. The shaft 695 extrudes outward from the head inner surface 692. The head inner surface 692 further comprises slots 396 extending radially outward from the shaft 695. The slots 693 can allow air to vent from the body cavity 620 during manufacturing. The slots 693 can be oriented roughly perpendicular to the outer rim 694 of the toe screw weight head 690 (or perpendicular to a plane that is tangent to the outer rim 694 of the toe screw weight head 690). The slots 693 can be radially spaced from each other by angles of approximately 180 degrees, 120 degrees, 90 degrees, 72 degrees, 60 degrees, 51 degrees, 45 degrees, between 10 and 45 degrees, between 45 and 90 degrees, between 90 and 180 degrees, between 180 and 270 degrees, or between 270 and 360 degrees.

The toe screw weight 662 can comprise one, two, three, four, five, six, seven, eight, or more slots 693. The slots 693 can each comprise a depth. The depth of each slot 693 can range between 0.002 inch and 0.010 inch. In some embodiments, the depth of each slot 693 can range between 0.002 inch and 0.004 inch, 0.003 inch and 0.005 inch, 0.004 inch and 0.006 inch, 0.005 inch and 0.007 inch, 0.006 inch and 0.008 inch, 0.007 inch and 0.009 inch, or 0.008 inch and 0.010 inch. The depth of the slots 693 can affect the speed that air can flow through the slots 693. The slots 693 cut or formed into the head of the toe screw weight 662 prevent the toe screw weight 662 from sealing the toe screw cavity 663 airtight when the toe screw weight 662 is received in the toe screw cavity 663. The slots 693 allow air to move in or out of the body cavity 620 even when the toe screw weight 662 is installed in the toe screw cavity 663. The slots 693 can allow air to vent from the body cavity 620 during the injection of the insert material 140 into the body cavity 620 during manufacturing. In embodiments having a low-viscosity insert, the depth of the slots 693 can also prevent the insert material from flowing or escaping through the slots 693 during manufacturing.

The toe screw weight shaft 695 can comprise a neck 696, a threaded portion 698, and an unthreaded portion 699. The neck 696 can be located between the threaded portion 698 of the shaft 695 and the toe screw weight head 690. The neck 696 can comprise a diameter 697 that is less than the diameter of a corresponding region of the toe screw cavity 663. The neck diameter 697 can be between 0.005 inch and 0.015 inch smaller than the diameter of the corresponding region of the toe screw cavity 663. In some embodiments, the corresponding region of the toe screw cavity 663 has a diameter less than the neck diameter 697 by between 0.005 inch and 0.008 inch, 0.007 inch and 0.010 inch, 0.009 inch and 0.012 inch, or 0.011 inch and 0.015 inch.

The threaded portion 698 of the shaft 695 can be located adjacent to the neck 696 of the shaft 695, which is near the toe screw weight head 690. The threaded portion 698 can comprise between one and ten threads. In some embodiments, the threaded portion 698 can cover between one quarter to one half the length of the shaft 695. In other embodiments, the threaded portion 698 covers approximately one third the length of the shaft 695. The purpose of the threaded shaft portion 698 is to engage corresponding threads on the toe screw cavity 663 to hold the toe screw weight 662 onto the golf club head body 610. Additionally, the threaded shaft portion 698 can be offset from the toe screw cavity threads by a tolerance or gap. In some embodiments, the tolerance gap can provide enough space for air to pass between the toe screw weight 662 and the toe screw cavity 663 during the injection molding process of forming the insert. Furthermore, the tolerance gap between the toe screw weight threads and the toe screw cavity threads can prevent the insert material from flowing out of the cavity 620 during the manufacturing process. Despite the insert material coming into contact with the toe screw weight threaded portion 698, the toe screw weight can remain removable due to the different material properties of the metallic toe screw weight 662 and the insert 640.

Beyond the threaded portion 698, the remaining, unthreaded portion 699 of the shaft 695 can extend at least partially within the toe screw cavity 663. The unthreaded shaft portion 699 can comprise a diameter that is less than the diameter of a corresponding portion of the toe screw cavity 663 configured to receive the unthreaded shaft portion 699. In some embodiments, the unthreaded shaft portion 699 can extend at least partially into the body cavity 620 of the club head 600. The purpose of the shaft unthreaded portion 699 can be to add weight to the toe screw weight 662.

The toe screw weight shaft is configured with tolerances that allow air to pass between the toe screw weight 662 and the corresponding toe screw cavity 663. In embodiments of the golf club head 600 with injection-molded inserts, the threaded portion of the shaft of the toe screw weight 662 prevents the insert material from flowing out of the body cavity during the manufacturing process, as described below. The slots are also sized to prevent the insert material from escaping in the unlikely event that the insert material makes it past the threaded portion of the toe screw weight 662.

The slots, shaft diameters, and shaft threading of the toe screw weight 662, described above, allow the insert 620 to be injection molded without leaving flash (excess, unwanted material between metal portions of mold interface surfaces, including within vents), including around the mouth of an injection port, because the air can be vented through the toe screw weight 662. As described below, by venting the air through the toe screw weight 662, the need for post-injection molding machining for cleaning off flash can be eliminated or reduced.

Although the peripheral weights described above contribute to the perimeter weighting and high MOI of the club head, the perimeter body also plays a critical role in perimeter weighting. Shaping portions of the perimeter of the body to comprise more material can alter the weighting and increase MOI.

D. Materials of the Club Head Body with Rear Opening

The materials used to form the components of golf club head 600, can be similar to the materials used to form the components of golf club head 100, as described above. In particular, the body 610 can comprise the same body material as body 110. The insert 640 can comprise the same insert material as insert 140. The faceplate 655 can comprise the same faceplate material as faceplate 155. The toe weight 661, tip weight 660, and toe screw weight 662 can comprise the same materials as the toe weight 161, tip weight 160, and toe screw weight materials as golf club head 100.

III. GOLF CLUB HEAD WITH REAR AND FRONT OPENING

Described herein is a golf club head 300. Like golf club heads 100 and 600, golf club head 300 can be a tour style golf club head with forgiveness as discussed above. Referring to FIGS. 35-38, the golf club head 300 can comprise a body 310 having a cavity 320 that houses an insert 340. Unlike golf club heads 100 and 600, the golf club head 300 does not comprise a faceplate made of metal. The golf club head does comprise a body 310 and an insert 340. The insert 340 is exposed at a front of the golf club head 300 and serves as a strikeface (also called a "striking surface" or a "hitting surface") 311 for impacting a golf ball. The strikeface 311 formed by the insert can comprise grooves. The strikeface 311 can be flush with the front 304 of the body 310. The insert-material strikeface 311 can be configured to impact a golf ball. In some embodiments, the insert-material strikeface 311 can be formed from a polymer or composite material.

The body 310 comprises an upper portion 308, a lower portion 309, a sole 307, a rear 303, a front 304, a toe region 301, a heel region 302, and a top rail 306. The rear 303 can further comprise an inflection seam 330. The inflection seam 330 is the boundary between the upper portion 308 and lower portion 309 of the golf club head 300. The sole 307, the rear 303, and the top rail 306 enclose a cavity 320.

FIGS. 35-52 illustrate several variations of golf club head 300, which can be similar to golf club heads 100 and 600. Golf club head 300 comprises a body 310 forming a cavity 320. The body 310 defines a rear opening 380 in the upper portion 308. The rear opening 380 at least partially exposes the cavity 320. The body 310 further defines a front opening or indention 342. The front opening at least partially exposes (and/or is connected to) the cavity 320. The front opening can be sized to cover a majority of the strikeface 311. After assembly, the insert 340 is visible through the rear opening 380 and the front opening 342.

The insert 340 harbors within the cavity 320. The insert 340 can comprise a non-metal or polymer-based material. The insert 340 can comprise a low-density material. The insert material can be injected into the cavity 320 of the golf club head 300 through the rear opening 380 or the front opening 342 to form the insert 340 within the cavity 320. In other embodiments, the insert 340 comprises a metal material, similar to the insert 140 described above. The insert 340 extends fully through from the front 304 to the rear 303 of the golf club head 300.

In some embodiments, the golf club head 300 can be a tour or game-improvement iron club head, and can have a volume between 1.8 cubic inches and 2.7 cubic inches (30 cubic centimeters (cc) and 45 cc). The body 310 of the golf club head 300 can be cast or forged from a metal material. In some embodiments, the insert 340 can be injection molded into the cavity 320 of the body 310. The insert 340 can be formed from a polymer or composite material. In some embodiments, the golf club head 300 can be a game-improvement iron with a volume greater than the volume of a tour iron. In some embodiments, the golf club head 300 can be a game-improvement iron with a blade length greater than 2.7 inch and/or between 2.7 inch and 2.9 inch, between 2.8 inch and 2.9 inch.

The insert 340 comprises a low-density material, similar to the inserts of club heads 100 and 600. However, the insert 340 of golf club head 300 can increase the moment of inertia value of the golf club head even more than the inserts of golf club heads 100 and 600 because the insert 340 of golf club head 300 can displace more dense body material. In other words, the body 310 of golf club head 300 comprises less material than the bodies of golf club heads 100 and 600. Specifically, the golf club head 300 lacks a metallic faceplate. Instead, the low-density insert 340 of the golf club head 300 forms the strikeface 311 of the golf club head 300. Because a high-density faceplate is not used in golf club head 300, the mass of the body 310 can be greatly reduced. The saved weight can be redistributed as built-in discretionary weight or removable weights. By placing the saved weight around the periphery of the club head 300, the moment of inertia can be increased. The CG can also be lowered in a manner similar to that described for golf club heads 100 and 600.

In some embodiments, a tip weight 360 positioned in the hosel and/or a toe weight 361 positioned in a toe cavity 314 of the body 310 provide additional perimeter weighting. The tip and/or toe weight can comprise a density greater than the body material density and greater than the insert density. The body material can include, but is not limited to, a steel-based material or a steel alloy. The body material can comprise a density between 7.70 and 8.10 g/cc. The insert material can include, but is not limited to, a glass-filled elastomer, a stainless steel-filled elastomer, a tungsten-filled elastomer, a thermoplastic polyurethane (TPU), a thermoplastic elastomer (TPE), or any other elastomer matrix composite, a Kevlar® (aramid) fiber-reinforced polymer, a carbon-fiber reinforced polymer, or any suitable polymer matrix composite (in other words, any combination of a suitable resin and a suitable reinforcing fiber). In some embodiments, the insert material can comprise a density between 0.8 g/cc and 1.4 g/cc. In other embodiments, the insert material can comprise a density between 1.0 g/cc and 12.0 g/cc. The metallic body material and the polymeric or composite insert material can be similar to the materials described above for the body and the insert of golf club head 600.

In some embodiments, a toe screw weight 362 (swing weight) positioned in a toe screw weight cavity 363 (swing weight cavity) of the body 310 provides additional perimeter weighting. In some embodiments, the interior contours of the cavity 320 are altered to leave body material in locations that require additional weighting. In some embodiments, the rear 303 of the club head 300 comprises one or more weight ports for receiving removable weights. In some embodiments, the rear 303 of the club head can be configured to receive tungsten weights in the low toe region 301 or the low heel region 302. These weights can be co-molded, swedged (swagged), or welded onto the body.

The golf club head 300 can be described with the same reference planes and axes as golf club head 100. The definitions of the ground plane 10, loft plane 20, centerplane 45, centerpoint 80, lead edge axis 35, lead edge plane, x-axis 30, y-axis 40, z-axis 50, and hosel axis 70 remain the same for golf club head 300 as for golf club head 100.

E. Parts of the Golf Club Head

As discussed above and illustrated in FIGS. 28-31, the body 310 comprises at least an upper portion 308, a lower portion 309, a sole 307, a top rail 306, a rear 303, a front 304, a toe 301, a heel 302, and a hosel 305 respectively similar to the upper portion 108, the lower portion 109, sole 107, top rail 106, rear 103, front 104, toe 101, heel 102, and hosel 105 of golf club head 100.

The body 310 comprises an inflection seam 330 and rear contours similar to the inflection seam 130 and rear contours of golf club head 100. The heights of the upper and lower portions 308, 309, the depths of the upper and lower portions 308, 309, and the thickness of the rear 303 are similar to the heights of the upper and lower portions 108, 109, the depths of the upper and lower portions 108, 109, and the thickness of the rear 103 of golf club head 100.

The body 310 further comprises an opening wall 382, similar to the opening wall 682 of golf club head 600. The opening wall 382 defines the rear opening 380. The rear opening 380 location, size, and dimensions (including the projected area) can be similar to the rear opening 380 of golf club head 300. The CG location and weighting of the golf club head 300 can be affected in a manner similar to that described for golf club heads 100 and 600. However, the golf club head 300 can have a more extreme change in the CG location compared to a similar club lacking a low-density insert because the golf club head 300 has additional discretionary weight from the elimination of a metal strikeplate. The replacement of a metal strikeplate with a portion of the insert 340 frees up a large amount of weight that can be redistributed to peripheral edges of the golf club head 300 to lower the CG and/or increase the moment of inertia.

The golf club head 300 can be compared to a similar golf club head having a metal body that comprises a metal faceplate (that corresponds to the front opening 642 of golf club head 300) and a metal upper rear wall (covering an area that corresponds to the rear opening 380 of the golf club head 300). By replacing the metal body material that would otherwise occupy the rear opening 380 and the front opening 342, the insert 340 can reduce the mass of the upper portion 308 by between 1 gram and 70 grams. In some embodiments, the mass of the upper portion 308 can be reduced by between 1 gram and 10 grams, 10 grams and 20 grams, 20 grams and 30 grams, 30 grams and 40 grams, 40 grams and 50 grams, 50 grams and 60 grams, or 60 grams and 70 grams. This reduction in the mass of the upper portion 308 of the body 310 assists in lowering the CG, improving launch and spin characteristics and increasing ball speed.

Figure 36:
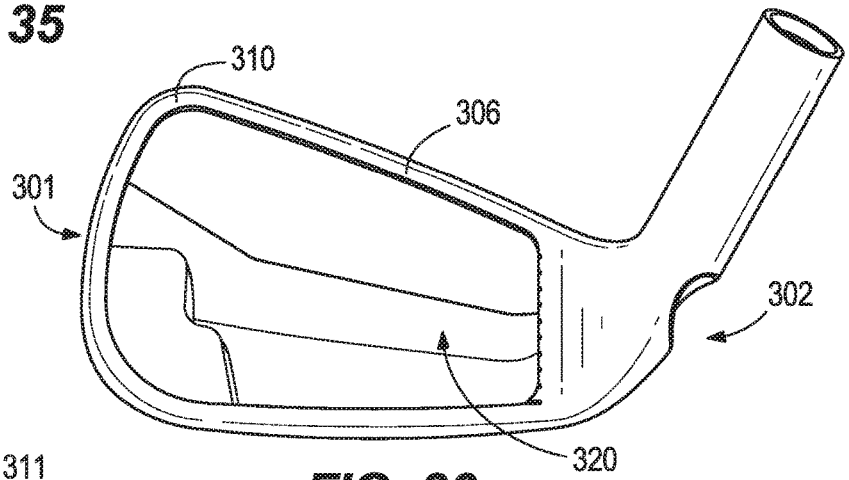
FIG. 36 shows a front view of the body of the golf club head of FIG. 35, without the insert.

As illustrated in FIG. 36, the body 310 of the golf club head 300 defines the cavity 320. The cavity 320 of the body 310 can be configured to receive a low-density insert 340. The regions, volumes, and contours of the cavity 320 are similar to the regions, volumes, and contours of cavity 120. The sole 307, the top rail 306, and the rear 303 define the cavity 320. The cavity 320 is exposed through the front opening 342 and the rear opening 380 of the body 310.

F. Insert of the Golf Club Head

Figure 37:
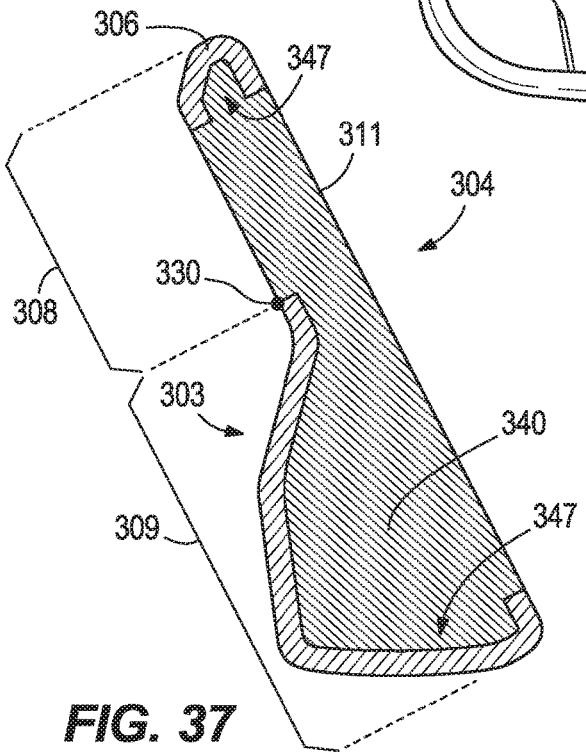
FIG. 37 shows a cross-sectional view of the golf club head of FIG. 35.

The insert 340 is configured to fit within the cavity 320 of the body 310 in order to increase the MOI and retain the solid feel of the golf club head 300. The volume of the insert 340 can be greater than the volume of the insert 140 of golf club head 100, since the insert 340 forms the strikeface as well as an internal, central insert. In some embodiments, the insert 340 completely fills the cavity 320, having the same volume as the cavity 320. As illustrated in FIG. 37, the insert 640 can be formed within the cavity 320 of the body 310. The rear opening 380 can serve as a port for the insert 340 to be injected into the cavity 320, as described below.

G. Cavity of the Body

Figure 35:
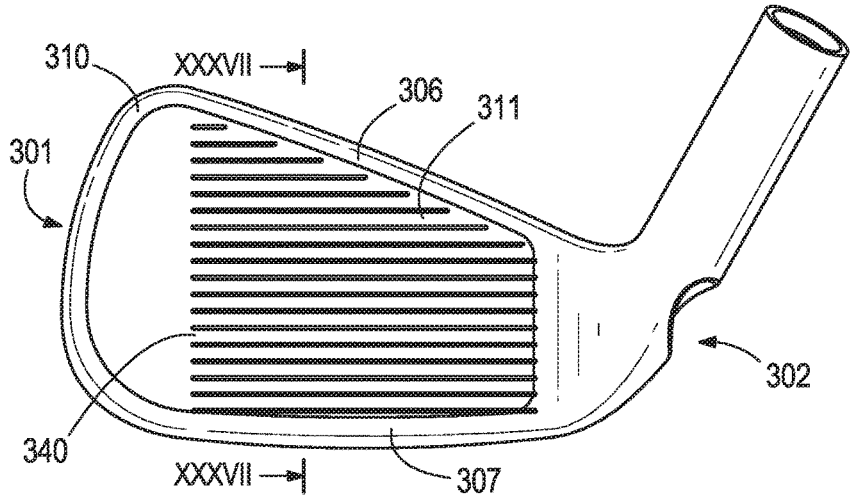
FIG. 35 shows a front view of a golf club head, according to an embodiment.

As illustrated in FIGS. 35 and 30, the body 310 of the golf club head 300 can define edges or walls of the cavity 320. As illustrated in FIGS. 39-45, in some embodiments, the body 310 further comprises one or more securing features 345, locking features, arches, tubes, or other features that interrupt the cavity space (hereafter referred to collectively as "securing features"). The securing features 345 can be located internally. The securing features 345 are not externally visible in the finished golf club head 300. The securing features 345 can geometrically secure the insert 340 into the cavity 320. The material of the insert 340 can flow around and subsequently harden around the one or more securing features 345, so that the insert 340 is permanently secured into the cavity 320. The securing features 345 can also add weight to specific regions of the golf club head 300.

The body 310 can comprise between one and six securing features 345. In some embodiments, the body 310 comprises one, two, three, four, five, or six securing features 345. The one or more securing features 354 can extend from one or more of the rear 303, the sole 307, the toe region 301, or the heel region 302. In some embodiments, the one or more securing features 345 extend between rear 303 and the sole 307. In some embodiments, one of the securing features 345 comprises a first and second end that both connect to the rest of the body 310 in the toe region 301. In some embodiments, one of the securing features 345 comprises a first and second end that both connect to the rest of the body 310 in the heel region 302. In some embodiments, one of the securing features 345 comprises a first and second end that both connect to the rest of the body 310 in the sole 307.

Figure 39:
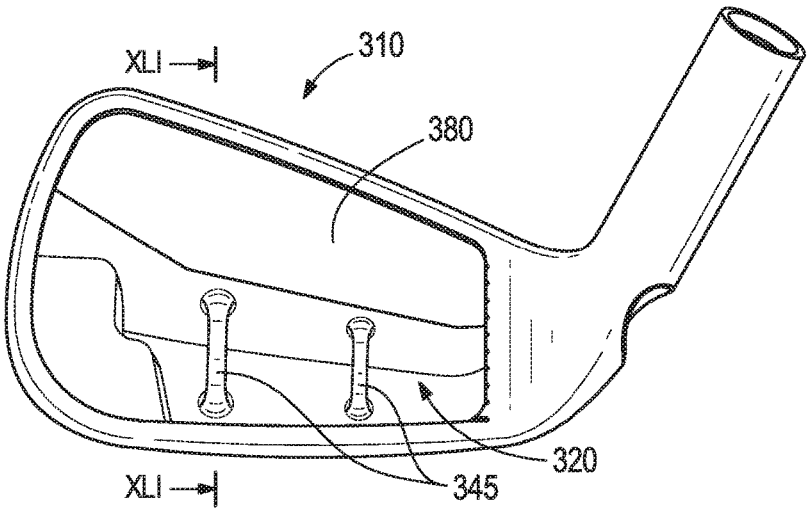
FIG. 39 shows a front view of the body of a golf club head, according to an embodiment that is similar to the golf club head of FIG. 35.
Figure 40:
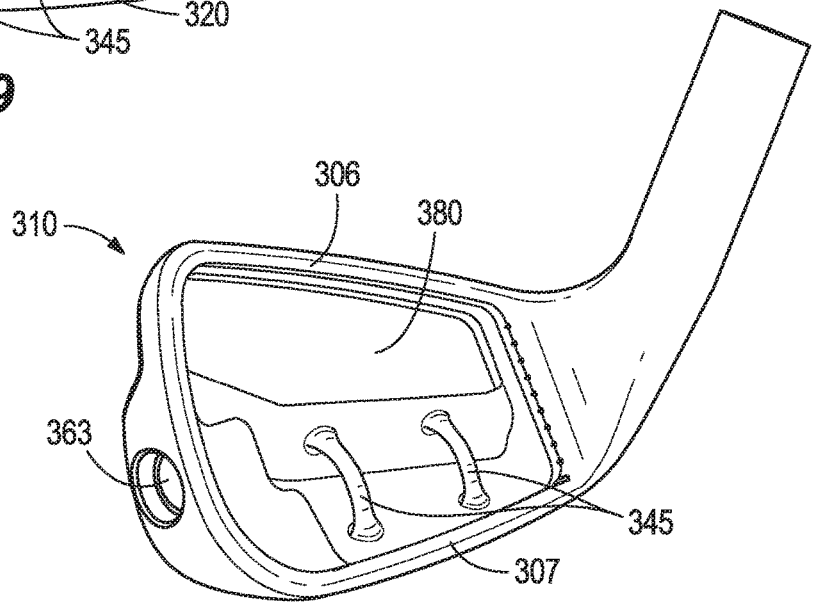
FIG. 40 shows a perspective view of the body of the golf club head of FIG. 39.
Figure 41:
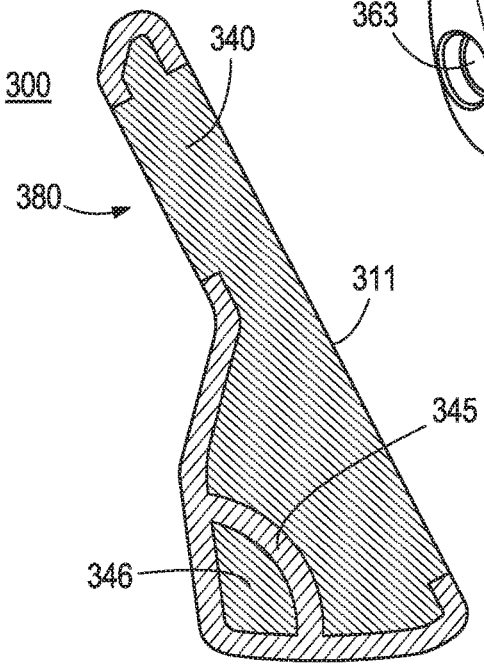
FIG. 41 shows a cross-sectional view of the golf club head of FIG. 39.
Figure 42:
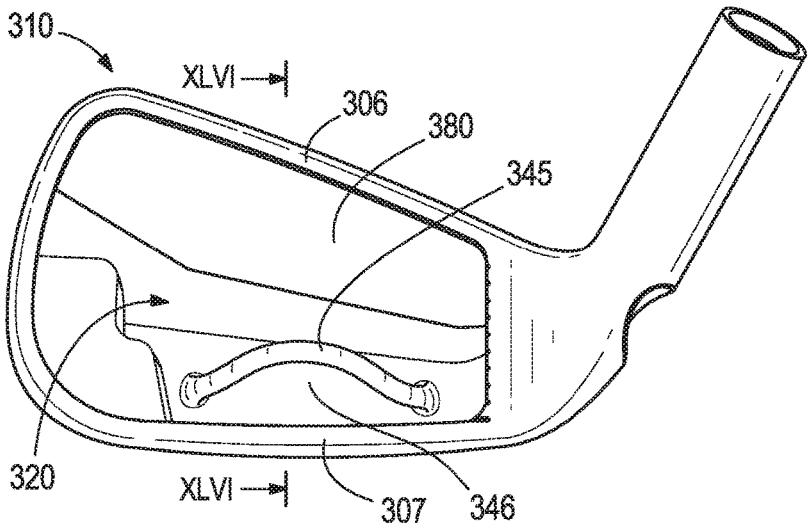
FIG. 42 shows a front view of the body of a golf club head, according to an embodiment that is similar to the golf club head of FIG. 35.
Figure 43:
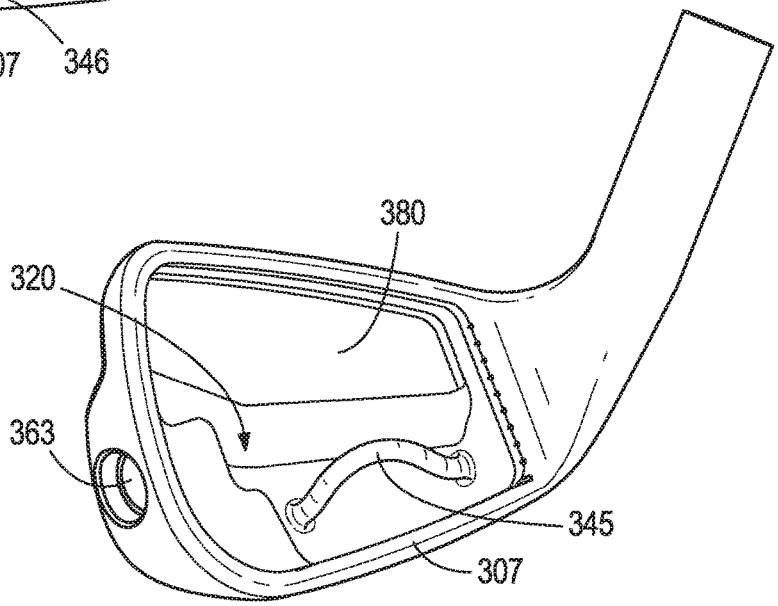
FIG. 43 shows a perspective view of the body of the golf club head of FIG. 42.
Figure 44:
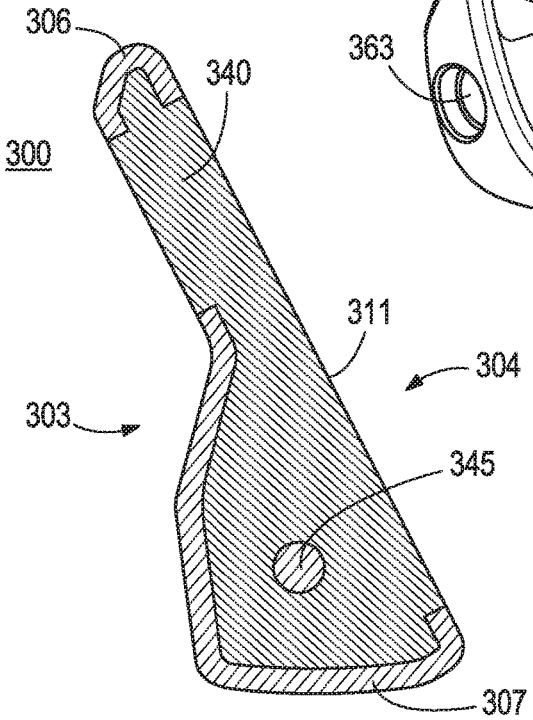
FIG. 44 shows a cross-sectional view of the golf club head of FIG. 42.
Figure 45:
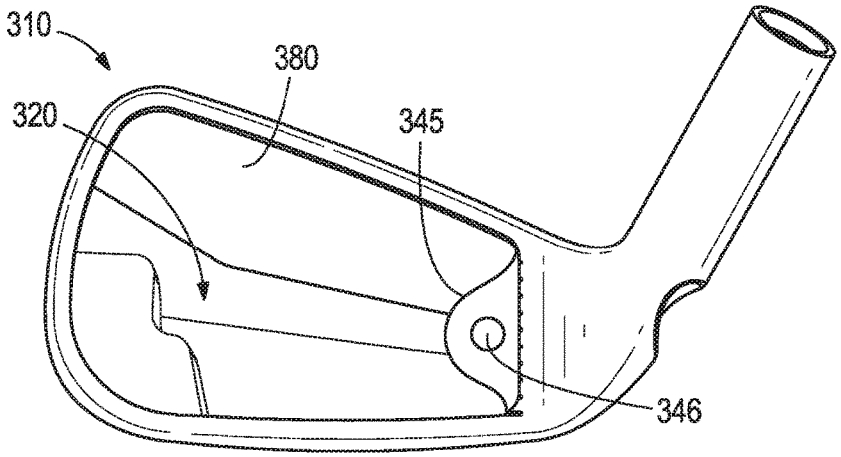
FIG. 45 shows a front view of the body of a golf club head, according to an embodiment that is similar to the golf club head of FIG. 35.
Figure 46:
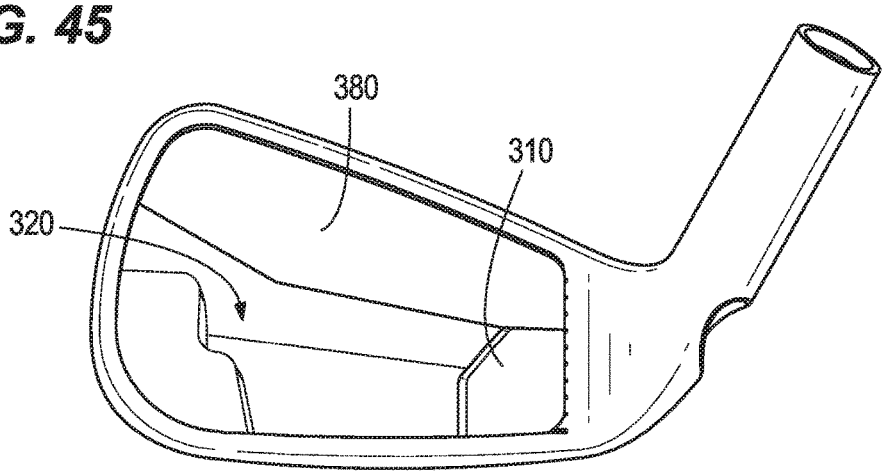
FIG. 46 shows a front view of the body of a golf club head, according to an embodiment that is similar to the golf club head of FIG. 35.
Figure 47:
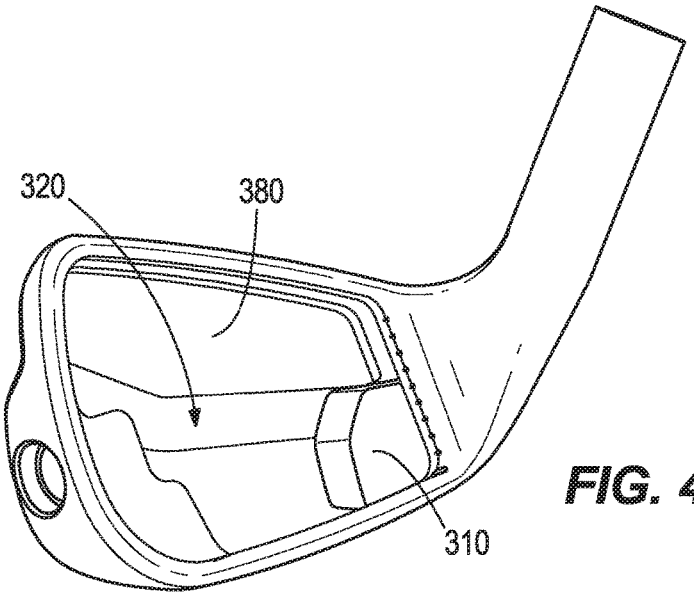
FIG. 47 shows a perspective view of the body of the golf club head of FIG. 46.

In the embodiment illustrated in FIGS. 39-41, the golf club head 300 comprises two securing features 345 extending from the rear 303 to the sole 307. In the embodiment illustrated in FIGS. 42-44, one securing feature 345 extends from a toe-ward end of the sole 307 to a heel-ward end of the sole 307. In the embodiment illustrated in FIG. 45, a single securing feature 345 (or arch) comprises a first and second end that both connect to the body 310 in the heel region 302. As illustrated in FIG. 45, the one or more securing features 345 can define a channel 346, opening, through-hole, or tube (hereafter collectively referred to as "the channel") that can be filled by the insert material. The channel 346 can have a minimum diameter of 0.065 inch. In some embodiments, the channel 346 can have a diameter between 0.065 and 0.075 inch, 0.070 inch and 0.080 inch, 0.075 and 0.085 inch, or 0.080 and 0.090 inch. In some embodiments, the channel 346 can have a diameter greater that 0.080 or greater than 0.090 inch. The diameter of the channel 346 under and/or surrounded by the securing feature allows the insert material to flow during the injection of the insert material into the cavity during manufacturing.

Figure 38:
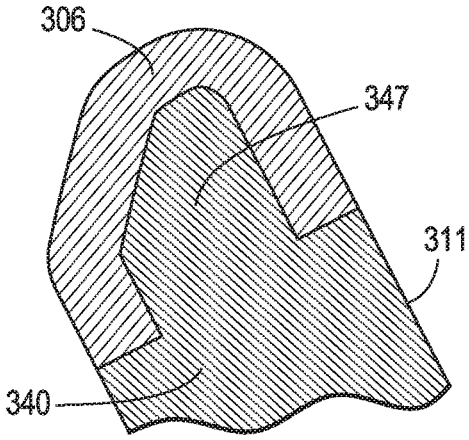
FIG. 38 shows a close-up view of the top rail shown in FIG. 37.

The one or more securing features 345 can comprise a cross-sectional shape that is circular, oval, ellipsoid, or any other shape configured to promote the flow of insert material around the securing feature. FIG. 44 illustrates a securing feature with a circular cross-section. In some embodiments, the cavity 620 further comprises an undercut within the top rail 306 and/or the sole 307. The undercuts 347 can help mechanically lock the insert 640 into the cavity 320. A golf club having a top rail 306 and sole 307 with undercuts 347 is illustrated in the embodiment of FIGS. 37 and 38.

Figure 51:
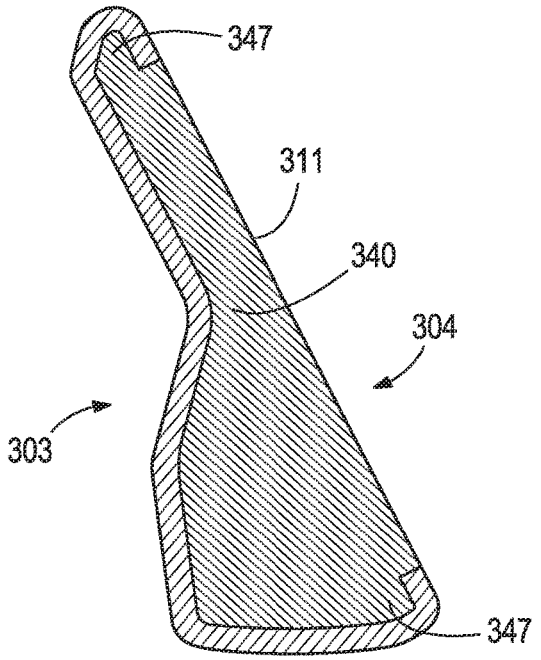
FIG. 51 shows a cross-sectional view of a golf club head, according to an embodiment.
Figure 52:
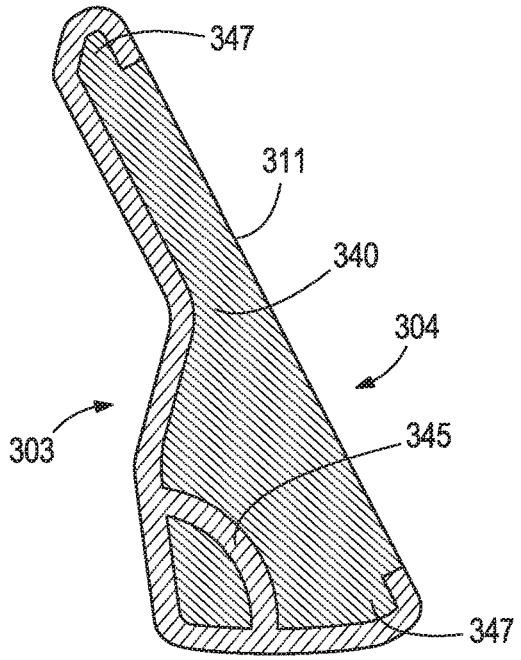
FIG. 52 shows a cross-sectional view of the golf club head of FIG. 51, including a securing feature.

Referring to FIGS. 51 and 52, in some variations of the golf club head 300, there is no rear opening 380. Instead, the body 310 covers the entire rear 303 of the club head 300. In these embodiments, the cavity 320 is exposed only at the front 304 of the club head 300. These embodiments can comprise one or more undercuts 347 and/or one or more securing features 345 to hold the insert 340 in the cavity 320.

H. Other Peripheral Weights (Tip Weights, Toe Weights) in the Golf Club Head

Figure 48:
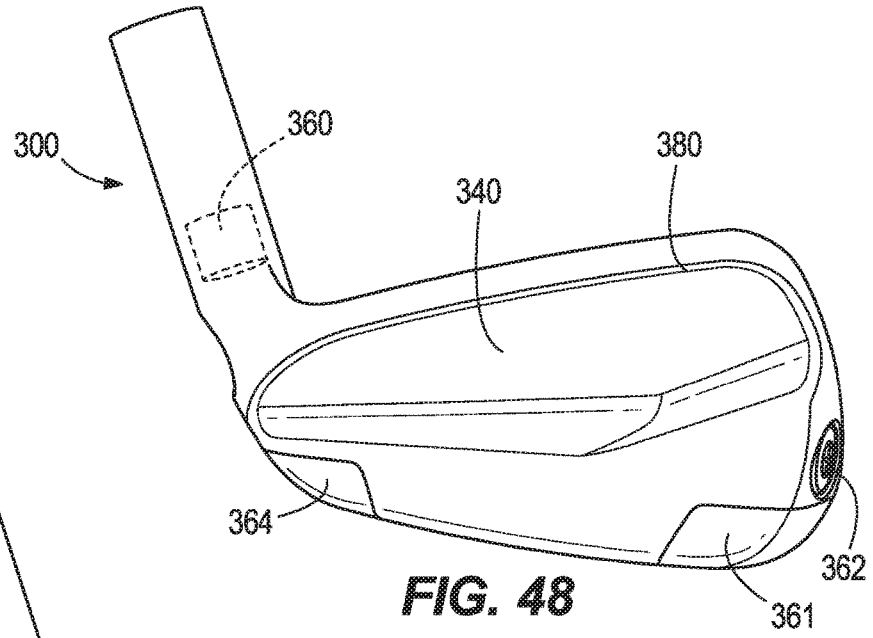
FIG. 48 shows a rear view of a golf club head having at least a toe and heel weight, according to an embodiment that is similar to the golf club head of FIG. 35.
Figure 49:
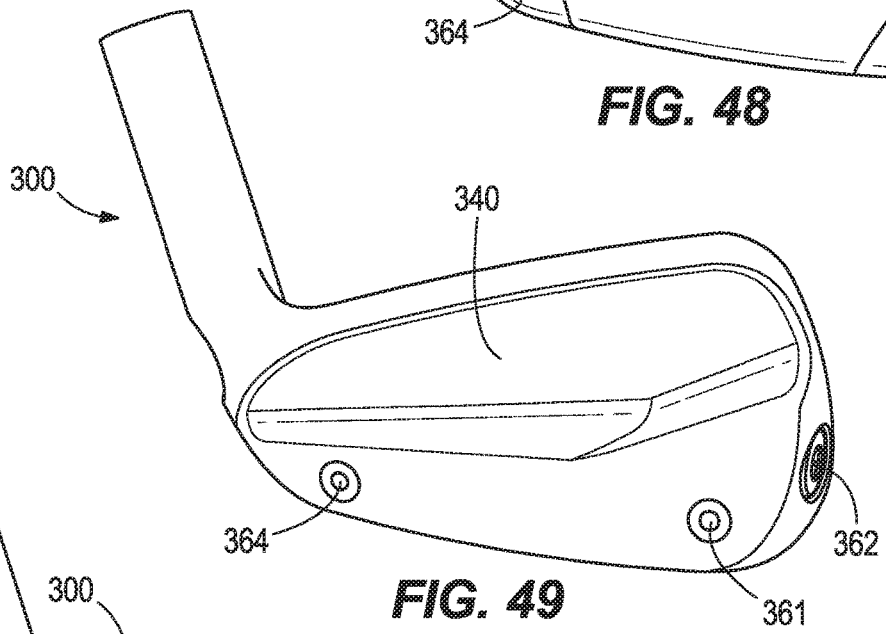
FIG. 49 shows a rear view of a golf club head having a plurality of weights, according to an embodiment that is similar to the golf club head of FIG. 35.
Figure 50:
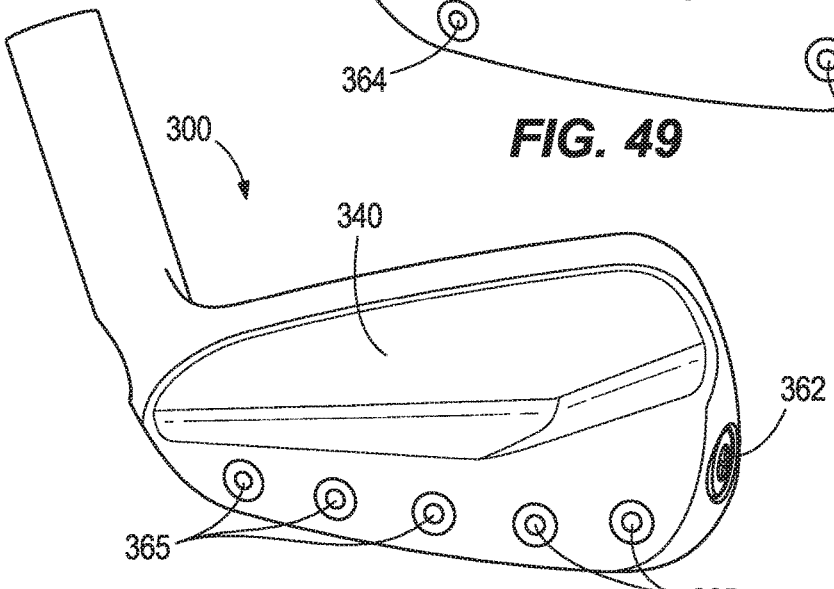
FIG. 50 shows a rear view of a golf club head having a plurality of weights, according to an embodiment that is similar to the golf club head of FIG. 35.

The golf club head 300 can comprise a toe weight 361, similar to the toe weights 161 and 661, a tip weight 360, similar to the tip weight 160 and 660, and a toe screw weight 362, similar to the toe screw weight 662. As illustrated in FIGS. 48-50, the golf club head 300 can additionally or alternately comprise a plurality of weights 365 disposed in the rear of the club head 300. In some embodiments, such as the one illustrated in FIG. 48, the club head 300 can comprise a toe weight 361 and a heel weight 364. In some embodiments, the toe weight 361 and the heel weight 364 can be swedged (swagged), welded, co-forged, or otherwise secured into receiving cavities of the club head 300. In other embodiments, the toe and heel weights 361, 364 are secured to the club head 300 via fastening mechanisms. For example, in the embodiment illustrated in FIG. 49, the toe weight 361 and heel weight 364 are screwed into receiving bores of the club head 300. In some embodiments, such as the one illustrated in FIG. 50, a plurality of weights 365 is secured or formed into the rear 303 of the club head 300.

IV. GOLF CLUB HEAD CHARACTERISTICS

A. Golf Club Head Measurements

The golf club head 100, 300, 600 can be a tour iron. The golf club head 100, 300, 600 described herein can be a tour iron head comprising a blade length, a hosel-x length, an offset distance, and an upper portion depth characteristic of tour iron. Characteristics that identify the golf club head 100 as a tour iron are described below. Golf club heads 300 and 600 can have tour iron characteristics similar to golf club head 100.

As illustrated in FIG. 2, the golf club head 100 comprises a blade length 173. The blade length 173 is measured as the maximum distance from an edge of the strikeface 111 in the heel region 102 to an edge of the club head 100 in the toe region 101. The blade length of a generic tour iron can be less than 2.8 inches. The blade length of a game-improvement iron is generally greater than 2.8 inches. The blade length 173 of golf club head 100 is less than 2.8 inches, as is characteristic of a tour iron. In some embodiments, the blade length 173 of golf club head 100 can be between 2.2 inch and 2.8 inch, 2.2 inch and 2.4 inch, 2.4 inch and 2.6 inch, or 2.6 inch and 2.8 inch.

As illustrated in FIG. 2, a hosel-X length 174 is measured from the centerplane 45 to an intersection of the hosel axis 70 with the lead edge axis 35. The hosel-X length of a tour iron is generally less than 1.5 inches, and the hosel-X length of a game improvement iron is generally greater than 1.5 inches. The hosel-X length of the golf club head 100 is less than 1.5 inches, as is characteristic of a tour iron. In some embodiments, the hosel-X length 174 can be between 1.30 inches and 1.50 inches, 1.30 inches and 1.40 inches, or 1.40 inches and 1.50 inches.

As illustrated in FIG. 4, an offset distance 173 is measured between a forward edge of the hosel 105 to a forwardmost point of the golf club head 100. Typically, the forwardmost point is located at the bottom of the strikeface 111 and adjacent the sole 107. The offset distance 172 can vary for golf club heads within the same set due to different loft angles. Therefore, in order to compare sets of irons, an average is taken of the offset distances 173 of all golf clubs within a set. The average offset for a tour iron set is generally less than 0.140 inch. The average offset for a game-improvement iron set is generally greater than 0.140 inch. The average offset for a set of golf clubs comprising golf club heads similar to club head 100 is less than 0.140 inch. The offset distance 172 of a single golf club head 100 can be between 0.100 inches and 0.160 inches. In some embodiments, the offset distance can be between 0.100 inch and 0.110 inch, 0.110 inch and 0.120 inch, 0.120 inch and 0.130 inch, 0.130 inch and 0.140 inch, 0.140 inch and 0.150 inch, or 0.150 inch and 0.160 inch.

An upper portion depth 116 is measured adjacent the top rail 106 and orthogonal to the strikeface 111 from the front 104 to the rear 103, as shown in FIG. 4. The average upper portion depth of a tour iron is generally less than 0.290 inch. The average upper portion depth of a game improvement iron is generally greater than 0.290 inch. The average upper portion depth for a set of golf clubs comprising golf club heads similar to golf club head 100 is less than 0.290 inch, as is characteristic of a set of tour irons.

A parameter that is similar between game-improvement and tour irons is the height of the golf club head. As illustrated in FIG. 2, the golf club head 100 can each have a maximum height 175 measured along the loft plane 20 from the lead edge axis 35 to the highest point on the top rail 106. Golf club head 600 can have a similar height golf club head 100. The maximum height 175 can be between 2.0 inches and 2.5 inches. In some embodiments, the maximum height 175 can be between 2.0 inches and 2.1 inches, 2.1 inches and 2.2 inches, 2.2 inches and 2.3 inches, 2.3 inches and 2.4 inches, and 2.4 inches and 2.5 inches.

Table I, below, compares blade length, hosel X, average offset, average upper portion depth, and maximum height of a tour iron versus a game improvement iron.

TABLE I

| | Blade Length | Hosel X | Offset (AVG of All Lofts) | Upper Portion Depth (AVG of All Lofts) | Maximum Height |
|---|---|---|---|---|---|
| Tour Iron | <2.8" | <1.5" | <0.140" | <0.290" | 2.0"-2.5" |
| Game Improvement | >2.8" | >1.5" | >0.140" | >0.290" | 2.0"-2.5" |

B. CG and MOI of Golf Club Head

In order to accurately understand the benefits of the perimeter weighting of the golf club head 100, 300, 600 one must consider both the MOI and CG characteristics of the golf club head 100, 300, 600 and the tour size of the golf club head 100, 300, 600. Although game-improvement irons are known for having high MOI values, they lack other features unique to tour irons. The golf club described herein marries the benefits of a game-improvement iron with a tour iron style.

In some embodiments, the CG 60 of the golf club head 100, 300, 600 was shifted down and back compared to a flat back tour iron. The CG 60 position of the golf club head 100, 300, 600 can also be measured from the lead edge plane.

The CG 60 of the golf club heads 100, 600 can be located above the lead edge plane by between 0.380 inch and 0.670 inch. In some embodiments, the CG 60 of the golf club heads 100, 600 can be located above the lead edge plane by between 0.400 inch and 0.650 inch, 0.380 inch and 0.400 inch, 0.400 inch and 0.420 inch, 0.420 inch and 0.440, 0.440 inch and 0.460 inch, 0.460 inch and 0.480 inch, 0.480 inch and 0.500 inch, 0.500 inch and 0.520 inch, 0.520 inch and 0.540 inch, 0.540 inch and 0.560 inch, 0.560 inch and 0.580 inch, 0.580 inch and 0.600 inch, 0.600 inch and 0.620 inch, 0.620 inch and 0.640 inch, 0.640 inch and 0.660 inch, or 0.660 inch and 0.670 inch. In other embodiments, the CG 60 can be located above the lead edge plane by 0.380 inch, 0.390 inch, 0.400 inch, 0.410 inch, 0.420 inch, 0.430 inch, 0.440 inch, 0.450 inch, 0.460 inch, 0.470 inch, 0.480 inch, 0.490 inch, 0.500 inch, 0.510 inch, 0.520 inch, 0.530 inch, 0.540 inch, 0.550 inch, 0.560 inch, 0.570 inch, 0.580 inch, 0.590 inch, 0.600 inch, 0.610 inch, 0.620 inch, 0.630 inch, 0.640 inch, 0.650 inch, 0.660 inch, or 0.670 inch.

As described above, the golf club heads 100, 300, and 600 described herein can comprise light weight inserts 140, 440, 240, 270, and/or 640 in the center of the golf club heads. The saved weight can be added to the perimeter of the golf club heads 100, 300, and 600 without greatly changing the overall weight of the golf club heads 100, 300, and 600, but does allow for a shifting of the CG 60, and raising of the MOI. This perimeter weighting can come in the form of toe weights, a tip weight, or added body material around the perimeter. The compact nature of the golf club heads 100, 300, and 600 leads to material properties playing a greater role in MOI improvement than structural sizing. The MOI about the CG 60 and about the x-axis 30, Ixx, can range from 70 to 140 gram square inches. The MOI about the CG 60 and about the y-axis 40, Iyy, can range from 310 to 500 gram square inches. These MOI values can apply to golf club heads 100, 300, and 600. These MOI values can further apply to any embodiment having insert 140, 640, multi-material insert 440, or weight-saving insert 240 or 270.

V. METHODS

Figure 54:
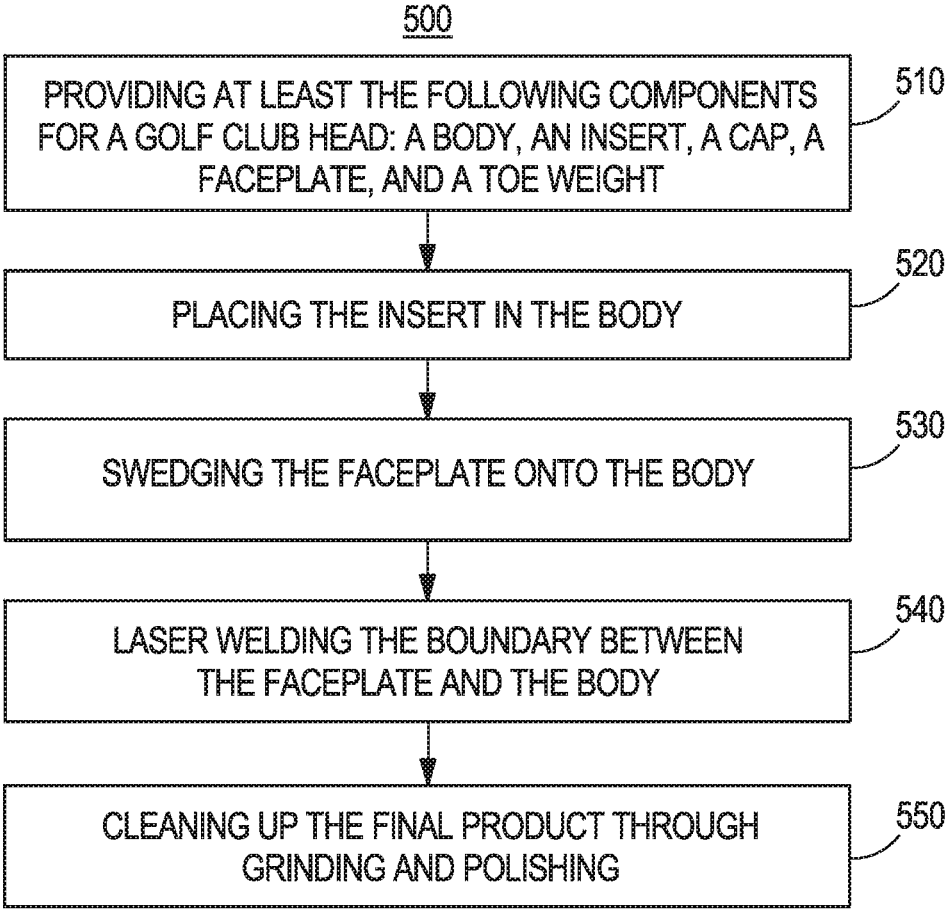
FIG. 54 shows a method of manufacturing a golf club head, according to an embodiment.
Figure 55:
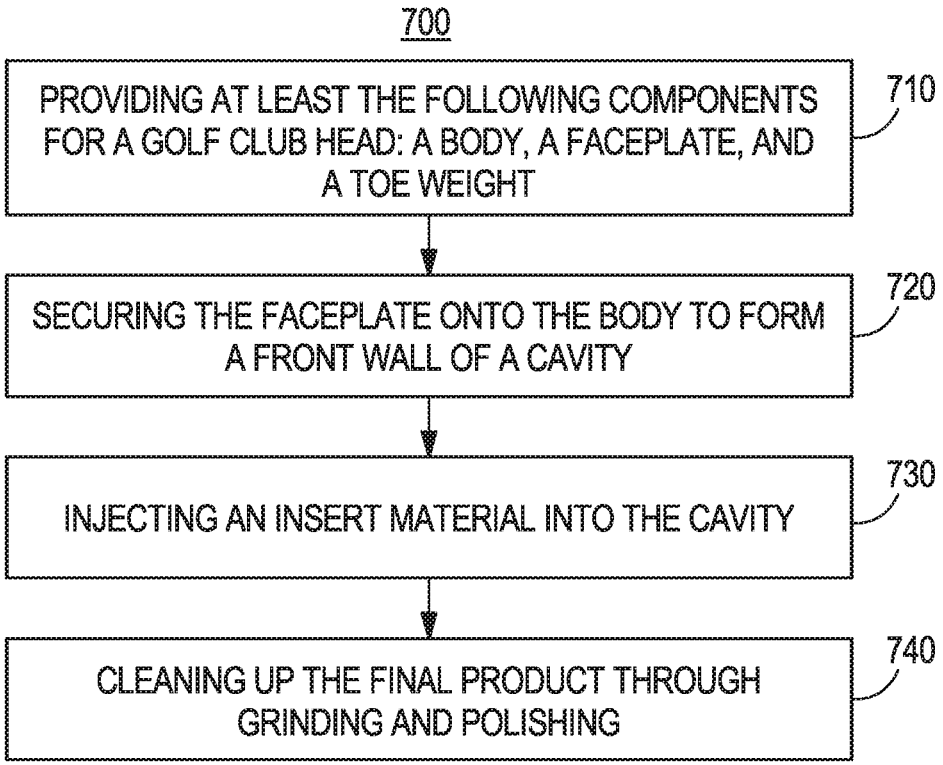
FIG. 55 shows a method of manufacturing a golf club head, according to a second embodiment.

As shown in FIG. 54, a method 500 of manufacturing the golf club head 100 is described herein. The method comprises providing each component 510, placing the insert in the body 520, swedging (swagging) the faceplate onto the body 530, laser welding a boundary between the faceplate and the body 540, and cleaning up the final product through grinding and polishing. In some embodiments of the method 500, the method 500 can consist of steps 510, 520, 530 and 550.

Step 510 can comprise providing at least a body 110, an insert 140 or a multi-material insert 440, and a faceplate 155 as components for the golf club head 100. In some embodiments, providing the body 110 can consist of one or more of:

forging, casting, forming by additive manufacturing, machining, or any other suitable method for forming the body 110. Step 510 can comprise forming the body 110 as a unitary piece.

In some embodiments, providing the insert 140 can consist of one or more of: forging, casting, forming by additive manufacturing, machining, or any other suitable method for forming the body 140. In some embodiments, the insert 140 or a portion of the multi-material insert 440 is molded by pouring a resin into a fiber reinforcing structure to form an elastomeric matrix composite. The insert 140 can be formed as a unitary piece having a uniform density or as multiple pieces having different densities. In some embodiments, having the multi-material insert 440, the insert 440 can be formed into a single unit or can be placed into the cavity 120 in two separate portions.

In some embodiments providing the multi-material insert 440 comprises (1) providing a first portion 450 of the insert 440, (2) providing a second portion 460 of the insert 440, and (3) joining the first and second portions 450, 460 of the insert 440. Providing the first portion 450 of the insert 440 can comprise molding the first portion 440. Providing the second portion 460 of the insert 440 can comprise casting, forging, stamping, die casting, or other means of providing the second portion 460. In some embodiments, the sub-steps of (1) providing the second portion 460 and (2) joining the first and second portions 450, 460 are combined when the first portion 450 is molded and joined to the second portion 460. In some embodiments, the insert 440 may be sanded, ground, or polished before being inserted into the cavity 120 of the golf club head 100.

In some embodiments, forming the faceplate 155 can consist of forging, casting, machining, forming by additive manufacturing, or otherwise forming the faceplate 155. In some embodiments, forming the faceplate 155 can comprise machining, casting, or forging a variable thickness geometry into the faceplate 155.

In some embodiments, step 510 of method 500 can further comprise providing a toe weight, a tip weight, and/or a toe screw weight. In these embodiments, step 510 further comprises welding the toe weight 161 into a toe cavity 114 of the body 110. In other embodiments, the toe weight 161 can be swedged (swaged), adhered, or otherwise secured onto the body 610. For embodiments of the golf club head 100 further comprising a toe screw weight, the toe screw weight can be screwed into the golf club head in step 510, 520, 530, or 550.

Step 520 of the method 500 comprises placing the insert 140 in a cavity 120 of the body 110. The insert 140 is inserted through a front opening of the cavity 120 at a front 104 of the body 110. In some embodiments, this step 520 involves applying adhesive, such as epoxy, to the cavity 120 of the body 110 and to the insert 140 to secure the insert 140 into the body 110. In some embodiments, this step 520 involves applying one more tape layers, such as tape layer 150, to the cavity 120 before placing the insert 140 into the cavity. The one or more tape layers, such as tape layer 150, can form a strong and durable connection between the insert 140 and the cavity 120 of the body 110. Furthermore, the use of tape can reduce the possibility for rattling and other undesirable quality issues. In some embodiments, various other methods of fastening the insert 140 to the body 110 are combined for maximum security. Not all embodiments of the method 500 require adhering or securing the insert 140 into the cavity 120.

Step 530 of method 500 comprises securing the faceplate 155 onto the body 110. The faceplate 155 is placed within the indentation 142. By placing the faceplate 155 in the indentation 142, the faceplate 155 is positioned so that it covers the insert 140 and the cavity 120 of the body 110. Step 530 can further comprise swedging (swagging) the faceplate 155 onto the body 110 so that the faceplate 155 is embedded in the indentation 142 on the front 104 of the body 110. In this way, the insert 140 is held within the golf club head 100 and completely isolated from the outside of the golf club head 100. In other embodiments, the faceplate 155 is adhered, press-fit, or otherwise secured to the body.

Some golf club heads are manufactured by methods including co-forging (also known as integrated forging) and joining individually cast parts by high temperature and high applied pressure. These methods apply high temperatures which affect multiple components of the golf club head, including any inserts. For example, the co-forging process occurs at temperatures between 700 and 1000 degrees Celsius. The melting point of some aluminum alloys falls between 650 and 680 degrees Celsius. Thus, for an aluminum insert, co-forging would ruin the integrity of the aluminum material. The insert 140, 440, the body 110, and the faceplate 155 are not co-forged together, because co-forging can lead to high temperatures which can compromise the insert 140, 440.

Furthermore, TIG welding a faceplate onto the golf club head could also impart high temperatures to the golf club head which could compromise the insert. The possible materials for a low-density center of an iron-type golf club head are significantly limited due to conventional manufacturing processes. The golf club head 100 can be manufactured with a wide variety of insert materials, because the manufacturing process does not place the final assembly under high temperatures. Additionally, some insert materials described herein, such as a thermoplastic composite, simply cannot be co-forged with a metal body material. The manufacturing method 500 described herein allows the insert 140, 440 to be formed from any suitable material without requiring that the material be able to be co-forged with the body 110.

Step 530 and step 540, described below, both employ low-heat methods of securing the faceplate 155 to enclose the insert 140 within the cavity 120. Swedging, laser welding, and other low temperature methods of securing the faceplate 155 allow the insert 140 or 440 to comprise a wide variety of materials in order to fine-tune acoustics, feel, and weighting. The low-head methods of steps 530 and 540 further allow versatility in the design, such as the use of adhesives and/or tape around the cavity 120 to reduce unwanted rattling and vibration.

Step 540 comprises laser welding a boundary between the faceplate 155 and the body 110. The process of step 540 is also referred to as surface fusion treatment. After the faceplate 155 is swedged onto the body 110 in step 530, the overlapping region or boundary between the faceplate 155 and the body 110 is laser welded. This laser welding process blends the metal materials of the faceplate 155 and the body 110 without creating a deep heat affected zone (hereafter "HAZ"). Laser welding the boundary eliminates any cracks or seams between the faceplate 155 and the body 110. In some embodiments, the golf club head 100 is finished with a coating in step 550, as described below. If the boundary has even minute cracks or seams, the coating can seep into the seams and cause quality issues. Laser welding the boundary in step 540 eliminates this manufacturing issue.

Step 540, described above, can be conducted without compromising the integrity of the materials within the cavity 120 because the HAZ depth is between 0.03 inch and 0.08 inch, which can be less than the thickness 112 of the faceplate 155. In some embodiments, the HAZ depth can be less than 0.08 inch, less than 0.07 inch, less than 0.06 inch, less than 0.05 inch, less than 0.04 inch, or less than 0.03 inch. In some embodiments, the HAZ depth can be 0.03 inch, 0.04 inch, 0.05 inch, 0.06 inch, 0.07 inch, or 0.08 inch. Laser welding heats the insert and other cavity fillers, such as tape layer(s), to a temperature that is lower than a melting temperature of the insert material. The heat imparted to the golf club head 100 during step 540 does not compromise any of the materials sealed within the cavity 120.

In step 550 of the method 550, the golf club head 100 is cleaned up through grinding and polishing. Grinding is used to create a smooth surface on the strikeface 111 of the golf club head 100. Furthermore, this step 550 can comprise polishing the surface of the golf club head 100 after grinding. In some embodiments, grooves are ground into the strikeface 111 of the faceplate 155, and the strikeface 111 is thereafter polished. No step in the manufacturing method 500 comprises co-forging with different materials.

As shown in FIG. 32, a method 700 of manufacturing a golf club head, similar to golf club head 600, comprises providing at least a body 610, an insert material, a faceplate 655, welding or swedging the faceplate 655 onto the body 610, injecting an insert material into the cavity 620 of the body 610, and polishing and cleaning the golf club head 600.

In step 710, the body 610 can be forged, cast, or formed by additive manufacturing. The faceplate 655 can be forged, cast, or formed by additive manufacturing. In a variation of the manufacturing process 700, the strikeface 655 is integrally formed as part of the body 610 rather than being separately formed as a faceplate 655 and welded or swedged onto a front opening of the body 610. In some embodiments, step 710 of method 700 further comprises providing a toe weight 661, a tip weight 650, and/or a toe screw weight 662. In these embodiments, step 710 further comprises welding the toe weight 661 into a toe cavity 614 of the body 610. In other embodiments, the toe weight 661 can be swedged (swaged), adhered, or otherwise secured onto the body 610. For embodiments of the golf club head 600 further comprising a toe screw weight 662, the toe screw weight 662 can be screwed into the golf club head in step 710, 720, 730, or 750.

Furthermore, in step 710 of method 700, an opening wall 782 defining a rear opening 680 can either be formed into the body 610 or can be cut into the rear 603 of the body 610 after the body 610 is formed. Step 710 can further comprise polishing or finishing the opening wall 782 of the rear 603.

Step 720 comprises placing the faceplate 655 within an indentation 642 of the body. The faceplate 655 is welded, swedged (swaged), or otherwise secured to the body 610. The body 610 and strikeplate 655 form a cavity 620. After the faceplate 655 is secured to the body 610, the only opening to the cavity 620 is the rear opening 680 of the body 610, as illustrated for the embodiment of FIGS. 14-23. In some embodiments, step 720 of method 700 can further comprise a laser welding or surface fusion treatment process, similar to that described in step 540 of method 500 above.

Step 720 can further comprise installing the toe screw weight 662 into a toe screw cavity 663. Since the toe screw cavity 663 opens into the body cavity 620, the toe screw weight 662 can be inserted into the toe screw cavity 663 to prevent the insert material from escaping through the toe screw cavity 663 during the injection molding of step 730. The club head 600 can be further prepared for injection molding by precision machining the rear surface or mouth of the rear opening 680. A provided golf club head that is cast or forged will typically lack a surface smooth enough to seal a mold around. In this embodiment of the manufacturing process, the rear surface or mouth of the rear opening 680 serves as a shutoff surface, up to which the injected material fills to during manufacturing. Tight tolerances are needed to provide a clean seal against the mold at the shutoff surface and prevent flash formation during injection molding. Therefore, the shutoff surface (in this embodiment, the rear surface or mouth of the rear opening 680) can be precision machined to give the surface an adequately tight tolerance against the mold.

In step 730, the insert material is injected, in liquid form, into the cavity 620 through the opening 60 in the rear. The cavity 620 of the body 610 serves as a mold for the injected material. In some embodiments, the injection molding process results in the insert material bonding to the surfaces of the cavity 620. To inject the material into the cavity 620 under pressure, an injection apparatus must be sealed to the mouth of the rear opening 680. The planar surface surrounding the rear opening 680 in the upper portion 608 of the golf club head 600 allows a good seal to be made between the injection apparatus and the body 610 of the golf club head 600. In some embodiments, where the insert 640 only partially fills the cavity 620, the injection apparatus is configured to further form a seal with a portion of the cavity 620 to prevent the material from filling the entire cavity 620.

Step 740 of the method 700, the golf club head 600 is cleaned up through grinding and polishing. Grinding is used to create a smooth surface on the strikeface 611 of the golf club head 600. Furthermore, this step 740 can comprise polishing the surface of the golf club head 600 after grinding. In some embodiments, grooves are ground into the strikeface 611 of the faceplate 655, and the strikeface 611 is thereafter polished.

A method of making some embodiments of the golf club head 600, resembles the method 500 more closely than the method 700 described above. In some embodiments, a method of forming the golf club head 600 wherein the golf club head 600 comprises a metal insert 640, would require placing the insert 640 within the cavity 640 prior to swedging on the faceplate 655.

VI. EXAMPLES

Example 1

Measurement of Golf Club Head

The golf club head 100, as described above, was measured using several different parameters. The included the blade length 173, hosel-x length 174, the offset distance 172, the upper portion depth 116, and the maximum height 175. These values were compared to a game improvement iron and are both shown in Table II, below. Both the golf club head 100 and the game improvement iron that were measured were 7-irons, having a roughly equivalent loft angle.

TABLE II

| Parameters for Example 1. | | | | | |
|---|---|---|---|---|---|
| | Blade Length | Hosel X | Offset | Upper Portion Depth | Maximum Height |
| Golf club head 100 | 2.727" | 1.345" | 0.085" | 0.250" | 2.040" |
| Game Improvement | 2.802" | 1.630" | 0.175" | 0.315" | 2.045" |

Example 2

Moment of Inertia (MOI) Comparison and Center of Gravity (CG) Comparison

A test has been conducted to compare the MOI of a traditional tour iron head to golf club heads 100 described above. The traditional tour iron head used in this comparison test is identical in size and headweight to the sample golf club head. Thus, this test isolated the MOI as a variable, to provide an accurate comparison of the performance of the sample over the traditional tour iron head. The test produced an Ixx value of roughly 108 gram square inches for the sample club head and an Ixx value of roughly 103 gram square inches for the traditional tour iron head. Therefore, the MOI around the x-axis 30 is approximately 4.8% higher in the sample club head. The test produced an Iyy value of roughly 413 gram square inches for the sample club head and an Iyy value of roughly 398 gram square inches for the traditional tour iron head. Therefore, the MOI around the y-axis 40 is approximately 3.7% higher in the sample club head. This test shows that the lightweight insert for the golf club head 100 provides an improvement in MOI without altering the size or weight of the golf club head 100.

Additionally, a comparison was done between five club heads: (1) an iron similar to golf club head 600, having an opening in the rear and an insert formed from TPC; (2) an iron similar to golf club head 600, having an opening in the rear and an insert formed from aluminum; (3) an iron similar to golf club head 100, having an enclosed cavity filled with a TPC insert; (4) an iron similar to golf club head 100, having an enclosed cavity filled with an aluminum insert; and (5) a solid steel club head having a similar overall club head volume to the golf club heads described herein. Measurements were taken using computer aided design (CAD) models of each golf club head. Table III below summarizes the MOI data collected. Table IV below summarizes the CG data collected.

Table III. MOI Comparison Data for Example 2

TABLE III

| MOI Comparison Data for Example 2 | | | | | |
|---|---|---|---|---|---|
| Club Head | Mass (g) | MOIxx | MOIyy | MOIxx efficiency | MOIyy efficiency |
| (1) Filled with TPC (opening in rear) | 265.0 | 97.4 | 414.4 | 0.368 | 1.564 |
| (2) Filled with Aluminum (opening in rear) | 278.0 | 100.0 | 421.8 | 0.360 | 1.517 |
| (3) Filled with TPC (enclosed cavity) | 254.1 | 96.1 | 410.3 | 0.378 | 1.615 |
| (4) Filled with Aluminum (enclosed cavity) | 265.0 | 98.0 | 415.5 | 0.370 | 1.568 |
| (5) Solid Steel | 314.0 | 106.6 | 438.8 | 0.340 | 1.398 |

Since MOI is a function of distance from the CG and mass, the MOI will reflect changes in the overall mass of the golf club head. Therefore, to accurately compare club head MOI, the difference in total mass of the golf club head must be accounted for. In order to illustrate the efficiency of the MOI across the compared golf club heads, the MOI was divided by the mass of the golf club head to arrive at an MOI efficiency value. The MOI efficiency value of golf club heads can be compared, independent of mass, to show how the structure and localized weighting of the golf club heads affects the MOI. Therefore, although the MOI values in both the x-axis 30 and the y-axis 40 directions were higher for the solid steel golf club head (5) than for the low-density insert golf club heads (1) through (4), the MOI efficiency of the solid steel golf club head (5) was lower than the MOI efficiency of golf club heads (1) through (4). Therefore, the golf club heads (1) through (4) with low-density inserts are more forgiving than a golf club head lacking the low-density insert 140, 440, 460 of the golf club head 100, 600 described herein.

As can be seen from Table III, the golf club heads (1) through (4) with low-density inserts have MOI efficiencies in the x-axis 30 direction of 5.9% to 11.2% higher than solid steel golf club head (5). As can be seen from Table III, the club heads (1) through (4) with low-density inserts have MOI efficiencies in the y-axis 40 direction of 8.5% to 15.5% higher than solid steel golf club head (5).

In addition to increasing the MOI, lowering of the CG can also benefit golf club head performance. The golf club heads 100, 300, 600 described herein comprise a lower CG 60 than an equivalent solid steel iron having a similar shape to golf club heads 100 and 600. Lower CG is desirable in tour irons because shots are easier to shape when the CG is lower. For golf club head 600, the lowering of the CG is due in part to the elimination of high-density body material by inclusion of the opening 680 in the rear 603.

TABLE IV

CG Comparison Data for Example 2

| Golf Club Head | Mass (g) | CGx | CGy | CGz |
|---|---|---|---|---|
| (1) Filled with TPC (opening in rear) | 265.0 | 0.037 | 0.528 | −0.510 |
| (2) Filled with Aluminum (opening in rear) | 278.0 | 0.022 | 0.532 | −0.517 |
| (3) Filled with TPC (enclosed cavity) | 254.1 | 0.055 | 0.566 | −0.525 |
| (4) Filled with Aluminum (enclosed cavity) | 265.0 | 0.040 | 0.562 | −0.528 |
| (5) Solid Steel | 314.0 | −0.012 | 0.543 | −0.539 |

Referring to FIG. 1, the CGy is measured in the y-axis 40 direction (vertical) and upward from the lead edge axis 35. The CGx is measured horizontally along the lead edge axis 35 with the origin at the y-axis 40, such that the CG is closer to the heel 102 when the CGx value is positive. The CGz is measured rearward, horizontally along the z-axis 50 from the lead edge axis 35. The CGy value is lower in golf club heads 1 and 2 than in golf club heads 3-5. This shows that the golf club heads having the opening in the rear of the body (similar to golf club head 600, described above) have a desirably lower CG. The CG is 2.06% lower in club head 2 than in steel club head 5. The CG is 2.84% lower in golf club head 1 than in steel golf club head 5, indicating that the low-density TPC insert results in an even better CG placement than its aluminum insert counterpart (golf club head 2).

The comparison data in Tables III and IV further illustrates the strengths of the enclosed cavity embodiments and the rear opening embodiments. Although all embodiments of the invention (comparison golf club heads (1) through (4)) show improvements over the solid club head (5), both the enclosed cavity embodiments (comparison golf club heads (3) and (4)) and the rear opening embodiments (comparison golf club heads (1) and (2)) provide unique benefits. The comparison data shows that the MOI efficiency in both the x-axis 30 direction and the y-axis 40 direction is higher in the enclosed cavity club heads (3) and (4) than in the club heads (1), (2), and (5), as shown in the MOI efficiency columns of Table II. This suggests that the enclosed cavity embodiments, similar to golf club heads 100 described herein or comparison club heads (3) and (4), are more forgiving than embodiments having an opening in the rear, such as golf club head 600 or comparison club heads (1) and (2). However, embodiments with a rear opening 680 in the body 610 have lower CG values than the embodiments having an enclosed cavity, as shown in the CGy column of Table IV.

Example 3

Center of Gravity Flat Back Versus Inflection Seam Back Comparison

In addition to MOI and feel, the location of the CG of a golf club head affects performance. In particular, the CG location affects the amount of torque that is imparted to the golf club head upon impact with a golf ball. By lowering the CG, the arm between the force applied by the golf ball and the CG is lessened, since the golf ball is typically struck with a lower portion of the strikeface. This shortened arm between the applied force and the CG results in lower torque and improved launch characteristics upon impact with a golf ball. Therefore, in order to provide the golfer with the best possible experience, the golf club head described herein comprises a low CG.

To illustrate the how the uniform depth of the upper portions 108, 608 of the golf club head 100, 600 leads to a lower CG 60, a comparison was done between a golf club head, similar to golf club heads 100, 300, and 600, and a comparison golf club head having a varying depth from its top rail to its sole. The comparison golf club head has a planar rear stretching from its top rail to its sole. In order to provide an accurate illustration, the comparison golf club head and the golf club head similar to 100, 300, and 600 were both modeled with the same total mass. The results of the comparison are outlined in Table IV below.

TABLE IV

CG Comparison Data for Example 3

| Golf Club Head | Mass (g) | CGx | CGy | CGz |
|---|---|---|---|---|
| Golf club head similar to 100, 300, and 600 (rear with inflection point & uniform upper portion depth) | 261.0 | 0.044 | 0.569 | −0.528 |
| Comparison golf club head (planar rear) | 261.0 | 0.047 | 0.608 | −0.542 |

As shown in Table IV, the CGy value, which is measured along the vertical y-axis 40, is significantly lower for the golf club head similar to 100, 300, and 600. Specifically, the golf club head similar to 100, 300, and 600 comprises a CGy 0.039 inch lower than the comparison golf club head. This shows that the uniform depth of the upper portion 108, 608 above the inflection point 130, 630, lowers the CG, providing better launch and spin characteristics and higher ball speed.

Furthermore, the CGz value, is measured along the z-axis 50, wherein rearward of the CG 60 is negative and forward of the CG 60 is positive. The CG 60 of the golf club head similar to 100, 300, and 600 is closer to the front of the golf club head.

Example 4

Feel and Sound

Part of the appeal of tour irons is their compact profile and sleek aesthetic design. Furthermore, forged golf club heads are perceived by many golfers to perform better than cast club heads. Therefore, it is critical that a tour iron satisfy these expectations. Golfers especially enjoy the sound and feel of forged tour irons over other types of irons. In golf the "feel" of the golf club head, as perceived by a golfer, plays a big role in the golfer's performance. The "feel" is generally affected by weighting, materials, acoustics, and the thickness of the strikeface. Most golfers agree that tour irons provide a solid feel that is absent from many other types of irons. The golf club heads described herein exhibit a solid feel and acoustic quality that equals if not exceeds existing tour irons.

A survey has been conducted to quantify the feel of a sample tour iron, having a golf club head similar to the golf club head 100 described herein. Twenty golfers participated in the survey and compared their experiences with the sample iron to their experiences with a traditional tour iron. After using both the sample and the traditional iron, survey participants were asked the following question for each iron:

"How satisfied are you with the impact experience (feel/sound) that this iron provides?" A majority of the players preferred the impact experience of the sample tour iron over the traditional tour iron.

Finally, the quality and durability of the iron is critical to lasting performance. The strikeface 111, 311, and 611 is engineered to withstand, alone, the stresses placed on it by striking a golf ball. However, the inclusion of the thermoplastic composite insert 140 or 640, the fully metal insert 140 or 640, the multi-material insert 440, or the weight-saving insert 240 or 280, gives the golf club head an additionally solid feel and improves the acoustic quality of the golf club head over similar hollow-bodied golf club heads. The faceplate 155, 655 can improve the quality and durability of the golf club head by ensuring that the insert 140, 340, 440, 240, 280, or 640 remains secured inside the golf club head at all times.

Example 5

Performance Test

A test was performed to compare a control club, a first test club with an insert having a Shore A30 hardness (similar to golf club head 600, described above), and a second test club with an insert formed from TPU (similar to golf club head 600, described above). Shot data for all three clubs was recorded for twelve golfers. The results showed that the first test club (Shore A30 insert) and the second test club (TPU insert) both exhibited a ball speed roughly similar to (within 0.9 mph of) the control club. The launch angles and spin rates of the first and second test clubs were not significantly different than the launch angle of the control club. It was predicted that the control club would outperform the first and second test clubs in ball speed, launch angle, and spin rate due to the material of the insert. Therefore, it was unexpected when the test results showed that the three clubs performed with similar ball speed, launch angle, and spin rate.

Figure 53:
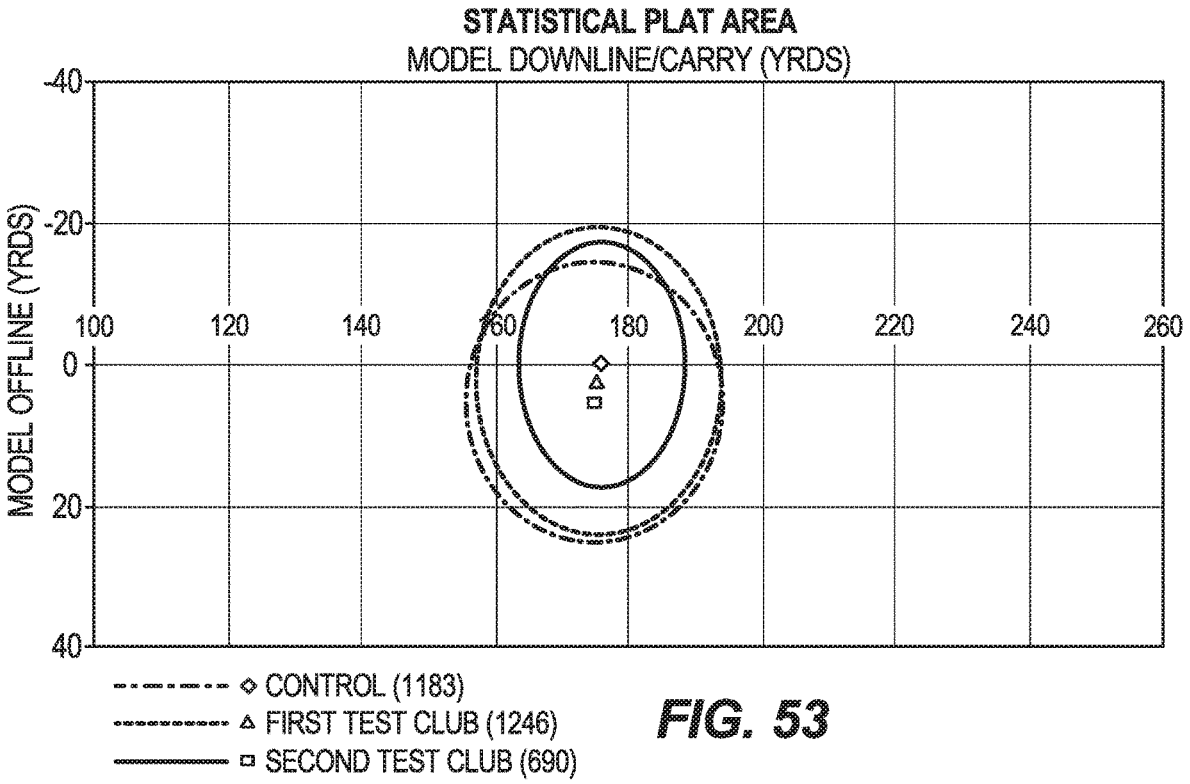
FIG. 53 shows a statistical plot area chart of a golf club comparison test.

As illustrated in FIG. 53, although the ball speed, launch angle, and spin rate were comparable for the three clubs, the second test club exhibited more downline (or carry) and offline consistency. The landing point for every shot was charted and analyzed to determine a statistical plot area for each club. The statistical plot area is an elliptical area, determined from the test data, within which 90% of any future shots would be expected to fall. The statistical plot area is determined by first taking the average standard deviation of the downline distance of the test shots and multiplying it by a factor to form the downline radius of the ellipse. Taking the average standard deviation of the offline distance of the test shots and multiplying it by a factor results in the offline radius of the ellipse. The statistical plot area ellipse is centered on the average downline and offline distance in which 90% of any future shots would be expected to fall.

The first test club performed similarly to the control club. The first test club produced a statistical plot area of 1246 square yards, while the control club produced a statistical plot area of 1183 square yards. However, the second test club (TPU insert) produced a statistical plot area that is approximately 42% smaller than the size of the control club statistical plot area. The second test club produced a statistical area of 690 square yards. The smaller statistical plot area of the second test club shows that this club (TPU insert) greatly increases the consistency of a golfer's shots. As plotted in FIG. 53, the second test club (TPU insert) exhibited greater consistency in both the downline and offline directions, compared to the control and first test club. This performance test showed that the second golf club (TPU insert, similar to golf club head 600) provided greater shot precision than the control or first golf clubs.

By combining and balancing CG placement, perimeter weighting for MOI, and a tour iron look and feel, the golf club head 100, 300, 600 described herein fills a need in the art for an iron type club head that marries the reliability of a game-improvement iron with the elegance of a tour iron. The golf club head can 600 further exhibit downline and offline consistency that is greater than traditional golf club heads.

The golf club heads 100 and 600 described herein functions as tour type golf club heads. The golf club head 300 can function as either a tour type iron or a game-improvement iron. The golf club heads 100 and 600, and optionally 300, offer a high MOI while remaining smaller than typical game-improvement irons. These multi-material golf club heads 100 and 600, and optionally 300, offer a compact product with exceptional forgiveness.

While FIGS. 1-52 depict specific embodiments of golf club heads, the disclosure of embodiments is intended to be illustrative of the scope of the present disclosure and is not intended to be limiting. It is intended that the scope of the present disclosure shall be limited only to the extent required by the appended claims.

As the rules to golf may change from time to time (e.g., new regulations may be adopted or old rules may be eliminated or modified by golf standard organizations and/or governing bodies), golf equipment related to the methods, apparatus, and/or articles of manufacture described herein may be conforming or non-conforming to the rules of golf at any particular time. Accordingly, golf equipment related to the methods, apparatus, and/or articles of manufacture described herein may be advertised, offered for sale, and/or sold as conforming or non-conforming golf equipment. The methods, apparatus, and/or articles of manufacture described herein are not limited in this regard.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Clause 1: A golf club head comprising: a faceplate, a body, and an insert; the body comprising an upper portion, a lower portion, a sole, a rear, and a top rail; wherein: the sole rests on a ground plane; a loft plane is tangential to the faceplate and intersects the ground plane; the rear comprises an inflection seam; the upper portion is bounded by the top rail and the inflection seam; the lower portion is bounded by the inflection seam and the sole; the faceplate, the sole, the rear, and the top rail enclose a cavity; the insert is received in the cavity; the insert comprises an insert upper portion configured to be received into the upper portion of the body; the insert comprises an insert lower portion configured to be received into the lower portion of the body; one or more recesses are formed within the insert lower portion; the faceplate comprises a first material of a first density; the body comprises a second material of a second density; the insert comprises a third material of a third density; and the third density is less than the first and second densities.

Clause 2: The golf club head of clause 1, wherein: the insert comprises a front surface, a rear surface, a perimeter, and an insert inflection seam that separates the insert upper portion from the insert lower portion; the insert upper portion and the insert lower portion are integrally formed at the insert inflection seam; the one or more recesses extend inwards from the front surface towards, but not through, the rear surface of the insert; the insert perimeter lies flush against walls of the cavity; and the one or more recesses open only towards the faceplate.

Clause 3: The golf club head of clause 1, wherein: the one or more recesses comprise a number of recesses selected from the group consisting of: two recesses, three recesses, four recesses, five recesses, and six recesses; and the insert further comprises one or more ribs that separate the number of recesses.

Clause 4: The golf club head of clause 3, wherein the one or more ribs are oriented orthogonal to the faceplate, in a direction parallel to a top rail-to-sole direction.

Clause 5: The golf club head of clause 1, wherein the insert upper portion is solid.

Clause 6: The golf club head of clause 1, wherein: the insert comprises a front surface, a rear surface, a perimeter, and an insert inflection seam that separates the insert upper portion from the insert lower portion; the insert upper portion further comprises at least one connecting rail that forms two or more apertures; the perimeter of the insert forms a frame to support the at least one connecting rail; and the at least one connecting rail can comprise a number of rails selected from the group consisting of: one, two, three, four, five, six, seven, eight, nine, and ten rails.

Clause 7: The golf club head of clause 1, wherein: the insert weighs less than a similar insert lacking the one or more recesses by a mass selected from the group consisting of: between 5 and 6 grams, between 5.5 and 6.5 grams, between 6 and 7 grams, between 6.5 and 7.5 grams, between 7 and 8 grams, between 7.5 and 8.5 grams, between 8 and 9 grams, between 8.5 and 9.5 grams, and between 9 and 10 grams.

Clause 8: The golf club head of clause 1, wherein: the insert fills a percentage of a volume of the cavity, selected from the group of ranges consisting of: 80% to 85%, 85% to 90%, 90% to 95%, 95% to 100%, and 80% to 90%.

Clause 9: The golf club head of clause 1, wherein: the upper portion of the insert comprises a height measured from the top rail to the inflection seam, in a direction parallel to the loft plane; the lower portion of the insert comprises a height measured from the sole to the inflection seam, in a direction parallel to the loft plane; the height of the upper portion and the height of the lower portion have a ratio of between 9:8 and 6:11; the upper portion comprises a first depth and the lower portion comprises a second depth, wherein the depths are measured perpendicular to the loft plane from the striking surface to an outer surface of the rear; and the first depth is constant and is less than the second depth.

Clause 10: The golf club head of clause 1, further comprising: a heel and a toe; an x-axis, extending in a heel-to-toe direction, parallel to the striking surface, and coincident with a center of gravity of the club head; a y-axis, orthogonal to the ground plane and coincident with the center of gravity; wherein: a moment of inertia, Ixx, measured about the x-axis ranges between 78 gram square inches and 120 gram square inches; and a moment of inertia, Iyy, measured about the y-axis ranges between 310 gram square inches and 466 gram square inches.

Clause 11: The golf club head of clause 1, wherein the third density is between 2.4 and 5.0 g/cc.

Clause 12: The golf club head of clause 11, wherein the third material comprises a material selected from the group consisting of: aluminum and titanium.

Clause 13: The golf club head of clause 1, wherein the first density is between 2.6 and 8.7 g/cc and the second density is between 7.7 and 8.1 g/cc.

Clause 14: The golf club head of clause 13, wherein the first material comprises a material selected from the group consisting of: a steel-based material, a titanium-based material, an aluminum alloy, or a titanium alloy; the second material comprises a material selected from the group consisting of: a steel-based material or a steel alloy.

Clause 15: The golf club head of clause 1, further comprising: a total mass; a toe weight; wherein: the body further comprises: a toe cavity; the toe cavity receives the toe weight; and the toe weight comprises a mass between 5% and 45% of the total mass of the club head.

Clause 16: The golf club head of clause 1, further comprising: a center of gravity; and a lead edge axis, parallel to the ground plane, extending in a heel-to-toe direction, and coincident with the loft plane; a lead edge plane, parallel to the ground plane and coincident with the lead edge axis; a y-axis, orthogonal to the ground plane, and coincident with the center of gravity; and wherein the center of gravity of the golf club head is located between 0.380 inch and 0.670 inch above the lead edge plane.

Clause 17: The golf club head of clause 1, further comprising: a heel and a toe; a centerplane running vertically through a centerpoint of the faceplate; a cylindrical hosel integral to the body; a hosel reference plane, parallel to a front edge of the cylindrical hosel, when viewed from a toe side view; a hosel axis, defined as the central axis of the cylindrical hosel; a lead edge axis, parallel to the ground plane, extending in a heel-to-toe direction, and coincident with the loft plane; a hosel-X distance, measured from the intersection of the lead edge axis with the centerplane to the intersection of the lead edge axis with the hosel axis, when viewed from a front view, wherein the hosel-X distance is less than 1.5 inches; and an offset distance, measured as the minimum distance between the lead edge axis and the hosel reference plane; wherein the offset distance between 0.05 inch and 0.27 inch.

Clause 18: The golf club head of clause 1, further comprising: a heel and a toe; and a blade length, measured in a heel-to-toe direction from an edge of the striking surface in the heel to an outermost point on the toe; wherein the blade length is less than 2.8 inches.

Clause 19: The golf club head of clause 1, further comprising a high density tape disposed between the insert and the faceplate.

Clause 20: The golf club head of clause 1, wherein: the body further comprises an indentation; the indentation abuts a periphery of the cavity; an area of a rear surface of the faceplate contacts the insert; a remaining area of the rear surface of the faceplate contacts the indentation.

Clause 21: A golf club head comprising: a body and an insert; the body comprising an upper portion, a lower portion, a sole, a rear, a toe region, a heel region, and a top rail; wherein: the sole rests on a ground plane; a loft plane is tangential to the faceplate and intersects the ground plane;

the rear comprises an inflection seam; the upper portion is bounded by the top rail and the inflection seam; the lower portion is bounded by the inflection seam and the sole; the sole, the rear, and the top rail of the body enclose a cavity; the body defines a front opening that connects to the cavity; the insert harbors within the cavity and the front opening; the insert form at least a portion of a striking surface; the body comprises a first material of a first density; the insert comprises a second material of a second density; and the second density is less than the first density.

Clause 22: The golf club head of clause 21, wherein: the insert comprises an insert upper portion configured to be received into the upper portion of the body; the insert comprises an insert lower portion configured to be received into the lower portion of the body; and both the insert upper portion and the insert lower portion form at least a portion of the strikeface.

Clause 23: The golf club head of clause 21, wherein the first density of the first material is between 7.70 and 8.10 g/cc.

Clause 24: The golf club head of clause 21, wherein the second material comprises a polymeric resin and a reinforcing fiber.

Clause 25: The golf club head of clause 24, wherein the second material is selected from the group consisting of: a glass-filled elastomer, a stainless steel-filled elastomer, a tungsten-filled elastomer, a thermoplastic polyurethane (TPU), a thermoplastic elastomer (TPE), a Kevlar® (aramid) fiber-reinforced polymer, and a carbon-fiber reinforced polymer.

Clause 26: The golf club head of clause 21, wherein the second density of the second material is between 0.8 g/cc and 1.4 g/cc.

Clause 27: The golf club head of clause 21, wherein: the body further comprises an opening wall in the rear that defines a rear opening; the rear opening is opposite the front opening and is located within the upper portion of the body; and the insert further harbors within the rear opening.

Clause 28: The golf club head of clause 27, wherein a mass of the upper portion of the body is between 1 gram and 70 grams less than the mass of a golf club head lacking a rear opening and an insert with a density less than a body.

Clause 29: The golf club head of clause 29, wherein the body further comprises one or more securing features, disposed inside the cavity and extending from one or more of the rear, the sole, the toe region, and the heel region.

Clause 30: The golf club head of clause 29, wherein at least one of the securing features extends from the rear to the sole within the cavity.

Clause 31: The golf club head of clause 29, wherein: at least one of the securing features comprises a first end and a second end; and both the first end and the second end are attached to the sole within the cavity.

Clause 32: The golf club head of clause 29, wherein at least one of the securing features forms a through-hole that is filled by the insert; the insert being geometrically locked to the at least one securing feature.

Clause 33: The golf club head of clause 21, wherein: the body further comprises an undercut in the top rail; the undercut forms part of the cavity; and the insert fills the undercut, causing the insert to mechanically lock into the cavity.

Clause 34: The golf club head of clause 21, wherein: the body further comprises an undercut in the sole; the undercut forms part of the cavity; and the insert fills the undercut, causing the insert to mechanically lock into the cavity.

Clause 35: The golf club head of clause 21, further comprising: an x-axis, extending in a heel-to-toe direction, parallel to the striking surface, and coincident with a center of gravity of the club head; a y-axis, orthogonal to the ground plane and coincident with the center of gravity; wherein: a moment of inertia, Ixx, measured about the x-axis ranges between 78 gram square inches and 120 gram square inches; and a moment of inertia, Iyy, measured about the y-axis ranges between 310 gram square inches and 466 gram square inches.

Clause 36: The golf club head of clause 21, wherein the first material comprises a material selected from the group consisting of: a steel-based material, a titanium-based material, an aluminum alloy, and a titanium alloy.

Clause 37: The golf club head of clause 21, further comprising: a total mass; a toe weight; wherein: the body further comprises: a toe cavity; the toe cavity receives the toe weight; and the toe weight comprises a mass between 5% and 45% of the total mass of the club head.

Clause 38: The golf club head of clause 21, further comprising: a center of gravity; and a lead edge axis, parallel to the ground plane, extending in a heel-to-toe direction, and coincident with a point on the loft plane; a lead edge plane, parallel to the ground plane and coincident with the lead edge axis; a y-axis, orthogonal to the ground plane, and coincident with the center of gravity; and wherein the center of gravity of the golf club head is located between 0.380 inch and 0.670 inch above the lead edge plane.

Clause 39: The golf club head of clause 21, further comprising: a heel and a toe; a centerplane running vertically through a centerpoint of the faceplate; a cylindrical hosel integral to the body; a hosel reference plane, parallel to a front edge of the cylindrical hosel, when viewed from a toe side view; a hosel axis, defined as the central axis of the cylindrical hosel; a lead edge axis, parallel to the ground plane, extending in a heel-to-toe direction, and coincident with the loft plane; a hosel-X distance, measured from the intersection of the lead edge axis with the centerplane to the intersection of the lead edge axis with the hosel axis, when viewed from a front view, wherein the hosel-X distance is less than 1.5 inches; and an offset distance, measured as the minimum distance between the lead edge axis and the hosel reference plane; wherein the offset distance between 0.05 inch and 0.27 inch.

Clause 40: The golf club head of clause 21, further comprising: a heel and a toe; and a blade length, measured in a heel-to-toe direction from an edge of the striking surface in the heel to an outermost point on the toe; wherein the blade length is less than 2.8 inches.

What is claimed is:

1. A golf club head comprising: a faceplate, a body, and an insert; the body comprising an upper portion, a lower portion, a sole, a rear, and a top rail; wherein: the sole rests on a ground plane; a loft plane is tangential to the faceplate and intersects the ground plane; the rear comprises an inflection seam; the upper portion is bounded by the top rail and the inflection seam; the lower portion is bounded by the inflection seam and the sole; the faceplate, the sole, the rear, and the top rail enclose a cavity; the insert is received in the cavity; the insert comprises an insert upper portion configured to be received into the upper portion of the body; the insert comprises an insert lower portion configured to be received into the lower portion of the body; one or more recesses are formed within the insert lower portion; the faceplate comprises a first material of a first density; the body comprises a second material of a second density; the insert comprises a third material of a third density; and the third density is less than the first and second densities; wherein: the insert comprises a front surface, a rear surface, a perimeter, and an insert inflection seam that separates the insert upper portion from the insert lower portion; the insert upper portion and the insert lower portion are integrally formed at the insert inflection seam; the one or more recesses extend inwards from the front surface towards, but not through, the rear surface of the insert; the insert perimeter lies flush against walls of the cavity; and the one or more recesses open only towards the faceplate; and wherein the insert upper portion further comprises at least one connecting rail that forms two or more apertures in the front surface.

2. The golf club head of claim 1, wherein:

the one or more recesses comprise a number of recesses selected from the group consisting of: two recesses, three recesses, four recesses, five recesses, and six recesses; and the insert further comprises one or more ribs that separate the number of recesses.

3. The golf club head of claim 2, wherein the one or more ribs are oriented orthogonal to the faceplate, in a direction parallel to a top rail-to-sole direction.

4. The golf club head of claim 1, wherein the insert upper portion is solid.

5. The golf club head of claim 1, wherein: the perimeter of the insert forms a frame to support the at least one connecting rail; and the at least one connecting rail comprises a number of rails selected from the group consisting of: one, two, three, four, five, six, seven, eight, nine, and ten rails.

6. The golf club head of claim 1, wherein:

the insert weighs less than a similar insert lacking the one or more recesses by a mass selected from the group consisting of: between 5 and 6 grams, between 5.5 and 6.5 grams, between 6 and 7 grams, between 6.5 and 7.5 grams, between 7 and 8 grams, between 7.5 and 8.5 grams, between 8 and 9 grams, between 8.5 and 9.5 grams, and between 9 and 10 grams.

7. The golf club head of claim 1, wherein:

the insert fills a percentage of a volume of the cavity, selected from the group of ranges consisting of: 80% to 85%, 85% to 90%, 90% to 95%, 95% to 100%, and 80% to 90%.

8. The golf club head of claim 1, wherein:

the upper portion of the insert comprises a height measured from the top rail to the inflection seam, in a direction parallel to the loft plane;

the lower portion of the insert comprises a height measured from the sole to the inflection seam, in a direction parallel to the loft plane;

the height of the upper portion and the height of the lower portion have a ratio of between 9:8 and 6:11;

the upper portion comprises a first depth and the lower portion comprises a second depth, wherein the depths are measured perpendicular to the loft plane from the faceplate to an outer surface of the rear; and the first depth is constant and is less than the second depth.

9. The golf club head of claim 1, further comprising:

a heel and a toe;

an x-axis, extending in a heel-to-toe direction, parallel to the faceplate, and coincident with a center of gravity of the club head;

a y-axis, orthogonal to the ground plane and coincident with the center of gravity;

wherein:

a moment of inertia, Ixx, measured about the x-axis ranges between 78 gram square inches and 120 gram square inches; and a moment of inertia, Iyy, measured about the y-axis ranges between 310 gram square inches and 466 gram square inches.

10. The golf club head of claim 1, wherein the third density is between 2.4 and 5.0 g/cc.

11. The golf club head of claim 10, wherein the third material comprises a material selected from the group consisting of: aluminum and titanium.

12. The golf club head of claim 1, wherein the first density is between 2.6 and 8.7 g/cc and the second density is between 7.7 and 8.1 g/cc.

13. The golf club head of claim 12, wherein the first material comprises a material selected from the group consisting of: a steel-based material, a titanium-based material, an aluminum alloy, or a titanium alloy;

the second material comprises a material selected from the group consisting of: a steel-based material or a steel alloy.

14. The golf club head of claim 1, further comprising:

a total mass;

a toe weight;

wherein:

the body further comprises: a toe cavity;

the toe cavity receives the toe weight; and the toe weight comprises a mass between 5% and 45% of the total mass of the club head.

15. The golf club head of claim 1, further comprising:

a center of gravity; and a lead edge axis, parallel to the ground plane, extending in a heel-to-toe direction, and coincident with the loft plane;

a lead edge plane, parallel to the ground plane and coincident with the lead edge axis;

a y-axis, orthogonal to the ground plane, and coincident with the center of gravity; and wherein the center of gravity of the golf club head is located between 0.380 inch and 0.670 inch above the lead edge plane.

16. The golf club head of claim 1, further comprising:

a heel and a toe;

a centerplane running vertically through a centerpoint of the faceplate;

a cylindrical hosel integral to the body;

a hosel reference plane, parallel to a front edge of the cylindrical hosel, when viewed from a toe side view;

a hosel axis, defined as the central axis of the cylindrical hosel;

a lead edge axis, parallel to the ground plane, extending in a heel-to-toe direction, and coincident with the loft plane;

a hosel-X distance, measured from the intersection of the lead edge axis with the centerplane to the intersection of the lead edge axis with the hosel axis, when viewed from a front view, wherein the hosel-X distance is less than 1.5 inches; and an offset distance, measured as the minimum distance between the lead edge axis and the hosel reference plane; wherein the offset distance between 0.05 inch and 0.27 inch.

17. The golf club head of claim 1, further comprising:

a heel and a toe; and a blade length, measured in a heel-to-toe direction from an edge of the faceplate in the heel to an outermost point on the toe; wherein the blade length is less than 2.8 inches.

18. The golf club head of claim 1, further comprising a high density tape disposed between the insert and the faceplate.

19. The golf club head of claim 1, wherein:

the body further comprises an indentation;

the indentation abuts a periphery of the cavity;

an area of a rear surface of the faceplate contacts the insert;

a remaining area of the rear surface of the faceplate contacts the indentation.

* * * * *